United States Patent [19]

Ishikawa et al.

[11] Patent Number: 4,797,351

[45] Date of Patent: Jan. 10, 1989

[54] METHOD FOR PROCESSING SILVER HALIDE COLOR PHOTOGRAPHIC MATERIALS

[75] Inventors: Masao Ishikawa; Shigeharu Koboshi; Kazuyoshi Miyaoka; Satoru Kuse, all of Hino, Japan

[73] Assignee: Konishiroku Photo Industry Co., Ltd., Tokyo, Japan

[21] Appl. No.: 856,779

[22] Filed: Apr. 25, 1986

[30] Foreign Application Priority Data

Apr. 30, 1985 [JP] Japan ..... 60-94760

[51] Int. Cl.[4] ..... G03C 7/30; G03C 7/38

[52] U.S. Cl. ..... 430/387; 430/386; 430/399; 430/491; 430/558

[58] Field of Search ..... 430/399, 386, 387, 558 R

[56] References Cited

U.S. PATENT DOCUMENTS

| | | | |
|---|---|---|---|
| 4,297,437 | 10/1981 | Koneko et al. | 430/399 |
| 4,348,475 | 9/1982 | Wernicke et al. | 430/399 |
| 4,613,562 | 9/1986 | Kuse et al. | 430/399 |
| 4,639,415 | 1/1987 | Kaneko et al. | 430/558 |

*Primary Examiner*—Richard L. Schilling

*Attorney, Agent, or Firm*—Jordan B. Bierman

[57] ABSTRACT

A replenishing process for use in the development of an image-wise exposed silver halide color photographic light-sensitive material in which a color developer replenisher containing $0\text{–}3.0\times10^{-3}$ mole of bromide is added to a color developer in a volume of between 0.5 and 9 ml per 100 $cm^2$ of silver halide color photographic light-sensitive material.

30 Claims, No Drawings

METHOD FOR PROCESSING SILVER HALIDE COLOR PHOTOGRAPHIC MATERIALS

BACKGROUND OF THE INVENTION

The present invention relates to the method for processing silver halide color photographic materials and particularly to the method for processing silver halide color photographic materials capable of improving remarkably the processing variation in the color development and of realizing the low environmental pollution.

Generally, color photographic materials produce thereon photographic images after they pass through the processing steps including a color developing step wherein color photographic materials, after they are exposed to light, are processed in the developer containing paraphenylene type color developing agent, a bleaching step and a fixing step or a bleach-fix step in place of previous two steps and a washing step.

In aforesaid color developing step, color images are formed by the coupling reaction between an oxidation product of color developing agent and a color coupler and metallic silver are concurrently produced in the photographic step. The metallic silver are oxidized by bleaching agents in the succeeding desilverizing step and then form, through the aid of fixing agents, the soluble silver complexes which are dissolved away.

Researches for low environmental pollution have been made recently from the viewpoints of an environmental protection and a cost and have been put to practical use in a partial processing steps. Especially in the color developing step, various technologies for low environmental pollution have been proposed in the past due to the level of an influence of the color developing step upon environmental pollution. For example, regenerating methods through an electrolysis described in Japanese Patent Publication Open to Public Inspection Nos. 37731/1979, 1048/1981, 1049/1981, 27142/1981, 33644/1981 and 149036/1981 (hereinafter referred to as Japanese Patent O.P.I. Publication), generating methods by means of activated carbon described in Japanese Patent Examined Publication No. 1571/1980 and Japanese Patent O.P.I. Publication No. 14831/1983, an ion exchange membrane method described in Japanese Patent O.P.I. Publication No. 105820/1977 and methods by means of an ion exchange resin described in Japanese Patent O.P.I Publication Nos. 132343/1978, 144240/1980, 146249/1982 and U.S. Pat. No. 4,348,475 and disclosed. However, aforesaid methods require a large and expensive regenerating apparatus and a skilled person who can analyze regenerating liquid for keeping the development level constant and therefore the methods are not utilized except an occasion where the methods are used by only a few photofinishing laboratories. Recently, on the other hand, a method for reducing waste liquid not by using a regenerating method but by reducing replenisher for the color developer has become popular. This method does not require a large and expensive apparatus and a skilled analyzer and therefore it is a desirable method for achieving low environmental pollution, which is different from aforesaid methods.

Through this method, it is possible to attain a low replenishment to a certain extent but this method has serious disadvantages such as the condensation of color developer caused by evaporation, mixing of iron salt and thiosulfate caused by the belt contamination and back contamination and a large process variation and a large process stain both caused by the substances eluted from the emulsion such as, for example, an outflow of activator and inhibitor. This tendency is remarkable especially when the low replenishment is accelerated under the conditions of high temperature processing and low volume processing. As a technology for preventing the process variation caused by iron salt and thiosulfate both mixed into color developer during the low replenishment, various types of chelating agents are disclosed and further polyvinyl pirrolidone type compounds and polyethylene glycol type compounds are disclosed in Japanese Patent O.P.I. Publication Nos. 150847/1982, 120250/1983 and 121036/1983, but all of them only prevent iron salt and thiosulfate both in a small amount to be mixed and they are not so effective when the low replenishment is accelerated and the amount level of iron salt and thiosulfate mixed into color developer is high. Further, when aforesaid chelating agents and polyvinyl pirrolidone type and polyethylene glycol type high molecular compounds are added in abundance, the photographic characteristics of photosensitive materials are adversely affected, which is not desirable.

SUMMARY OF THE INVENTION

An object of the invention is to improve greatly the process variation for silver halide photographic materials caused by the low replenishment and another object is to attain a remarkable low environmental pollution through a simple and inexpensive method. Further object of the invention is to provide a processing method capable of forming a color photographic image that is high sensitive and is excellent in its image quality.

After an enthusiastic study, the inventors of the present invention found that the processing of silver halide color photographic material having at least one layer of core/shell emulsion containing 3 mol% or more of silver iodide and containing magenta coupler represented by following general formula [I] is attained by replenishing 9 ml and less of the replenisher for color development containing $3.0\times10^{-3}$ mol and less of bromides per 100 $cm^2$ of silver halide color photographic material.

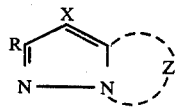

General formula [I]

In the formula, Z represents a nonmetallic atom group necessary for forming a nitrogen-containing heterocyclic ring and a ring formed by said Z may have a substituent. X represents a hydrogen atom or a substituent capable of splitting off through the reaction with an oxidized substance of color developing agent.

R, on the other hand, represents a hydrogen atom or a substituent.

Further, the embodiments of the invention wherein chelating agents represented by following general formulas [XI]-[XIII] are contained and further $2.0\times10^{-3}$ mol and less of bromides are contained in the replenisher for color development and aforesaid replenisher for color development in the amount of 7.5 ml and less is replenished per 100 $cm^2$ of silver halide color photographic material, show remarkable effects of the invention.

General formula [XI] A-COOM
General formula [XII] B-$PO_3M_2$

General formula [XIII]

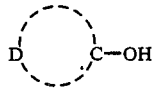

In the formulas, A and B represent respectively a monovalent group or an atom and they may be either an inorganic substance or an organic one. D represents a group of non-metal atoms necessary for forming an aromatic cyclic ring or a heterocyclic ring which may have a substituent and M represents a hydrogen atom or an alkali metal atom.

DETAILED DESCRIPTION OF THE INVENTION

Following is a detailed description of the invention. The inventors of the invention found that the process variation and process stain for color photographic materials grow large when the low replenishment is made for realizing a low environmental pollution and a low cost and especially when 9 ml and less of the replenisher for color development is replenished for processng per 100 $cm^2$ of silver halide color photographic material, the process variation grows large remarkably. Generally, color photographic materials containing silver iodide such as, for example, color negative films like color photographic materials for use in photographing require the replenishment of about 15 ml of the replenisher for color development per 100 $cm^2$ of the color photographic material. In this case, there is no big problem except mixing of ingredients from a previous bath such as iron salt and thiosulfate because the amount of replenishment is large. However, when the amount of replenishment is lowered down to 9 ml and below, the problems including the condensation of color developer caused by the evaporation and the accumulation of the substances eluted from the emulsion take place and especially, the density variation of a green-sensitive layer and stain tend to be caused, which was found by the inventors of the invention. Therefore, it is necessary to prevent the condensation of color developer caused by evaporation or to prevent the influence on color photographic material to some extent despite the condensation and further it is necessary to prevent or to control constant the accumulation of the substances eluted from emulsion, especially of alkali salt halide.

A lower replenishment has hitherto been impossible because no solutions for the aforesaid problems have been found out. However, with silver halide color photographic material having at least one emulsion layer containing core/shell type silver halide grains holding 3 mol% or more of silver iodide and containing magenta coupler represented by general formula [I], the low replenishment of 9 ml/100 $cm^2$ and less has been realized by keeping bromides in the replenisher for color development at $3.0\times10^{-3}$ mol per liter and less and by maintaining at bromide concentration which causes no problem in the color development.

Further detailed description of the invention will be made as follows. The replenishing amount of replenisher for color development of the invention is 9 ml and less but when the evaporating amount is taken into consideration, the range from 1 ml to 9 ml in replenishment is preferable and the range from 3 ml to 8 ml is especially preferable.

With regard to the replenishing method, the replenisher for color development is replenished through a known method but it is recommendable to use a metering pump such as a bellows pump. The replenisher for color development of the invention contains $3.0\times10^{-3}$ mol per liter and less of bromides and it is necessary to adjust the concentration of bromide depending on the level of low replenishment. In general, it is necessary to reduce the concentration of bromide contained in the replenisher for color development as a replenishing amount is reduced.

The concentration of bromide in the replenisher for color development is adjusted so that the concentration of bromide (mainly determined by elution from emulsion and evaporation) is kept constant, and when the concentration of bromide is $3.0\times10^{-3}$ mol per liter and less and the amount of the replenisher for color development is within the range of from 0.5 to 9 ml/100 $cm^2$ a stable processing can be achieved without so affecting any photographic characteristics.

As an actual compound of bromide, there may be given an alkali metal salt such as sodium bromide, potassium bromide and ammonium bromide as well as hydrobromic acid.

A concrete description of the invention will be made as follows.

In magenta coupler of the invention represented by aforesaid general formula [I], General formula [I]

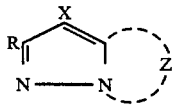

Z represents a nonmetallic atom group necessary for forming a nitrogen-containing heterocyclic ring and a ring formed by aforesaid Z may have a substituent.

X represents a hydrogen atom or a substituent capable of splitting off through the reaction with an oxidation product of color developing agent.

R, on the other hand, represents a hydrogen atom or a substituent.

As a substituent represented by aforesaid R, there may be given, for example, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro-compound residue, a bridge-type hydrocarbon compound residue, an alkoxy group, an aryloxy group, a heterocyclicoxy group, a cyloxy group, an acyloxy group, a carbamoyloxy group, an amino group, an acylamino group, a sulfonamide group, an imido group, an ureido group, a sulfamoylamino group, an alkoxycarbonylamino group, an aryloxycarbonyl group, an alkylthio group, an arylthio group and a heterocyclicthio group.

As a halogen atom, a chlorine atom and a bromine atom, for example, are given and a chlorine atom is particularly preferable.

As an alkyl group represented by R, the alkyl group having the number of carbons of 1–32 and an alkenyl group, the one having the number of carbons of 2–32 and a cycloalkyl group and the one having the number of carbons of 3–12, especially of 5–7 as a cycloalkenyl group are preferable and an alkyl group, an alkenyl group and an alkinyl group may be of the type of either straight chain or branching.

Further, these alkyl group, alkenyl group, alkinyl group, cycloalkyl group and cycloalkenyl group may have a substituent [for example, in addition to an aryl group, a cyano group, a halogen atom, a heterocyclic group, a cycloalkyl group, a cycloalkenyl group, a spiro-compound residue and a bridge-type hydrocarbon compound residue, the substituent that substitutes through a carbonyl group such as an acyl group, a carboxy group, a carbamoyl group, an alkoxycarbonyl group and an aryloxycarbonyl group, the substituent that substitutes through a hetero-atom {concretely, the substituent that substitutes through an oxygen atom such as a hydroxy group, an alkoxy group, an aryloxy group, a heterocyclicoxy group, a cyloxy group, an acyloxy group and a carbamoyloxy group, the substituent that substitutes through a nitrogen atom such as a nitro group, an amino (including dialkylamino and others) group, a sulfamoylamino group, an alkoxycarbonylamino group, an alkoxycarbonylamino group, an aryloxycarbonylamino group, an acylamino group, a sulfonamide group, an imido group and a ureido group, the substituent that substitutes through a sulfur atom such as an alkylthio group, an arylthio group, a heterocyclicthio group, a sulfonyl group, a sulfinyl group and a sulfamoyl group and the substituent that substitutes through a phosphorus atom such as a phosphonyl group}].

Concretely, there are given a methyl group, an ethyl group, an isopropyl group, a t-butyl group, a pentadecyl group, a heptadecyl group, a 1-hexylnonyl group, a 1,1'-dipentylnonyl group, a 2-chloro-t-butyl group, a trifluoromethyl group, a 1-ethoxytridecyl group, a 1-methoxyisopropyl group, a methanesulfonylethyl group, a 2,4-di-t-amylphenoxymethyl group, an anilino group, a 1-phenylisopropyl group, a 3-m-butanesulfonaminophenoxypropyl group, a 3-4'-{α-[4''(p-hydroxybenzenesulfonyl)phenoxy]dodecanoylamino}phenylpropyl group, 3-{4'-[α-(2'',4''-di-t-amylphenoxy)-butaneamide]phenyl}-propyl group, 4-[α-(o-chlorophenoxy)tetradecaneamidephenoxy]propyl group, an aryl group, a cyclopentyl group and a cyclohexyl group.

As an aryl group represented by R, a phenyl group is preferable and it may have a substituent (for example, an alkyl group, an alkoxy group or an acylamino group).

Concretely, there are given phenyl group, a 4-t-butylphenyl group, a 2,4-di-t-amylphenyl group, a 4-tetradecaneamidephenyl group, a hexadecyloxyphenyl group and a 4'-[α-(4''-t-butylphenoxy)tetradecaneamide]phenyl group.

As a heterocyclic group represented by R, the heterocyclic group having 5–7 members is preferable and it can either be substituted or condensed. Concrete examples are a 2-furyl group, a 2-thienyl group, a 2-pyrimidinyl group, a benzothiazolyl group and others.

As an acyl group represented by R, an alkylcarbonyl group such as, for example, an acetyl group, an phenylacetyl group, a dodecanoyl group and an α-2,4-di-t-amylphenoxybutanoyl group and an arylcarbonyl group such as a benzoyl group, a 3-pentadecyloxybenzoyl group and a p-chlorobenzoyl group are given.

As a sulfonyl group represented by R, an alkylsulfonyl group such as a methylsulfonyl group and a dodecylsulfonyl group as well as an arylsulfonyl group such as a benzenesulfonyl group and a p-toluenesulfonyl group are given.

As a sulfinyl group represented by R, an alkylsulfinyl group such as an ethylsulfinyl group, an octylsulfinyl group and a 3-phenoxybutylsulfinyl group as well as an arylsulfinyl group such as a phenylsulfinyl group and a m-pentadecylphenylsulfinyl group are cited.

As a phosphonyl group represented by R, there may be cited an alkylphosphonyl group such as a butyloctylphosphonyl group, an alkoxyphosphonyl group such as an octyloxyphosphonyl group, an aryloxyphosphonyl group such as phenoxyphosphonyl group and an arylphosphonyl group such as a phenylphosphonyl group.

A carbamoyl group represented by R may be substituted with an alkyl group or with an aryl group (preferably, phenyl group) and there may be cited, for example, an N-methylcarbamoyl group, an N,N-dibutylcarbamoyl group, an N-(2-pentadecyloctylethyl)carbamoyl group, an N-ethyl-N-dodecylcarbamoyl group and an N-{3-(2,4-di-t-amylphenoxy)propyl}carbamoyl group.

A sulfamoyl group represented by R may be substituted with an alkyl group or with an aryl group (preferably, a phenyl group) and there may be cited as an example, an N-propylsulfamoyl group, an N,N-diethylsulfamoyl group, an N-(2-pentadecyloxyethyl)sulfamoyl group, an N-ethyl-N-dodecylsulfamoyl group and an N-phenylsulfamoyl group.

As a spiro-compound residue represented by R, spiro[3.3]heptane-1-yl may be cited as an example.

As a bridge-type carbonized compound residue represented by R, bicyclo[2.2.1]heptane-1-yl, tricyclo[3.3.1.1$^{3,7}$]decane-1-yl and 7,7-dimethyl-bicyclo[2.2.1]heptane-1-yl are cited as an example.

An alkoxy group represented by R may further be substituted with a substituent cited for aforesaid alkyl group and a methoxy group, a propoxy group, a 2-ethoxyethoxy group, a pentadecyloxy group, a 2-dodecyloxynitoxy group and a phenethyloxyethoxy group are cited as an example.

As an aryloxy group represented by R, a phenyloxy group is preferable and an aryl nucleus may further be substituted with a substituent or an atom cited for aforesaid aryl group and a phenoxy group, a p-t-butylphenoxy group and an m-pentadecylphenoxy group may be cited as an example.

As a heterocyclicoxy group represented by R, a group having a heterocyclic ring of 5–7 members is preferable and the heterocyclic ring may further have a substituent and a 3,4,5,6-tetrahydropyranyl-2-oxy group and a 1-phenyltetrazole-5-oxy group are given as an example.

A cyloxy group represented by R may further be substituted with an alkyl group and others and a trimethylcyloxy group, a triethylcyloxy group and a dimethylbutylcyloxy group are given as an example.

As an acyloxy group represented by R, an alkylcarbonyloxy group and an arylcarbonyloxy group are cited as an example and they may further have a substituent and concrete examples thereof include an acetyloxy group, an α-chloroacetyloxy group and a benzoyloxy group.

A carbamoyloxy group represented by R may be substituted with an alkyl group or with an aryl group and an N-ethylcarbamoyloxy group, an N,N-diethylcarbamoyloxy group and an N-phenylcarbamoyloxy group may be cited as an example.

An amino group represented by R may be substituted with an alkyl group or with an aryl group (preferably, a phenyl group) and examples thereof are an ethylamino group, an anilino group, an m-chloroanilino group, a 3-pentadecyloxycarbonylanilino group and a 2-chloro-5-hexadecaneamidoanilino group.

As an acylamino group represented by R, an alkylcarbonylamino group, an arylcarbonylamino group (preferably, a phenylcarbonylamino group) and others are given and they may further have a substituent and there are concretely cited an acetamido group, an α-ethylpropaneamido group, an N-phenylacetamido group, a dodecaneamido group, a 2,4-di-t-amylphenoxyacetamido group, α-3-t-butyl 4-hydroxyphenoxybutaneamido group and others.

As a sulfonamide group represented by R, an alkylsulfonylamino group, an arylsulfonylamino group and others are given and they may further have a substituent. A methylsulfonylamino group, a pentadecylsulfonylamino group, a benzenesulfonamido group, a p-toluenesulfonamido group, a 2-methoxy-5-t-amylbenzenesulfonamido group and others are concretely cited.

An imido group represented by R may be either of an open-chain type or of a cyclic type and it may have a substituent. A succinic acid amide group and a 3-heptadecyl succinic acid amide group, a phthalimido group, a glutarimide group and others are given as an example.

An ureido group represented by R may be substituted with an alkyl group or with an aryl group (preferably, a phenyl group) and an N-ethylureido group, an N-methyl-N-decylureido group, an N-phenylureido group, an N-p-tolylureido group and others are given as an example.

A sulfamoylamino group represented by R may be substituted with an alkyl group or with an aryl group (preferably, a phenyl group) and an N,N-dibutylsulfamoylamino group, an N-methylsulfamoylamino group, an N-phenylsulfamoylamino group and others are given as an example.

An alkoxycarbonylamino group represented by R may further have a substituent and a methoxycarbonylamino group, a methoxyethoxycarbonylamino group, an octadecyloxycarbonylamino group and others are given as an example.

An aryloxycarbonylamino group represented by R may have a substituent and a phenoxycarbonylamino group and a 4-methylphenoxycarbonylamino group are given as an example.

An alkoxycarbonyl group represented by R may further have a substituent and a methoxycarbonyl group, a butyloxycarbonyl group, a dodecyloxycarbonyl group, an octadecyloxycarbonyl group, an ethoxymethoxycarbonyloxy group, a benzyloxycarbonyl group and others are given as an example.

An aryloxycarbonyl group represented by R may further have a substituent and a phenoxycarbonyl group, a p-chlorophenoxycarbonyl group, an m-pentadecyloxyphenoxycarbonyl group and others are given as an example.

An alkylthio group represented by R may further have a substituent and an ethylthio group, a dodecylthio group, an octadecylthio group, a phenetilthio group and a 3-phenoxypropylthio group are given as an example.

As an arylthio group represented by R, a phenylthio group is preferable and it may further have a substituent and a phenylthio group, a p-methoxyphenylthio group, a 2-t-octylphenylthio group, a 3-octadecylphenylthio group, a 2-carboxyphenylthio group, a p-acetaminophenylthio group and others are given as an example.

As a heterocyclicthio group represented by R, a heterocyclicthio group with 5–7 members is preferable and it may further have a condensed ring and even a substituent. For example, a 2-pyridylthio group, a 2-benzthiazolylthio group and a 2,4-diphenoxy-1,3,5-triazole-6-thio group are given.

As a substituent represented by X capable of splitting off through the reaction with an oxidation product of color developing agent, the groups substituted through carbon atoms, oxygen atoms, sulfur atoms or nitrogen atoms are given as an example in addition to the group substituted through halogen atoms (chlorine atom, bromine atom, fluorine atom or the like).

As a group substituted through carbon atoms, a group represented by the following general formula, a hydroxymethyl group and a triphenylmethyl group are given in addition to carboxyl group.

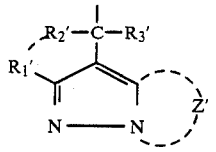

($R_1'$ is synonymous with aforesaid R, Z' is synonymous with aforesaid Z and $R_2'$ and $R_3'$ represent a hydrogen atom, an aryl group, an alkyl group or a heterocyclic group.)

As a group substituted through oxygen atoms, an alkoxy group, an aryloxy group, a heterocyclicoxy group, an acyloxy group, a sulfonyloxy group, an alkoxycarbonyloxy group, an aryloxycarbonyloxy group, an alkyloxyalyloxy group and an alkoxyoxalyloxy group are given as an example.

Aforesaid alkoxy group may further have a substituent and an ethoxy group, a 2-phenoxyethoxy group, a 2-cyanoethoxy group, a phenethyloxy group, a p-chlorobenzyloxy group and others are given as an example.

As an aryloxy group, a phenoxy group is preferable and aforesaid aryl group may further have a substituent. Concrete examples thereof are a phenoxy group, a 3-methylphenoxy group, a 3-dodecylphenoxy group, a 4-methanesulfonamidephenoxy group, a 4-[α-(3'-pentadecylphenoxy)butaneamide]phenoxy group, a hexydecylcarbamoylmethoxy group, a 4-cyanophenoxy group, a 4-methanesulfonylphenoxy group, a 1-naphthyloxy group, a p-methoxyphenoxy group and others.

As a heterocyclicoxy group, a heterocyclicoxy group with 5–7 members is preferable and it may be a condensed ring and it may have a substituent. Concretely, a 1-phenyltetrazolyloxy group, a 2-benzthiazolyloxy group and others are given.

As aforesaid acyloxy group, an alkylcarbonyloxy group such as acetoxy group and a butanoloxy group, an alkenylcarbonyloxy group such as a cinnamoyloxy group and an arylcarbonyloxy group such as a benzoyloxy group are given as an example.

As aforesaid sulfonyloxy group, a butanesulfonyloxy group and a methanesulfonyloxy group are given as an example.

As aforesaid alkoxycarbonyloxy group, an ethoxycarbonyloxy group and a benzyloxycarbonyloxy group are given as an example.

As aforesaid aryloxycarbonyl group, a phenoxycarbonyloxy group and others are given.

As aforesaid alkyloxalyloxy group, a methyloxalyloxy group is given as an example.

As aforesaid alkoxyoxalyloxy group, an ethoxyoxalyloxy group and others are given.

As a group substituted through sulfur atoms, an alkylthio group, an arylthio group, a heterocyclicthio group and an alkyloxythiocarbonylthio group are given as an example.

As aforesaid alkylthio group, a butylthio group, a 2-cyanoethylthio group, a phenethylthio group, a benzylthio group and others are given.

As aforesaid arylthio group, a phenylthio group, a 4-methanesulfonamidephenylthio group, a 4-dodecylphenethylthio group, a 4-nonafluoropentaneamidephenethylthio group, a 2-ethoxy-5-t-butylphenylthio group and others are given.

As aforesaid heterocyclicthio group, a 1-phenyl-1,2,3,4-tetrazolyl-5-thio group and a 2-benzthiazolylthio group are given as an example.

As aforesaid alkyloxythiocarbonylthio group, a dodecyloxythiocarbonylthio group and others are given.

As a group substituted through aforesaid nitrogen atoms, the group represented by general formula

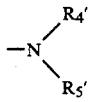

is given as an example. In the formula, $R_4'$ and $R_5'$ represent hydrogen atoms, an alkyl group, an aryl group, a heterocyclic group, a sulfamoyl group, a carbamoyl group, an acyl group, a sulfonyl group, an aryloxycarbonyl group and an alkoxycarbonyl group and both $R_4'$ and $R_5'$ may be combined to form a heterocyclic ring. However, the occasion wherein both $R_4'$ and $R_5'$ are hydrogen atoms should not take place.

Aforesaid alkyl group may be either of a straight chain type or of a branching type and it is preferably the one having carbons ranging from 1 to 22 in number. Further, an alkyl group may have a substituent which is cited as an aryl group, an alkoxy group, an aryloxy group, an alkylthio group, an arylthio group, an alkylamino grioup, an arylamino group, an acylamino group, a sulfonamide group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryloxycarbonylamino group, a hydroxyl group, a carboxyl group, a cyano group and halogen atoms, for example.

As concrete ones of aforesaid alkyl group, there are given, as an example, an ethyl group, an octyl group, a 2-ethylhexyl group and a 2-chloroethyl group.

As an aryl group represented by $R_4'$ or $R_5'$, the one having carbons ranging from 6 to 32 in number, especially a phenyl group and a naphthyl group are preferable and the aryl group may have a substituent which includes the ones given previously as a substituent for aforesaid alkyl group represented by $R_4'$ or $R_5'$ as well as an alkyl group. As concrete ones for aforesaid aryl group, a phenyl group, a 1-naphthyl group and a 4-methylsulfonylphenyl group are given as an example.

As a heterocyclic group represented by $R_4'$ or by $R_5'$, the one with 5–6 members is preferable and it may be a condensed ring and it may have a substituent. As a concrete example thereof, a 2-furyl group, a 2-quinolyl group, a 2-pyrimidyl group, a 2-benzthiazolyl group and a 2-pyridyl group are given.

As a sulfamoyl group represented by $R_4'$ or by $R_5'$, an N-alkylsulfamoyl group, an N,N-dialkylsulfamoyl group, an N-arylsulfamoyl group, an N,N-diarylsulfamoyl group and others are given and these alkyl groups and aryl groups may have the substituents referred previously concerning aforesaid alkyl group and aryl group. As concrete examples of sulfamoyl group, there are given an N,N-diethylsulfamoyl group, an N-methylsulfamoyl group, an N-dodecylsulfamoyl group and an N-p-tolylsulfamoyl group.

As a carbamoyl group represented by $R_4'$ or $R_5'$, an N-alkylcarbamoyl group, an N,N-dialkylcarbamoyl group, an N-arylcarbamoyl group an N,N-diarylcarbamoyl group and others are given and these alkyl groups and aryl group may have a substituent referred previously concerning aforesaid alkyl group and aryl group. As a concrete example of a carbamoyl group, there may be given an N,N-diethylcarbamoyl group, an N-methylcarbamoyl group, an N-dodecylcarbamoyl group, an N-p-cyanophenylcarbamoyl group and an N-p-tolylcarbamoyl group.

As an acyl group represented by $R_4'$ or by $R_5'$, there are given an alkylcarbonyl group, an arylcarbonyl group and a heterocycliccarbonyl group as an example and aforesaid alkyl group, aryl group and heterocyclic group may have a substituent. As a concrete acyl group, a hexafluorobutanoyl group, a 2,3,4,5,6-pentafluorobenzoyl group, an acetyl group, a benzoyl group, a naphthoyl group and a 2-furylcarbonyl group are cited as an example.

As a sulfonyl group represented by $R_4'$ or by $R_5'$, an alkylsulfonyl group, an arylsulfonyl group and a heterocyclicsulfonyl group are cited and they may have a substituent and concrete examples thereof include an ethanesulfonyl group, a benzenesulfonyl group, an octanesulfonyl group, a naphthalenesulfonyl group and a p-chlorobenzenesulfonyl group.

An aryloxycarbonyl group represented by $R_4'$ or by $R_5'$ may have ones referred as a substituent concerning aforesaid aryl group and a concrete example thereof is a phenoxycarbonyl group.

An alkoxycarbonyl group represented by $R_4'$ or by $R_5'$ may have substituents referred previously concerning aforesaid alkyl groups and concrete examples thereof include a methoxycarbonyl group, a dodecyloxycarbonyl group and a benzyloxycarbonyl group.

As a heterocyclic ring formed by the combination of $R_4'$ and $R_5'$, the one having 5–6 members is preferable and it may be either saturated or unsaturated and it may have either aromaticity or no aromaticity and it may further be a condensed ring. The examples of the heterocyclic ring include an N-phthalimido group, an N-succinic acid imido group, a 4-N-urazolyl group, a 1-N-hydantoinyl group, a 3-N-2,4-dioxooxazolizinyl group, a 2- N-1,1-dioxo-3-(3H)-oxo-1,2-benzthiazolyl group, a 1-pyrrolyl group, a 1-pyrrolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benztriazolyl group, a 1-benzimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyridone group, a phthaladione and a 2-oxo-1-piperidinyl group, and these heterocyclic groups may be substituted with an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, an ureido group, an alkoxycarbonyl group, an aryloxycarbonyl group, an imido group, a nitro group, a cyano group, a carboxyl group and halogen atoms.

Further, as a nitrogen containing heterocyclic ring formed by Z or by Z', a pyrazole ring, an imidazole ring, a triazole ring or a tetrazole ring are given and substituents which aforesaid rings may have are the ones referred previously concerning aforesaid R.

Further, when substituents (e.g., R, $R_1$–$R_8$) on the heterocyclic rings in general formula [I] and general formulae [II]–[VIII] mentioned later have a portion

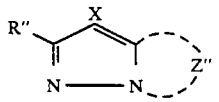

(wherein, R'', X and Z'' are synonymous with R, X and Z in general formula [I] respectively), so-called bis-type coupler is formed and it is naturally included in the present invention. Further, a ring formed by Z, Z', Z'' and $Z_1$ described later may further be the condensed ring of other ring (e.g., cycloalkylene having 5–7 members). For example, $R_5$ and $R_6$ in general formula [V] and $R_7$ and $R_8$ in general formula [VI] may be combined each other respectively to form a ring (e.g., cycloalkyne or benzene having 5–7 members).

What are represented by general formula [I] are further represented by following general formulae [II]–[VII] concretely.

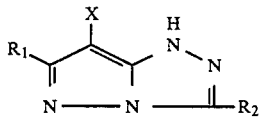

General formula [II]

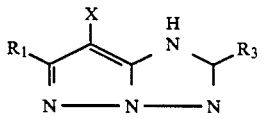

General formula [III]

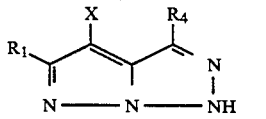

General formula [IV]

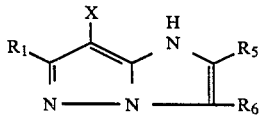

General formula [V]

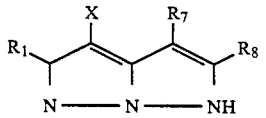

General formula [VI]

-continued

General formula [VII]

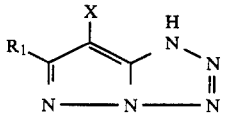

$R_1$–$R_8$ and X in aforesaid general formulae [II]–[VII] are synonymous with aforesaid R and X respectively.

The preferable one among what are represented by general formula [I] is what is represented by following general formula [VIII].

General formula [VIII]

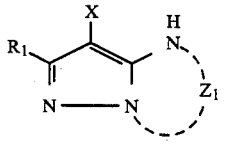

In the formula, $R_1$, X and $Z_1$ are synonymous with $R_1$, X and Z in general formula respectively.

The especially preferable one among magenta couplers represented by aforesaid general formulae [II]–[VII] is the one represented by general formula [II].

Further, as for substituents on heterocyclic rings in general formulae [I]–[VIII], it is preferable that R in general formula [I] and $R_1$ in general formulae [II]–[VIII] satisfy following condition 1 and it is more preferable that they satisfy following conditions 1 and 2 and the most preferable case is that following conditions 1, 2 and 3 are satisfied.

condition 1: A root atom being directly combined to a heterocyclic ring is a carbon atom.

condition 2: Only one hyrogen atom or no hydrogen atom is combined to aforesaid carbon atom.

condition 3: Every combination between aforesaid carbon atom and its adjacent atom is of a single bond type.

The most preferable ones as substituents R and $R_1$ on aforesaid heterocyclic ring are the substituents represented by following general formula [IX].

General formula [IX]

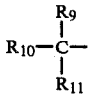

In the formula, $R_9$, $R_{10}$ and $R_{11}$ represent respectively a hydrogen atom, a halogen atom, an alkyl group, a cycloalkyl group, an alkenyl group, a cycloalkenyl group, an alkinyl group, an aryl group, a heterocyclic group, an acyl group, a sulfonyl group, a sulfinyl group, a phosphonyl group, a carbamoyl group, a sulfamoyl group, a cyano group, a spiro-compound residue, a bridge-type hydrocarbon compound residue, an alkoxy group, an aryloxy group, a heterocyclicoxy group, a siloxy group, an acyloxy group, a carbamoyloxy group, an amino group, an acylamino group, a sulfonamide group, an imido group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclicthio group and at least two of $R_9$, $R_{10}$ and $R_{11}$ are not a hydrogen atom.

Further, two of aforesaid $R_9$, $R_{10}$ and $R_{11}$ for example $R_9$ and $R_{10}$ may be combined to form a saturated or unsaturated ring (e.g., cycloalkane, cycloalkene, heterocyclic ring) and this ring may further be combined with $R_{11}$ to form a bridge-type hydrocarbon compound residue.

A group represented by $R_9$–$R_{11}$ may have a substituent and concrete examples of the group represented by $R_9$–$R_{11}$ and substituents which may be owned by aforesaid group are the concrete examples and substituents of the group represented by R in aforesaid general formula [I].

The concrete examples of the ring formed through the combination of $R_9$ and $R_{10}$, for example, and of the bridge-type hydrocarbon compound residue and their substituents are the concrete examples and their substituents of cycloalkyl, cycloalkenyl and heterocyclic ring bridge-type hydrocarbon compound residue represented by R in aforesaid general formula [I].

The preferable cases in general formula [IX] are;

(i) the case wherein two of $R_9$–$R_{11}$ are an alkyl group, and (ii) the case wherein one of $R_9$–$R_{11}$, for example $R_{11}$, is a hydrogen atom and other two of $R_9$ and $R_{10}$ combine and form cycloalkyl together with a root carbon atom. What is further preferable in aforesaid (i) is the case wherein two of $R_9$–$R_{11}$ are an alkyl group and remaining one is a hydrogen atom or an alkyl group.

Aforesaid alkyl and aforesaid cycloalkyl may further have a substituent and the concrete examples of aforesaid alkyl, aforesaid cycloalkyl and their substituents are given as the concrete examples of alkyl and cycloalkyl represented by R in aforesaid general formula [I] and their substituents.

As the substituents which may be owned by the ring formed by Z in general formula [I] and by the ring formed by $Z_1$ in general formula [VIII] and as $R_2$–$R_8$ in general formulae [II]–[VI], the ones represented by the following general formula [X] are preferable.

General formula [X] $\quad -R^1-SO_2-R^2$

In the formula, $R^1$ represents alkylene and $R^2$ represents alkyl, cycloalkyl or aryl.

Alkylene represented by $R^1$ is preferable when the number of carbons on the straight chain portion is 2 or more and it is more preferable when the number of carbons is from 3 to 6 and it may be either of a straight chain type or of a branching type. Further, this alkylene may have a substituent.

The examples of aforesaid substituent are the same as those shown as a substituent which may be owned by the alkyl group when R in aforesaid general formula [I] is an alkyl group.

As a preferable substituent, a phenyl is given.

Preferable concrete examples of alkylene represented by $R^1$ are shown below.

$-CH_2CH_2CH_2-$, $-CH(CH_3)CH_2CH_2-$, $-CH(C_2H_5)CH_2CH_2-$,

-continued $-CH_2CH_2\underset{\underset{C_7H_{15}}{|}}{CH}-$ $-CH_2CH_2\underset{\underset{C_2H_5}{|}}{CH}-$, $-CH_2CH_2CH_2CH_2-$, $-CH_2CH_2CH_2\underset{\underset{C_6H_{13}}{|}}{CH}-$, $-CHCH_2CH_2-$, $-\overset{\overset{CH_3}{|}}{\underset{\underset{CH_3}{|}}{C}}-CH_2CH_2-$ An alkyl group represented by $R^2$ may be either of a straight chain type or of a branching type.

Concretely, a methyl group, an ethyl group, a propyl group, an isopropyl group, a butyl group, a 2-ethylhexyl group, an octyl group, a dodecyl group, a tetradecyl group, a hexadecyl group, an octadecyl group and a 2-hexyldecyl group are given.

As a cycloalkyl group represented by $R^2$, the one with 5–6 members is preferable and a cyclohexyl group is given as an example.

An alkyl group and a cycloalkyl group both represented by $R^2$ may have a substituent and the examples thereof are the same as those exemplified as a substituent to aforesaid $R^1$.

As an aryl group represented by $R^2$, phenyl and naphthyl are concretely given. Aforesaid aryl group may have a substituent. As aforesaid substituent, the ones exemplified as a substituent to aforesaid $R^1$ are given in addition to an alkyl group that is of a straight chain type or a branching type, for example.

Further, when there are two or more substituents, they may be either of the same type or of different types.

Among compounds represented by general formula [I], the compounds represented by the following general formula [XI] are preferable in particular.

General formula [XI]

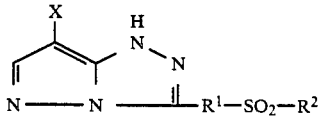

In the formula, R and X are synonymous with R and X in general formula [I] and $R^1$ and $R^2$ are synonymous with $R^1$ and $R^2$ in general formula [X].

1

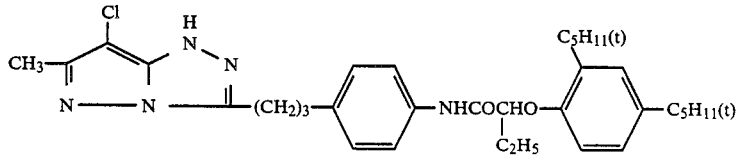

2

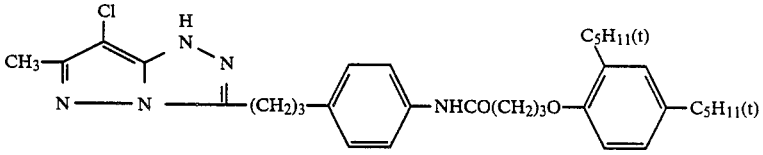

3

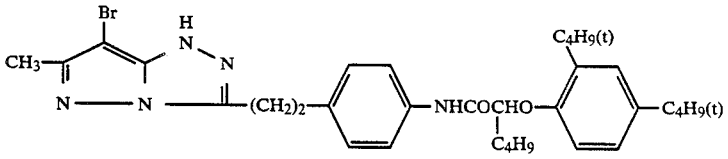

4

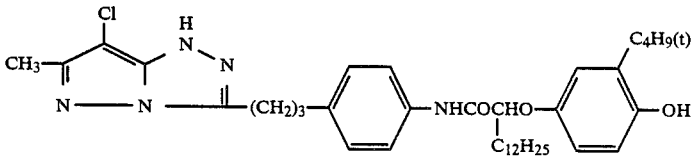

5

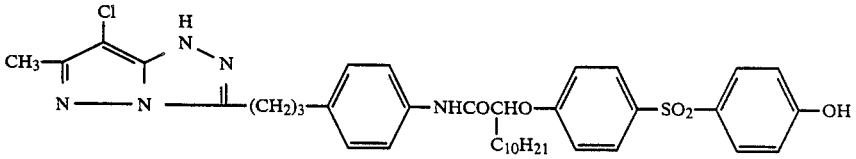

-continued
6
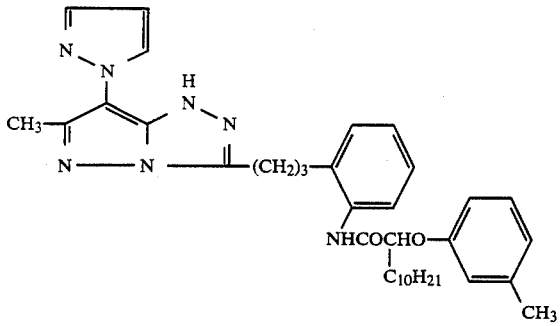
7
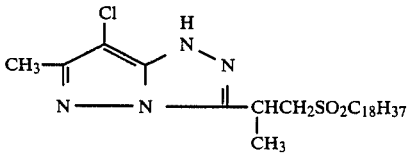
8
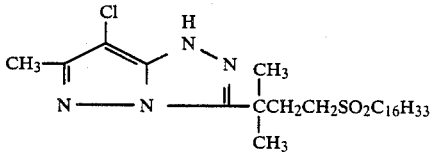
9
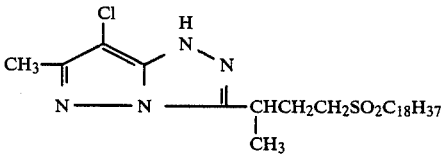
10
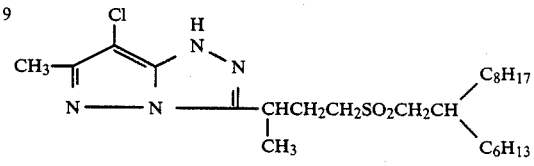
11
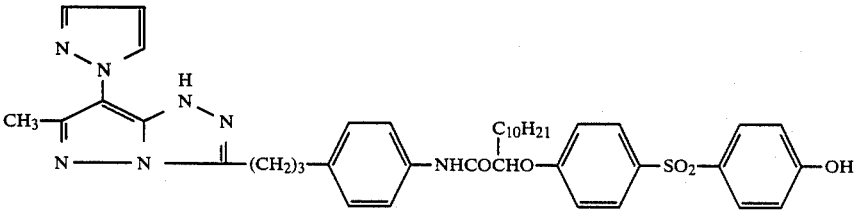
12
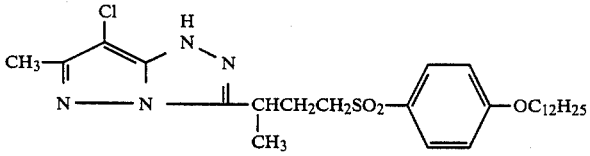
13
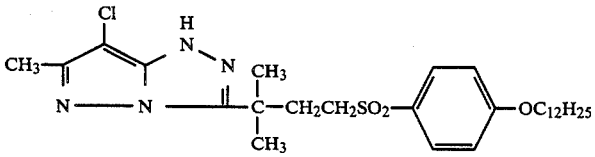
14
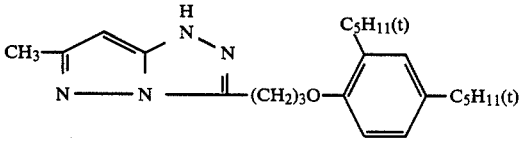
15
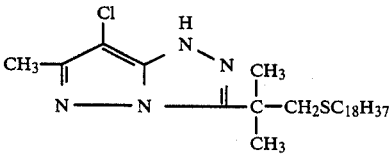

-continued
16
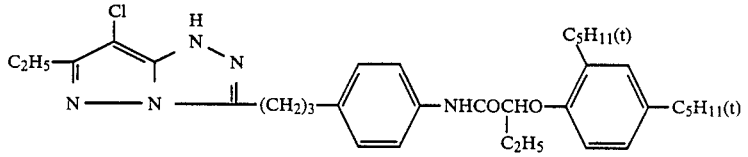
17
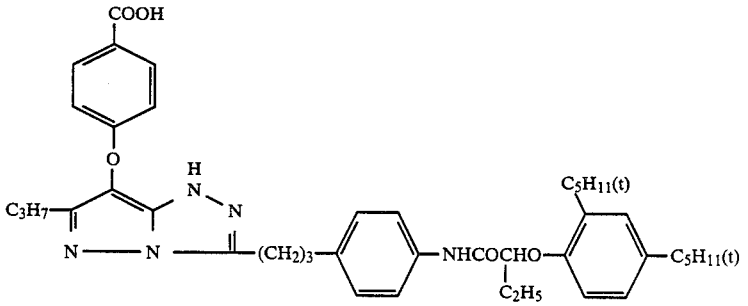
18
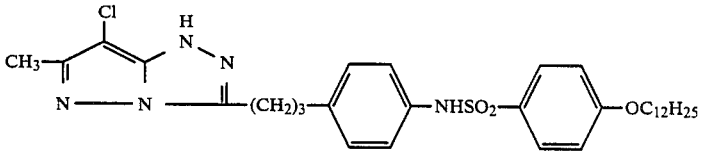
19
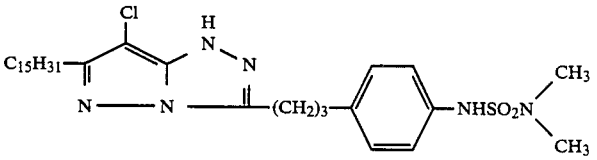
20
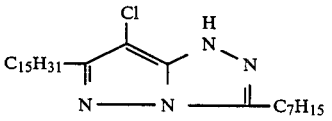
21
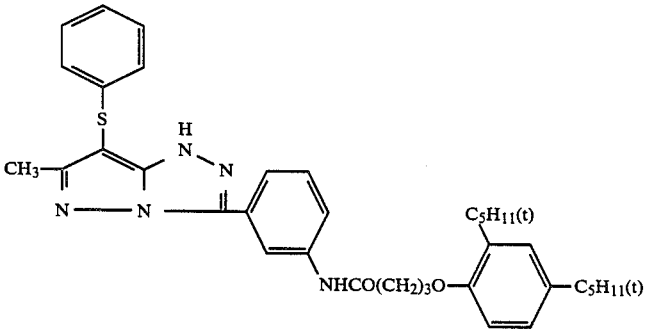
22
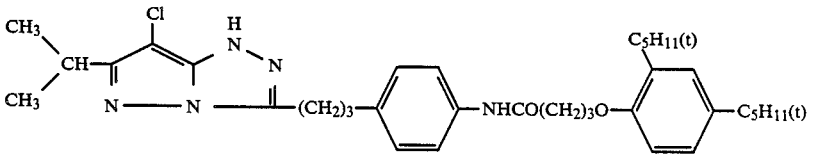
23
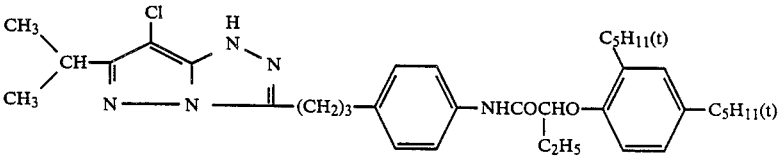

-continued
24
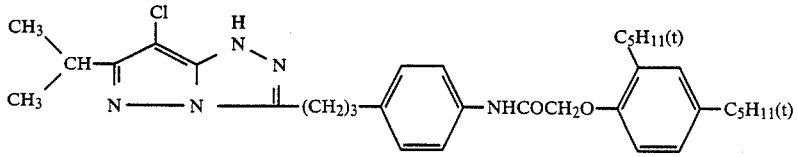
25
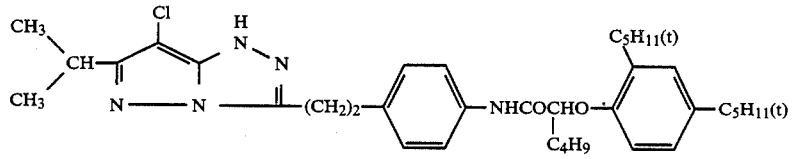
26
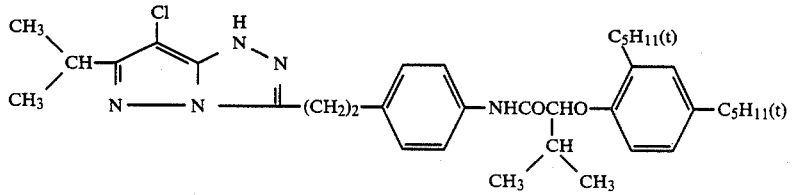
27
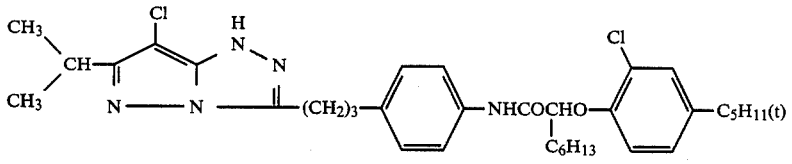
28
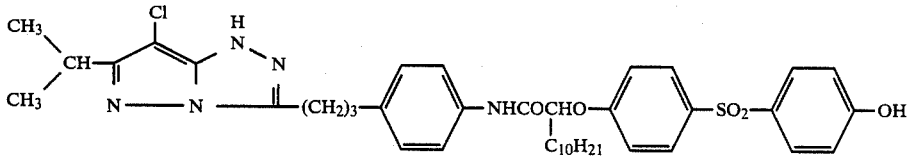
29
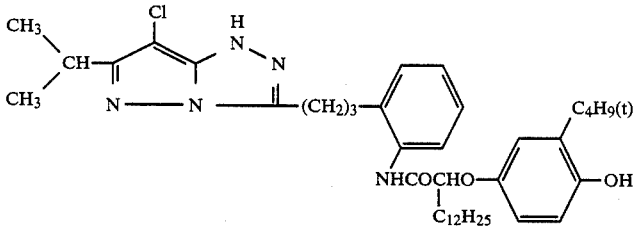
30
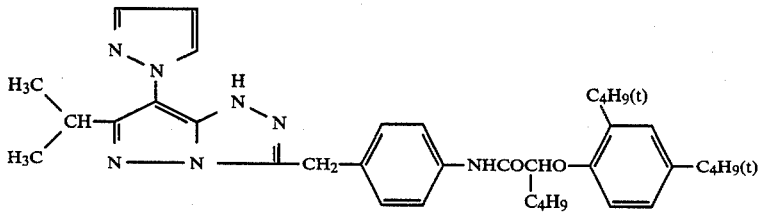
31
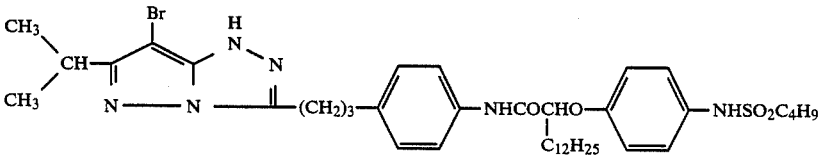
32
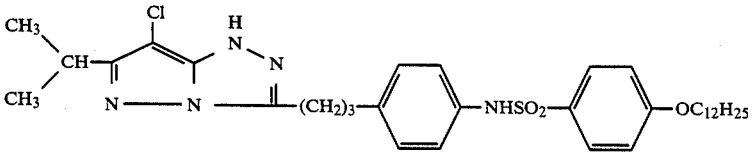

-continued
33
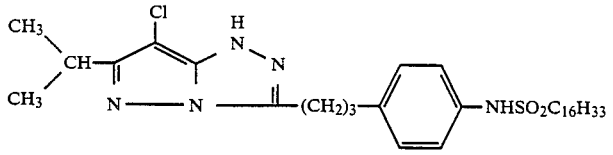
34
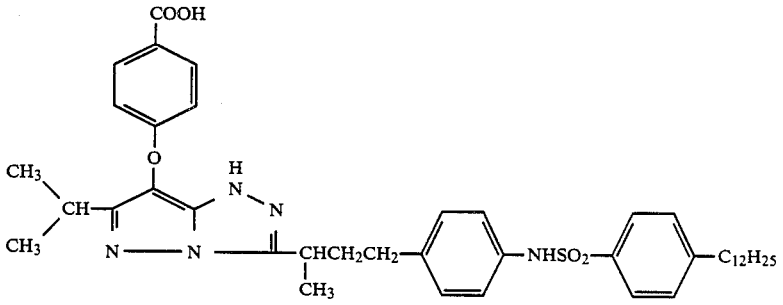
35
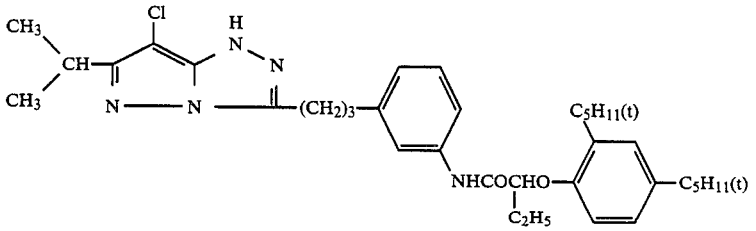
36
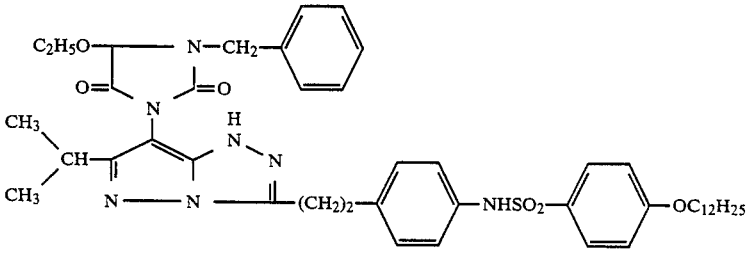
37
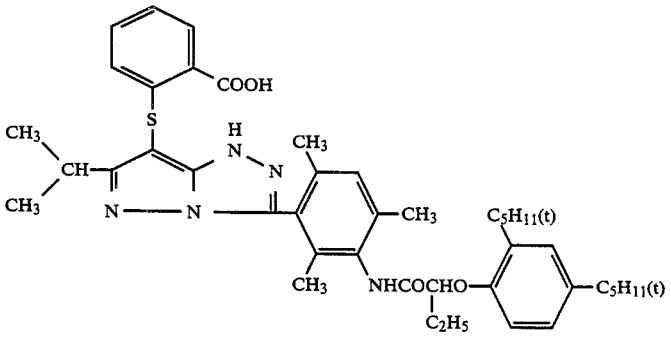
38
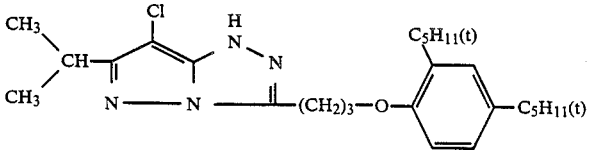

-continued
39
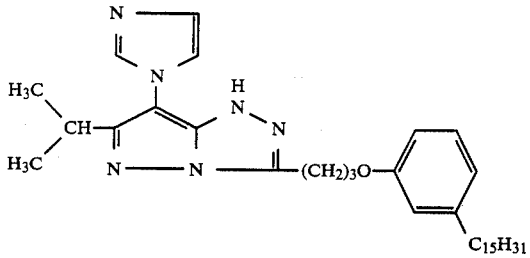
40
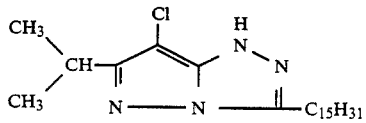
41
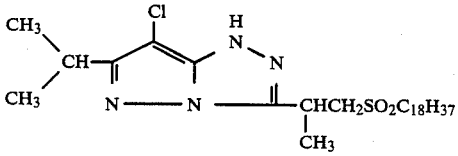
42
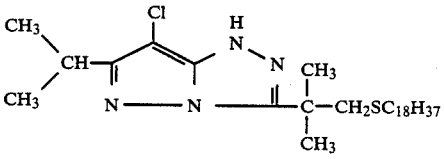
43
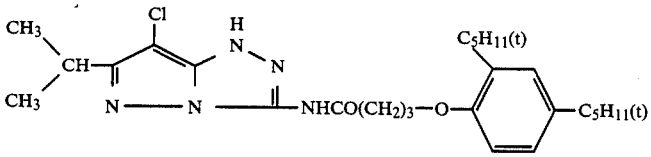
44
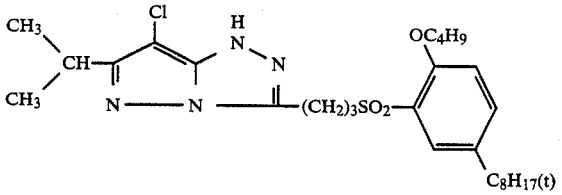
45
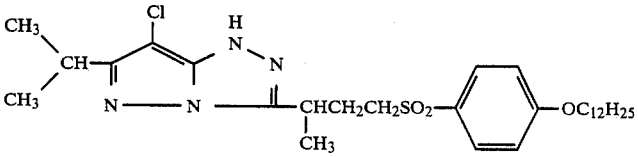
46
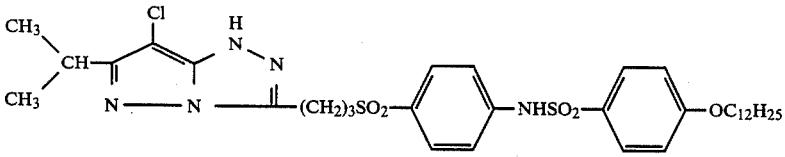
47
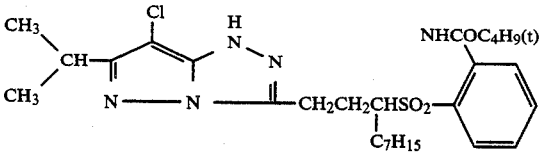
48
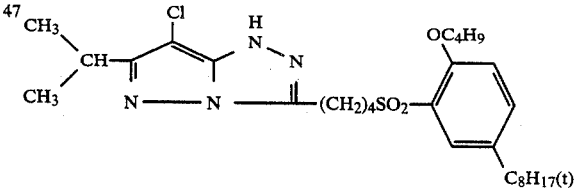
49
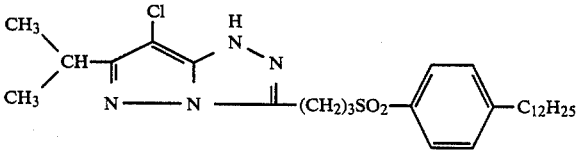
50
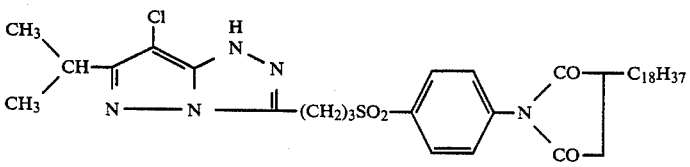

-continued
51
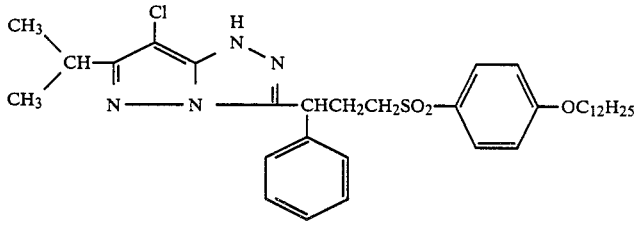
52
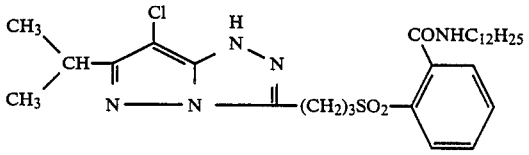
53
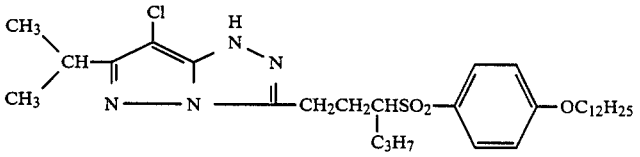
54
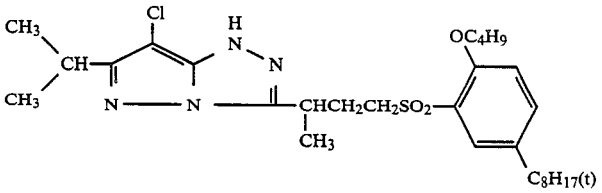
55
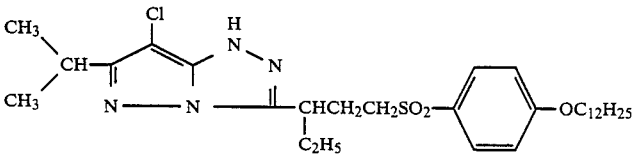
56
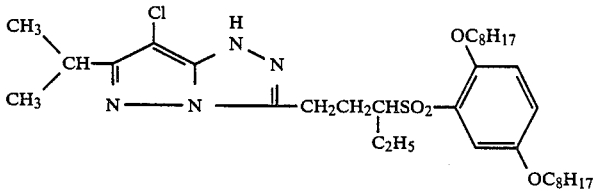
57
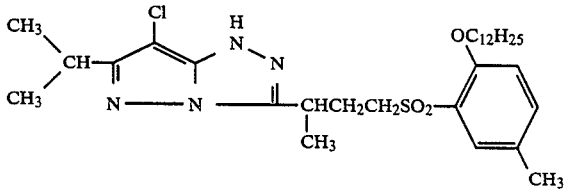
58
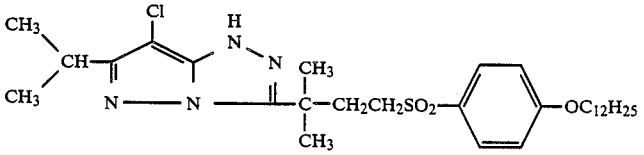

-continued
59
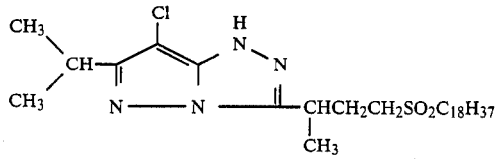
60
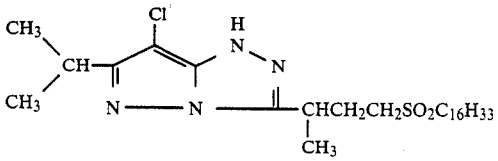
61
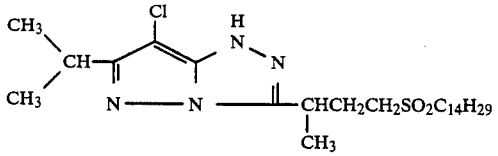
62
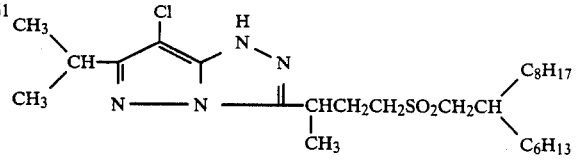
63
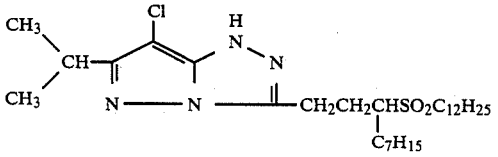
64
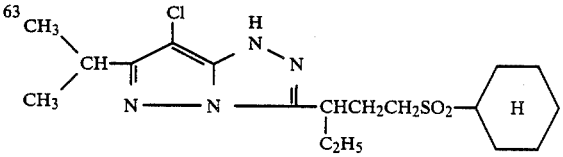
65
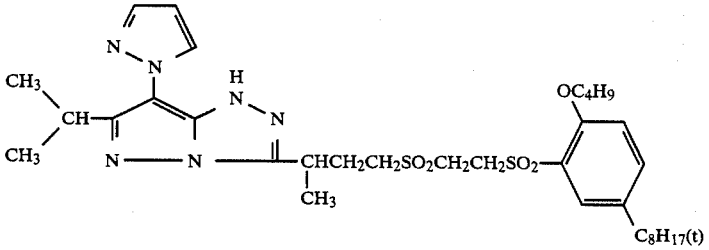
66
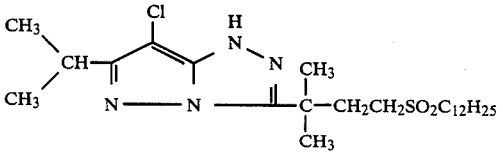
67
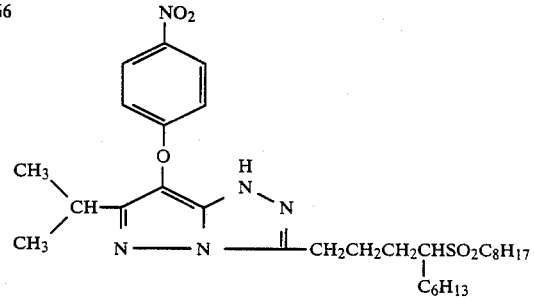
68
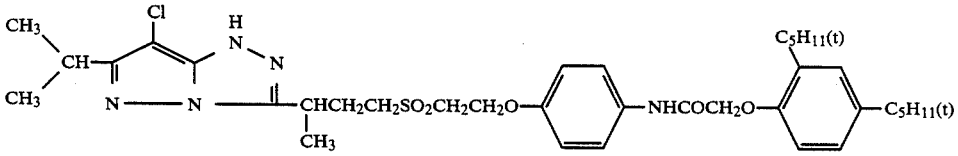
69
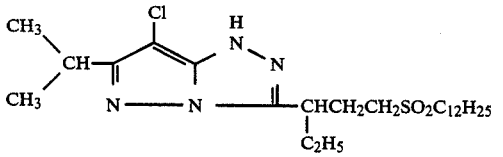
70
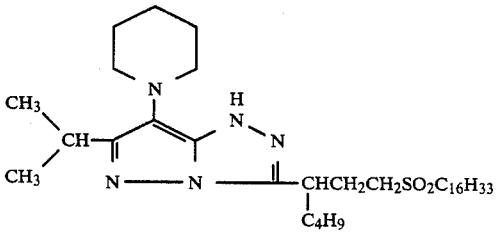
71
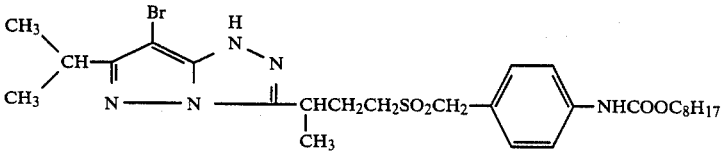

-continued
72
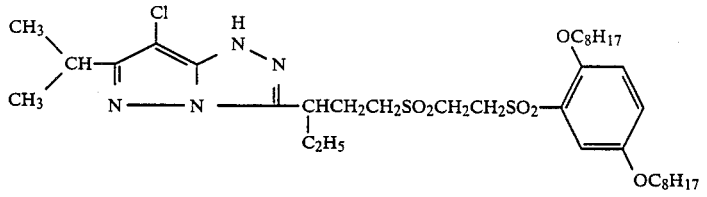
73
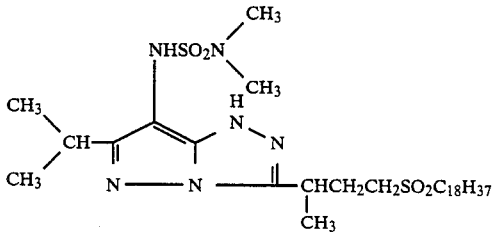
74
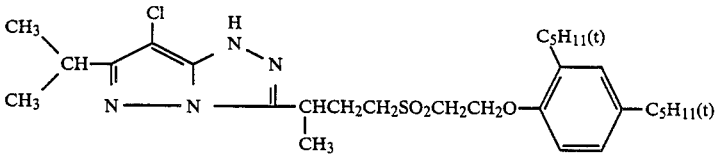
75
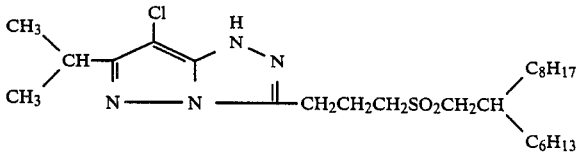
76
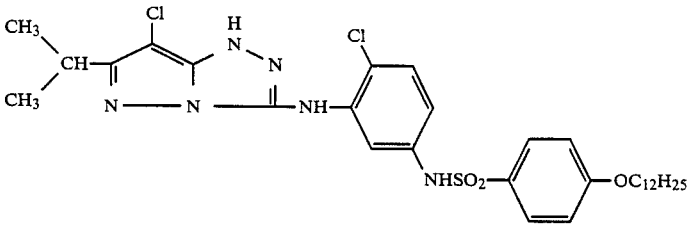
77
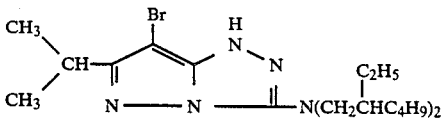
78
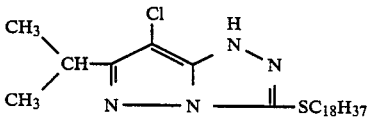
79
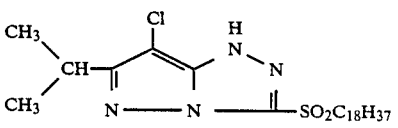
80
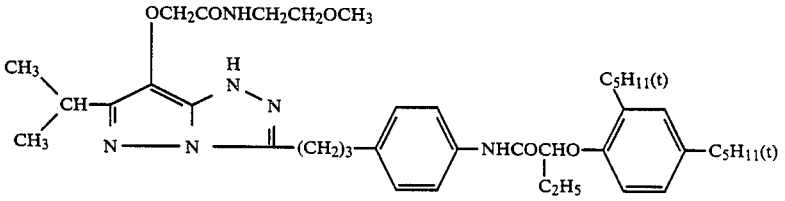

-continued
81
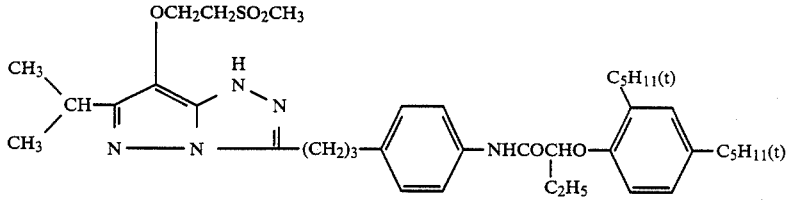
82
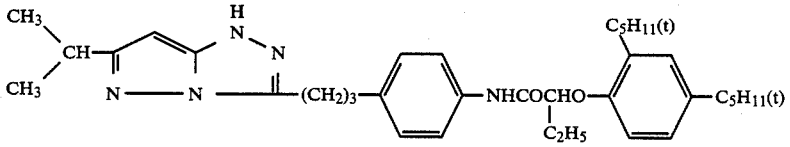
83
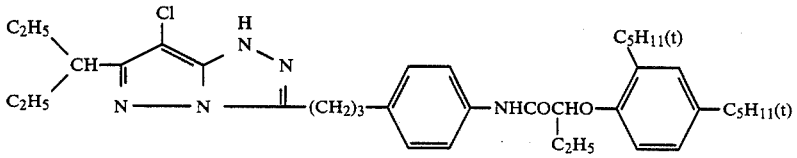
84
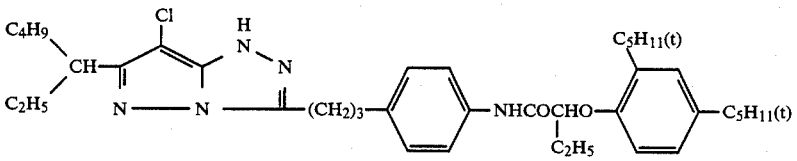
85
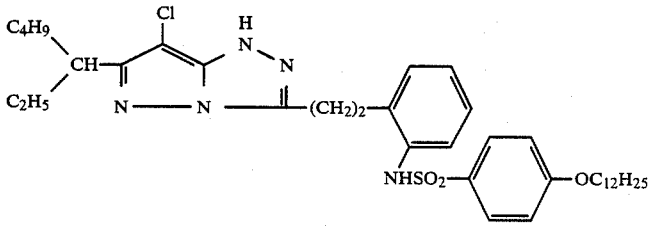
86
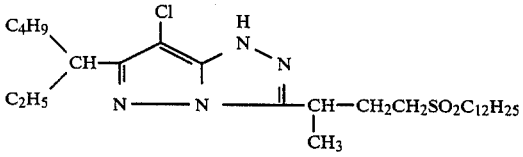
87
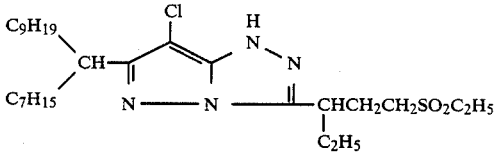
88
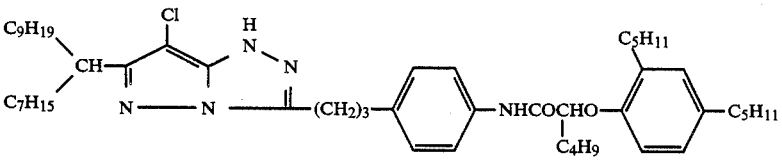
89
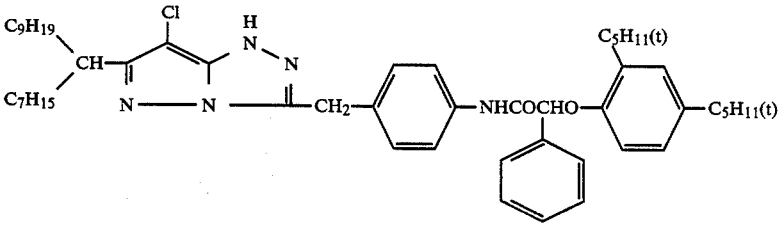
90
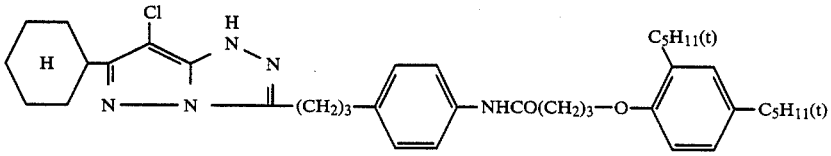

-continued
91
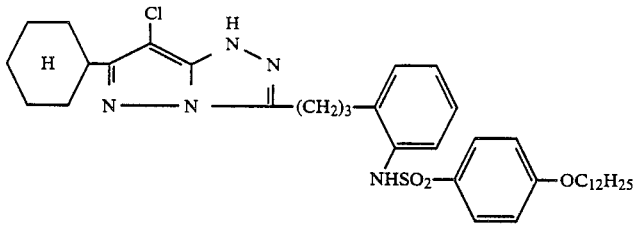
92
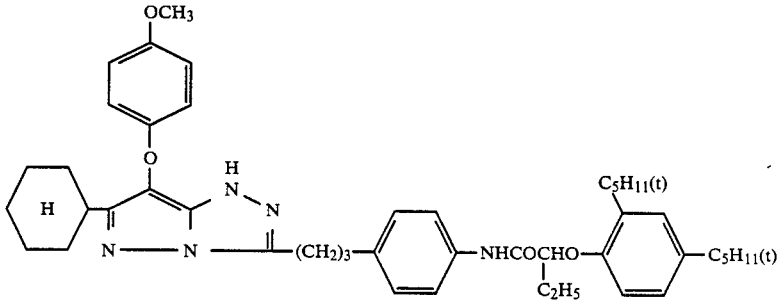
93
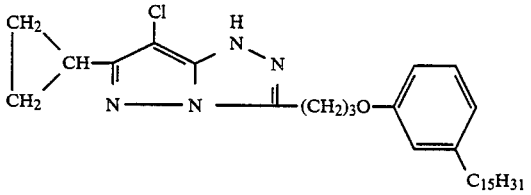
94
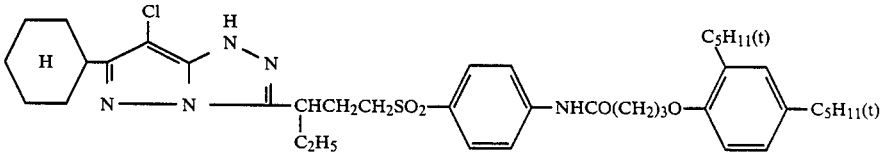
95
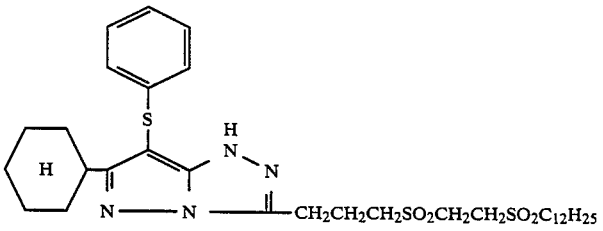
96
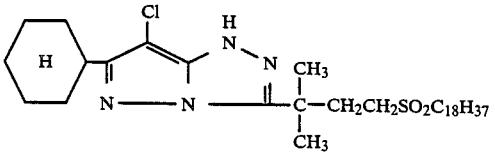
97
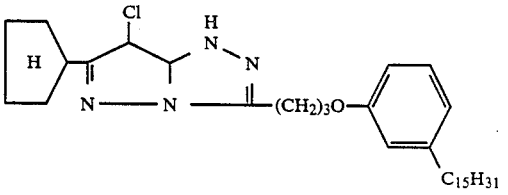
98
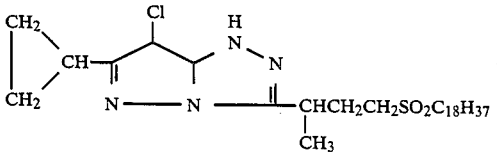

-continued
99
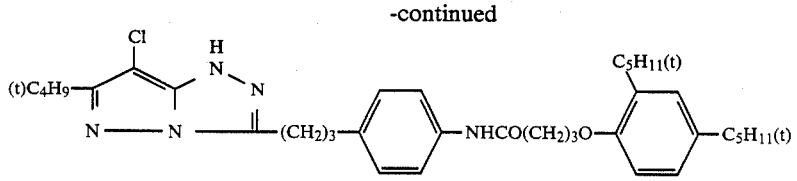
100
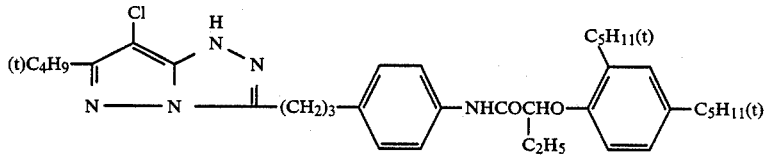
101
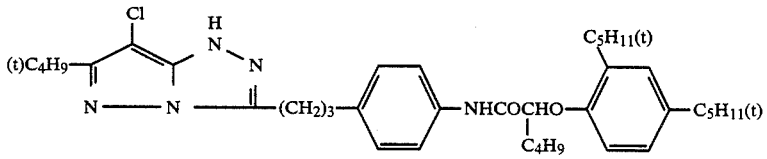
102
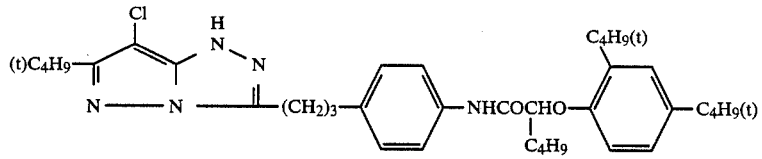
103
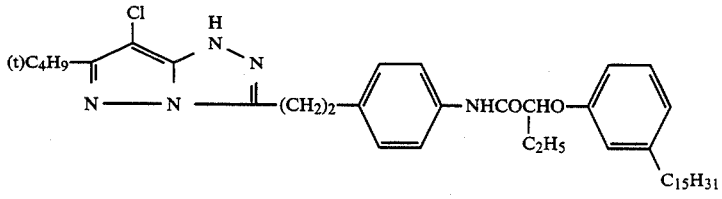
104
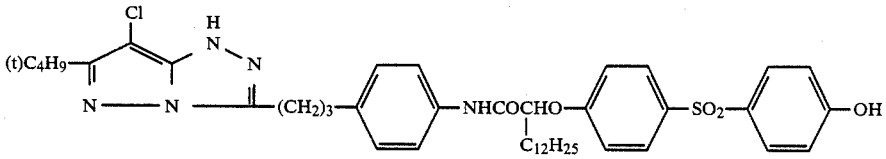
105
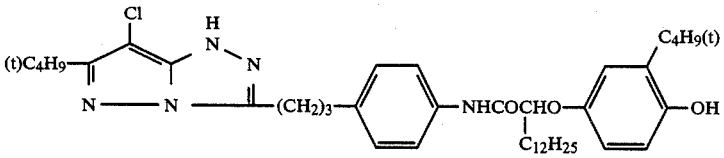
106
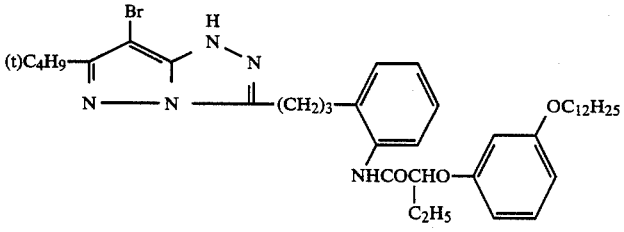
107
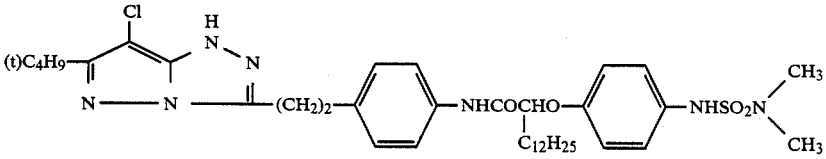

-continued
108
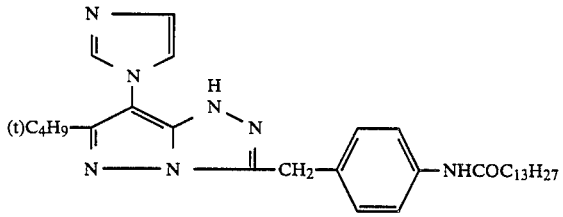
109
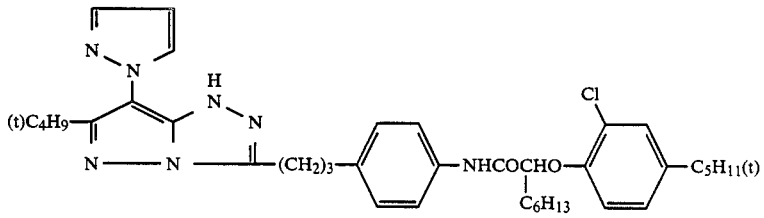
110
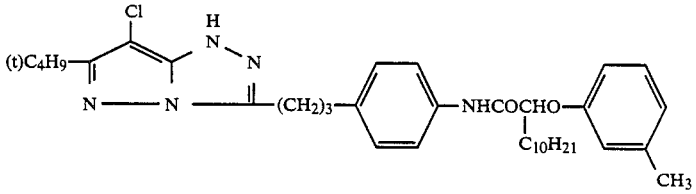
111
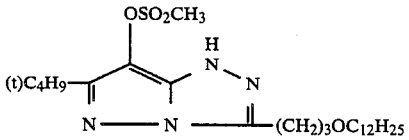
112
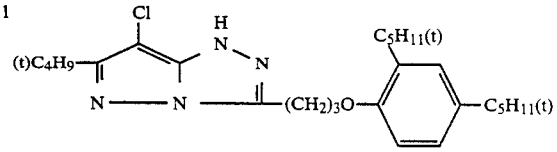
113
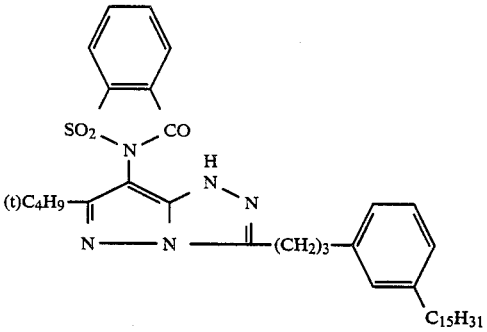
114
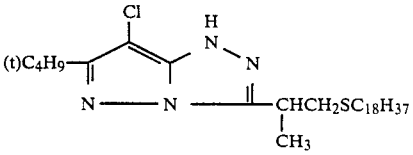
115
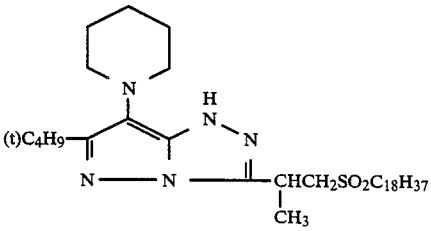
116
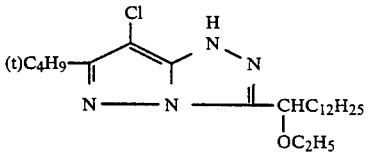
117
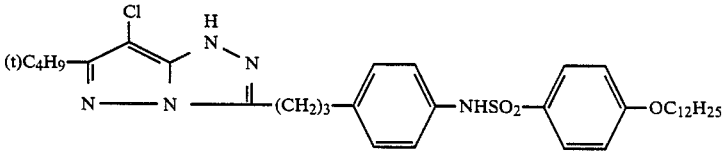

-continued
118
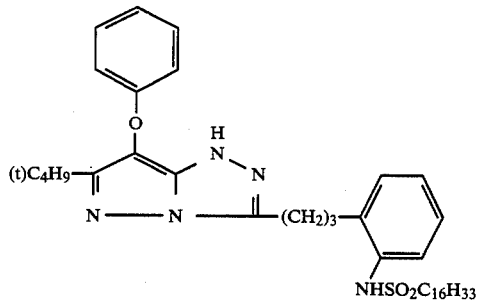
119
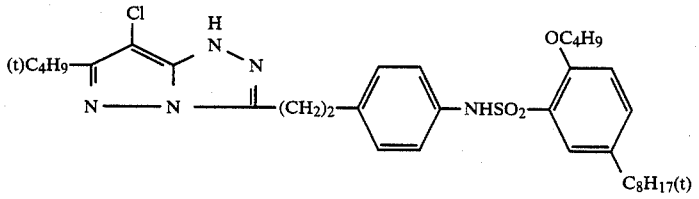
120
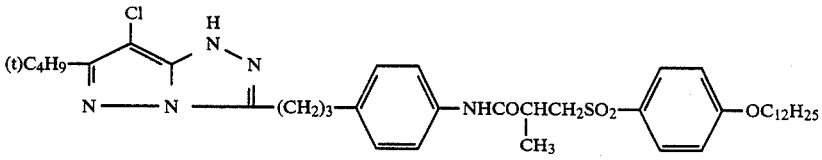
121
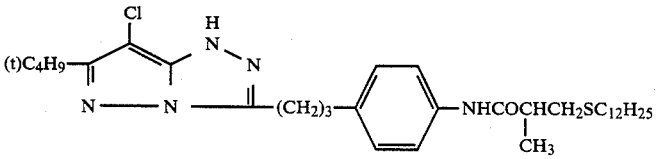
122
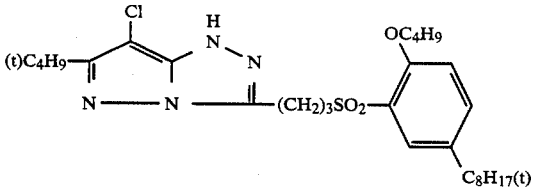
123
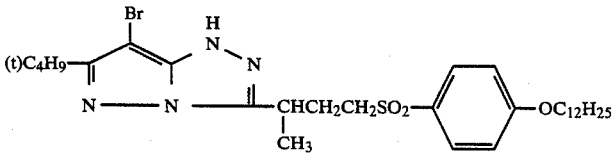
124
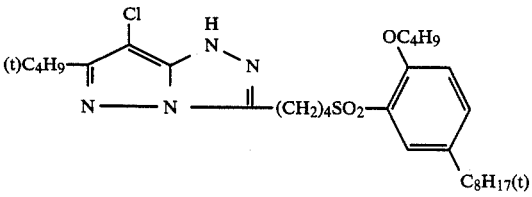

-continued
125
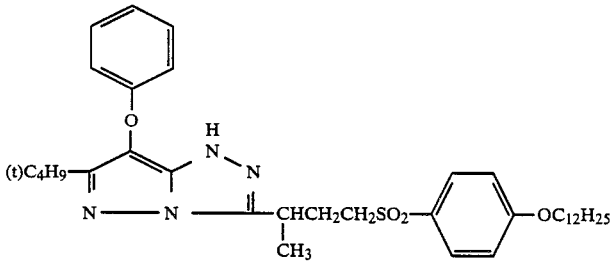
126
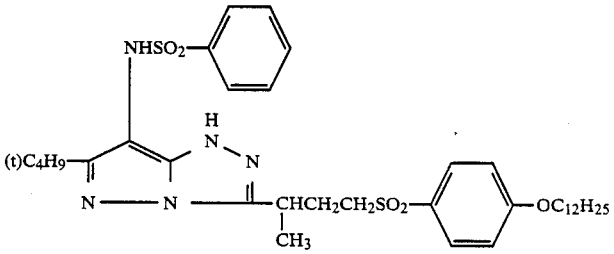
127
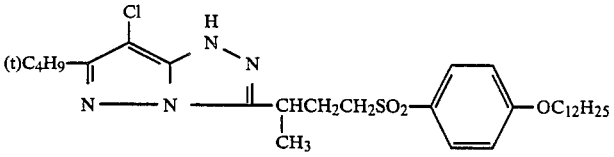
128
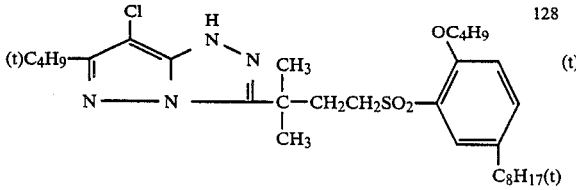
129
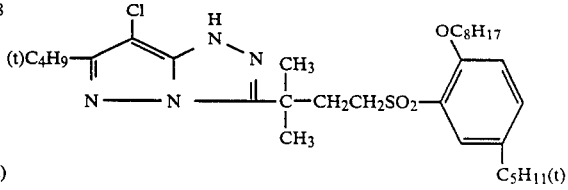
130
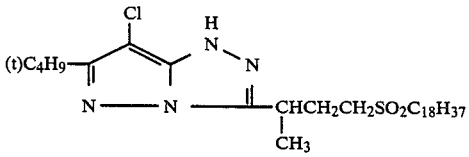
131
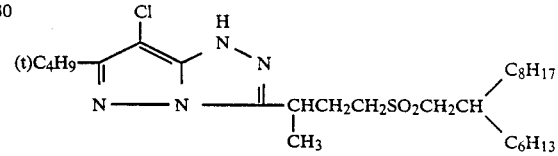
132
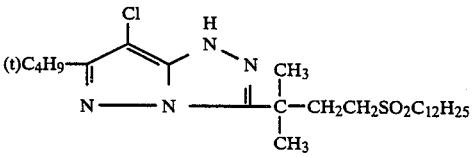
133
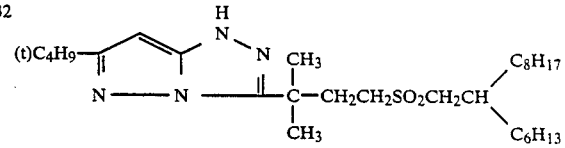
134
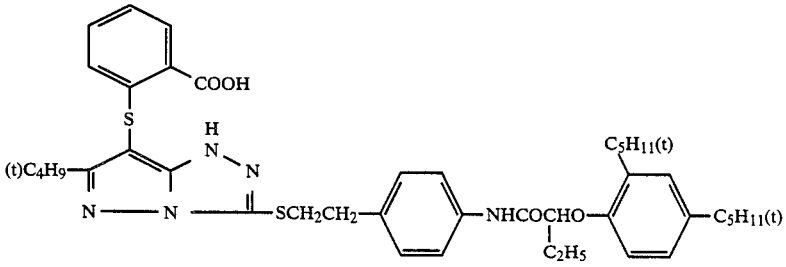

-continued
135
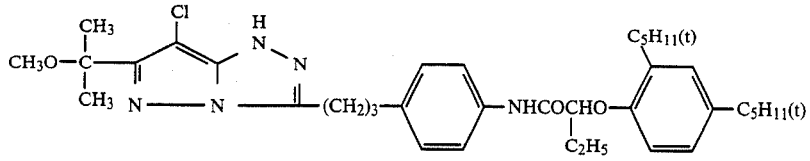
136
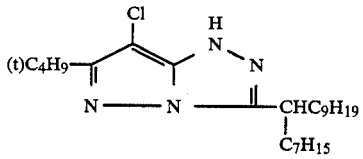
137
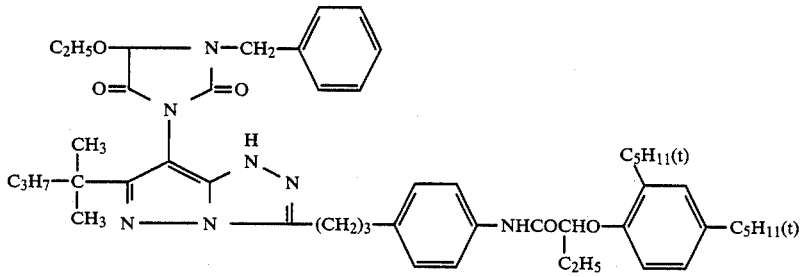
138
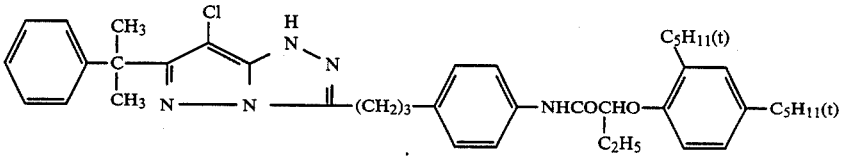
139
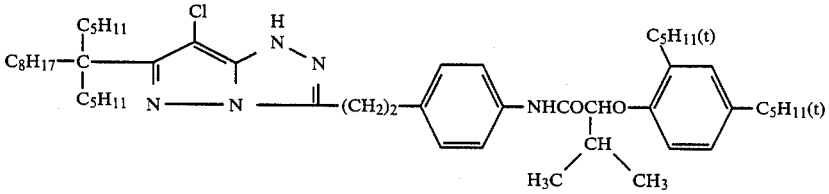
140
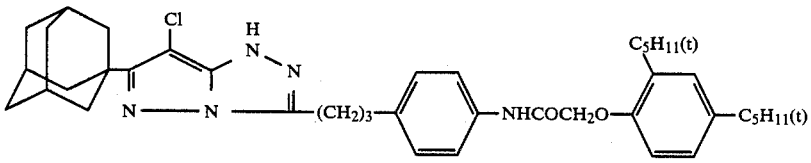
141
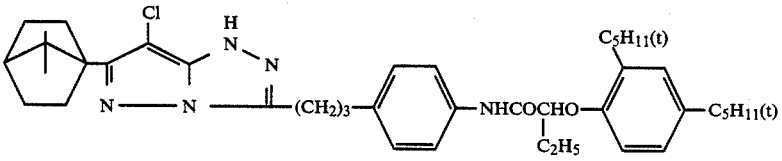
142
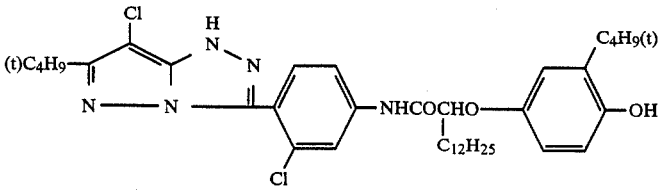

-continued
143
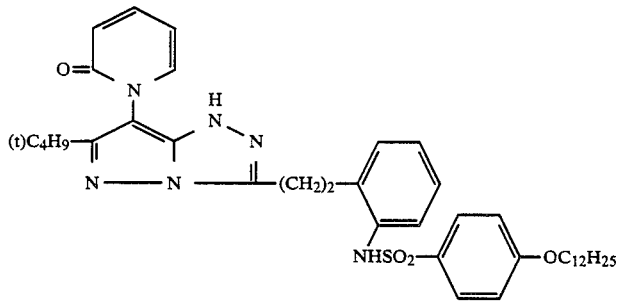
144
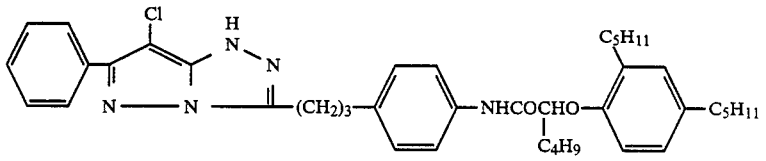
145
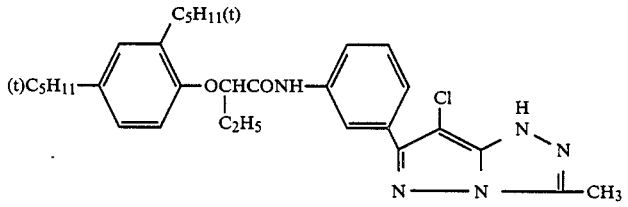
146
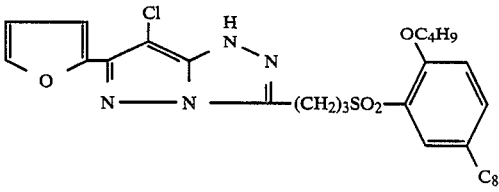
147
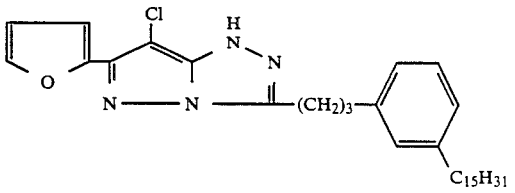
148
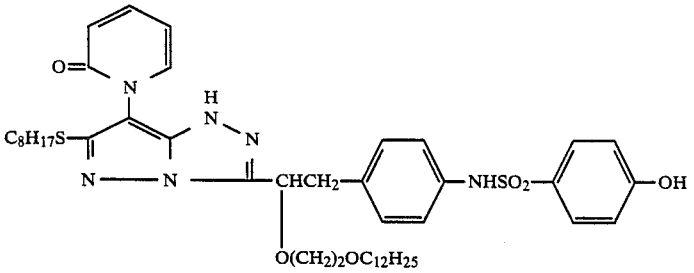
149
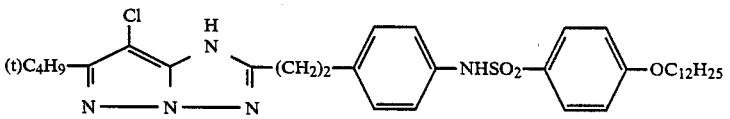
150
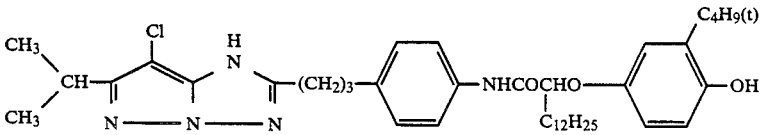
151
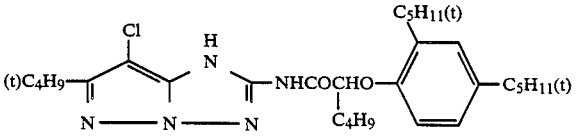

-continued
152
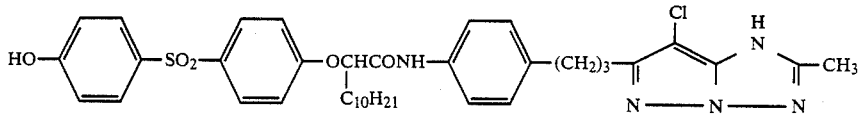
153
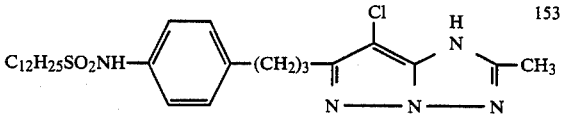
154
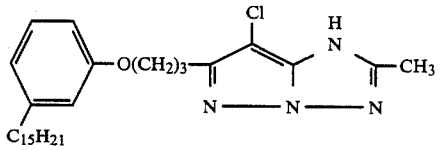
155
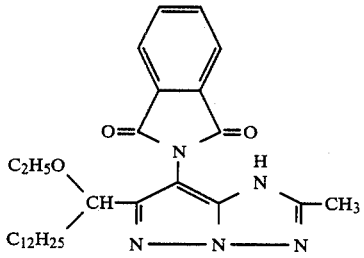
156
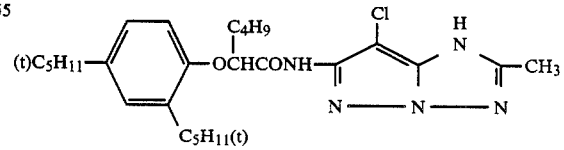
157
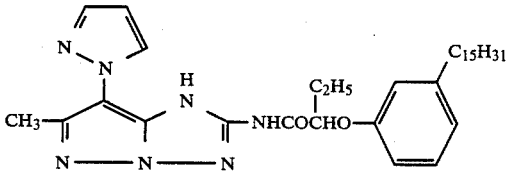
158
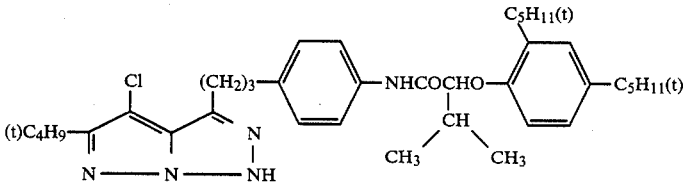
159
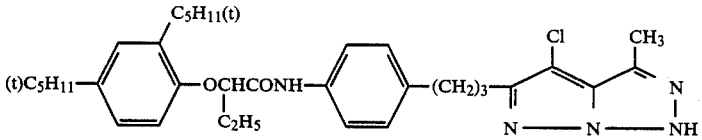
160
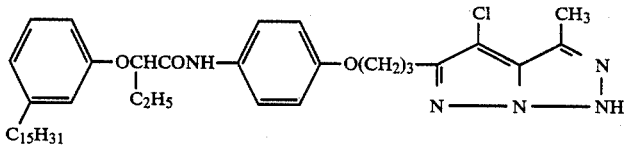
161
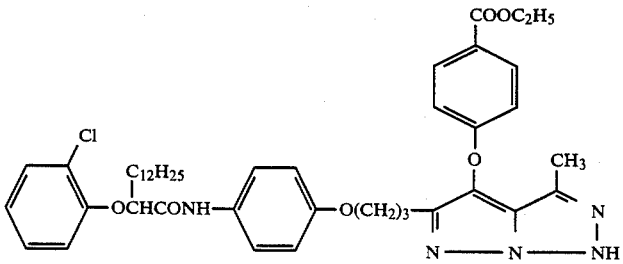

-continued
162
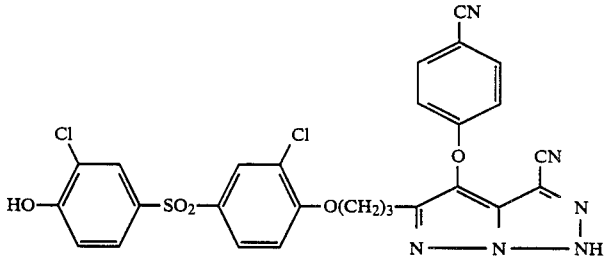
163
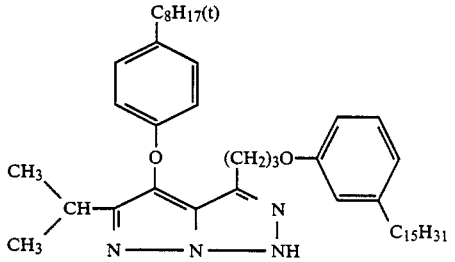
164
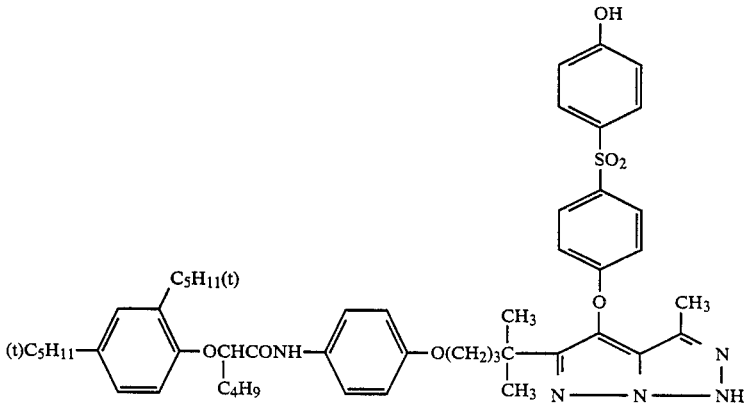
165
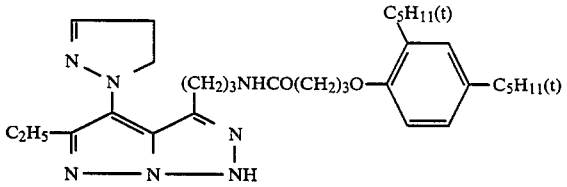
166
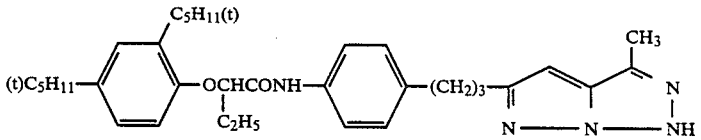
167
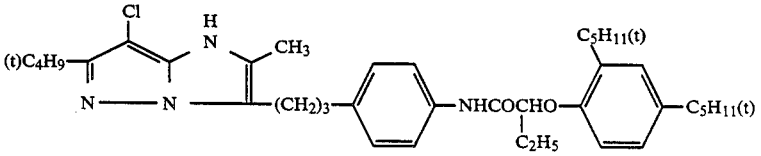
168
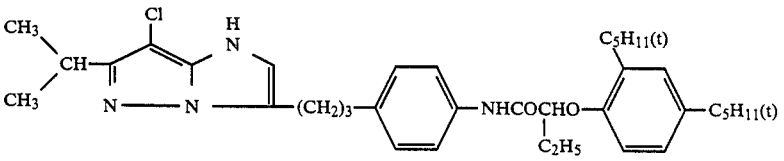

-continued
169
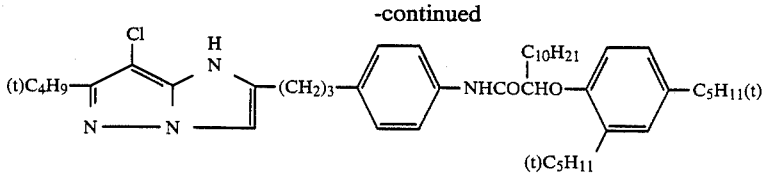
170
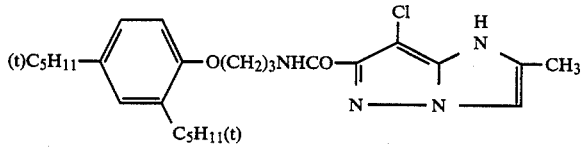
171
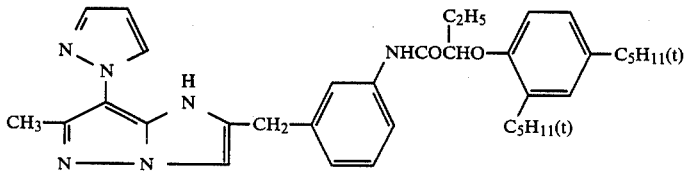
172
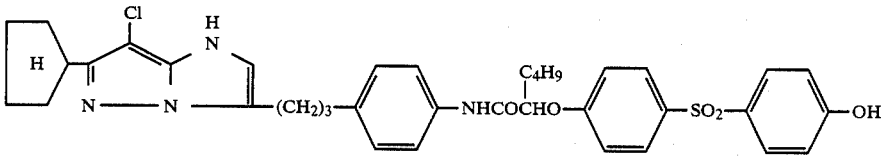
173
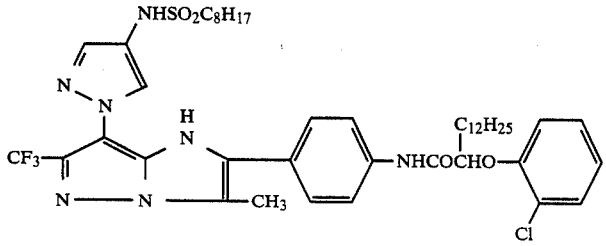
174
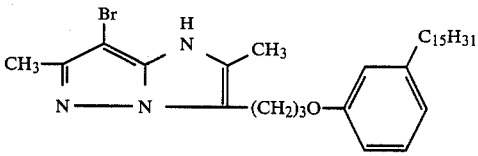
175
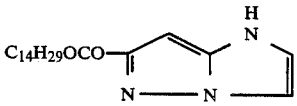
176
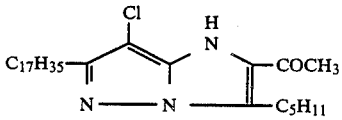
177
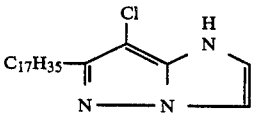
178
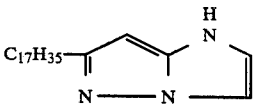
179
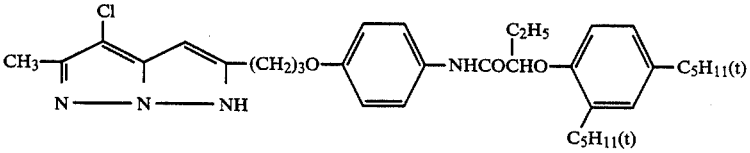
180
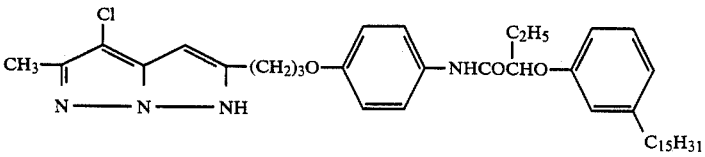

-continued
181
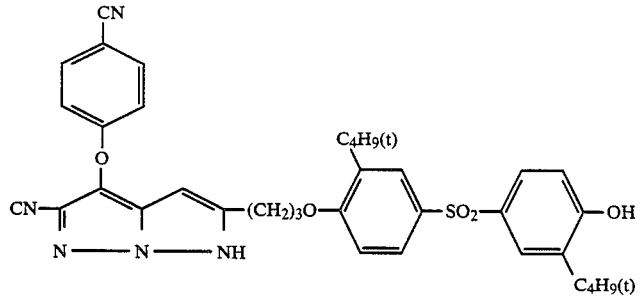
182
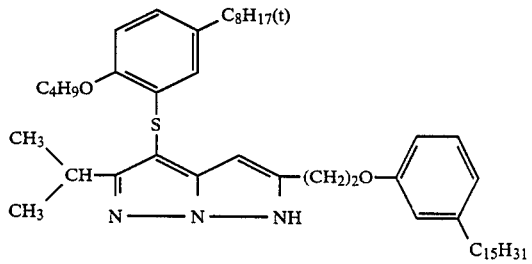
183
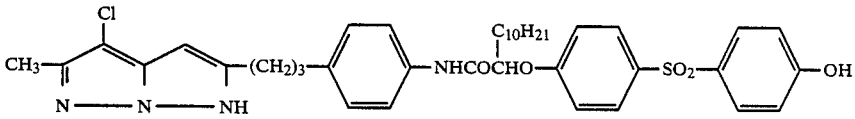
184
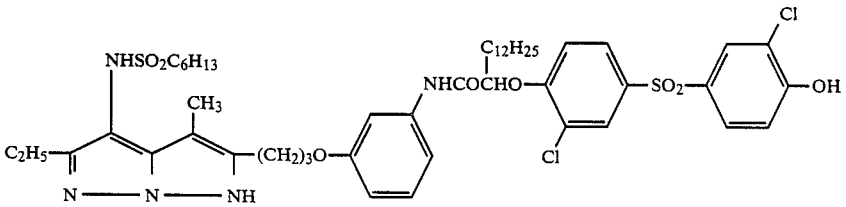
185
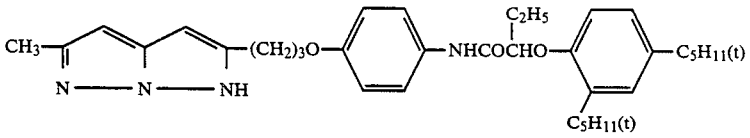
186
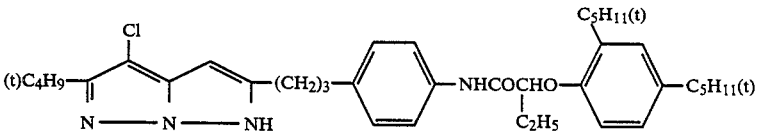
187
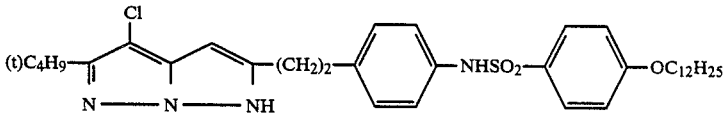
188
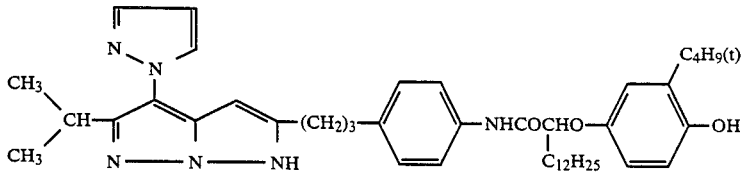

-continued
189
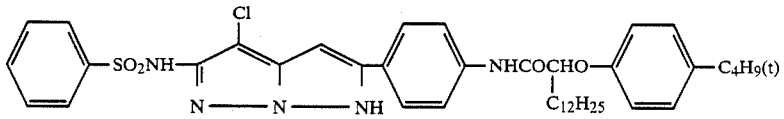
190
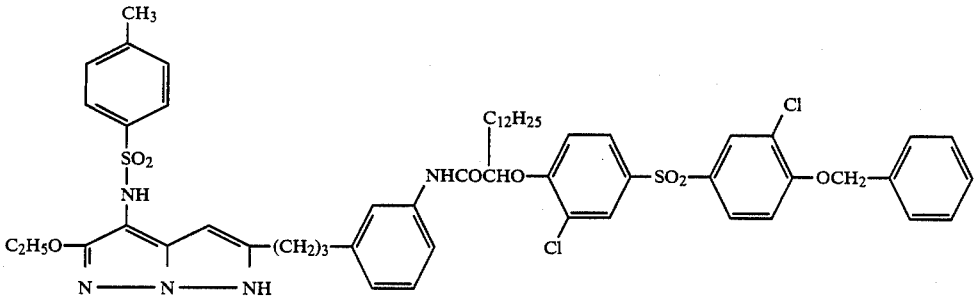
191
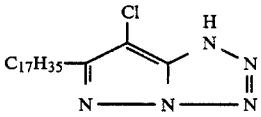
192
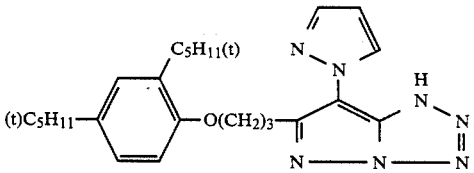
193
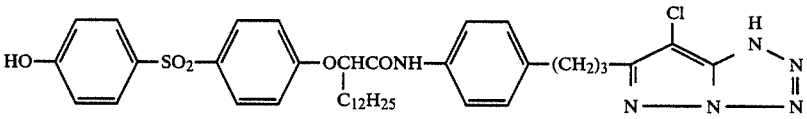
194
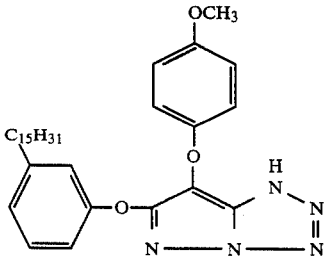
195
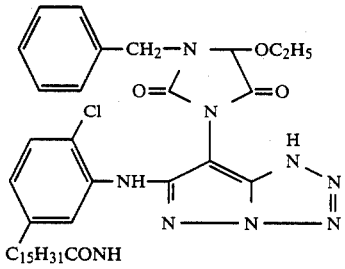
196
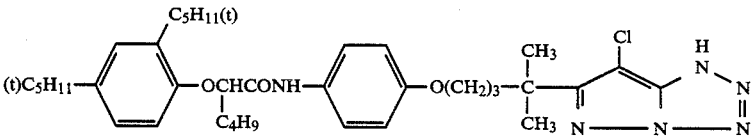
197
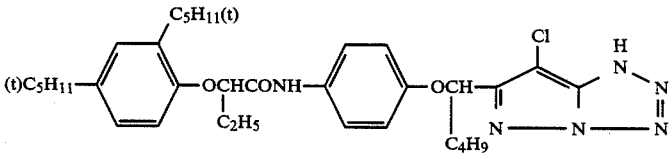
198
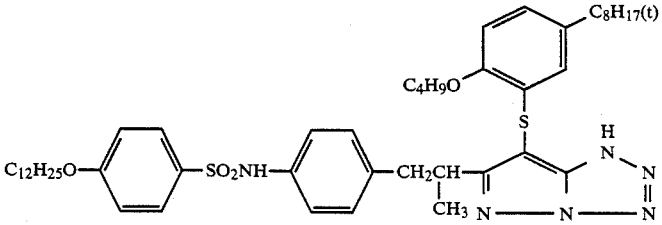

-continued

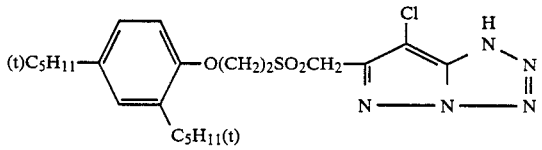

199

Aforesaid couplers were synthesized with reference to Journal of the Chemical Society, Perkin I (1977), 2047–2052, U.S. Pat. No. 3,725,067 and Japanese Patent Publication Open to Public Inspection Nos. 99437/1984, 42045/1983, 162548/1984, 171956/1984, 33552/1985 and 43659/1985 (hereinafter referred to as Japanese Patent Publication O.P.I. Publication).

It is possible to use the couplers of the invention within the range from $1\times10^{-3}$ mol to 1 mol of coupler per mol of silver halide usually and within the range from $1\times10^{-2}$ mol to $8\times10^{-1}$ mol per mol of silver halide preferably.

The couplers of the invention may further be used together with magenta couplers of other types.

In the case that the compounds represented by any one of the following Formulas [I] through [III] are used as cyan couplers in the color photographic light-sensitive materials relating to the invention, the advantages of the invention can be more excellently displayed and, further, another advantage that a cyan-fog variation can be more effectively prevented than in the other cases.

Formula [I]

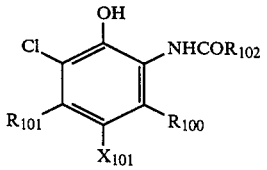

wherein, either one of $R_{100}$ and $R_{101}$ represents hydrogen, while the other represents a normal chained or branch chained alkyl group having at least 2 to 12 carbon atoms; $X_{101}$ represents hydrogen or a group capable of splitting off through a coupling reaction; and $R_{102}$ represents a ballast group.

Formula [C-II]

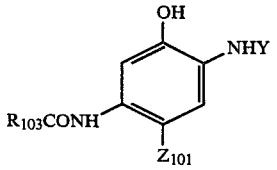

Formula [C-III]

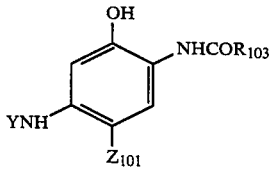

wherein, $Y_{101}$ represents $—COR_{104}$,

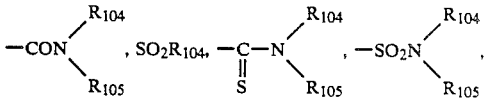

$—CONHCOR_{104}$ or $—CONHSO_2R_{104}$ in which $R_{104}$ represents an alkyl, alkenyl, cycloalkyl, aryl or heterocyclic group, and $R_{105}$ represents hydrogen, an alkyl, alkenyl, cycloalkyl, aryl or heterocyclic group, provided that the $R_{104}$ and $R_{105}$ in combination may form a 5- or 6-membered ring; $R_{103}$ represents a ballast group; and $Z_{101}$ represents hydrogen or a group capable of splitting off through the coupling thereof to the oxidation product of an aromatic primary amine color developing agent.

The normal chained or branch chained alkyl groups each having 2 to 12 carbon atoms, which are represented by $R_{100}$ and $R_{101}$ in the above-given Formula [C-I], include, for example, an ethyl group, a propyl group and a butyl group.

In the Formula [C-I], the ballast groups represented by $R_{102}$ are the organic groups each having such size and configuration that each molecule of couplers has an adequate volume so as not to substantially diffuse the couplers to any other layer from the layer to which the couplers are intrinsically applied. The typical ballast groups include, for example, an alkyl or aryl group having 8 to 32 carbon atoms and more preferably those each having 13 to 28 carbon atoms. The substituents for the above-mentioned alkyl or aryl groups include, for example, an alkyl, aryl, alkoxy, allyloxy, carboxy, acyl, ester, hydroxy, cyano, nitro, carbamoyl, carbonamido, alkylthio, arylthio, sulfonyl, sulfonamido or sulfamoyl group or a halogen. The substituents for the above-mentioned alkyl groups include, for example, those given for the above-mentioned aryl groups.

The preferable ones of the above-mentioned ballast groups are represented by the following formula:

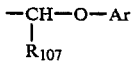

wherein $R_{107}$ represents an alkyl group having 1 to 12 carbon atoms; and Ar represents an aryl group such as a phenyl group, which is also allowed to have a substituent. Such substituents include, for example, an alkyl group, a hydroxy group, a halogen atom, an alkylsulfonamido group and the like and, most preferably, such a branch-chained alkyl group as a t-butyl group and the like.

As it is well known by the skilled in the art that the groups represented by X in the above-given Formula [C-1], which are capable of splitting off through a coupling reaction, will determine the equivalent number of a coupler and at the same time exert an influence upon a coupling reactivity. The typical examples of such groups include, a halogen such as chlorine and fluorine, an aryloxy, substituted or unsubstituted alkoxy, acyloxy, sulfonamido, arylthio, heteroylthio, heteroyloxy, sulfonyloxy, carbamoyloxy or like group. The more typical examples thereof include those described in, for example, Japanese Patent O.P.I. Publication Nos. 10135/1975, 120334/1975, 130441/1975, 48237/1979, 146828/1976, 14736/1979, 37425/1972, 123341/1975 and 95346/1983; Japanese Patent Examined Publication No. 36894/1973; and U.S. Pat. Nos. 3,476,563, 3,737,316 and 3,227,551. Next, the exemplified compounds of the cyan couplers represented by the Formula [I] will be given below. It is, however, to be understood that the invention shall not be limited thereto.

Formula [C-1]
Exemplified Compounds:

| Coupler No. | $R_{101}$ | $X_{101}$ | $R_{102}$ | $R_{100}$ |
|---|---|---|---|---|
| C-1 | $-C_2H_5$ | $-H$ | 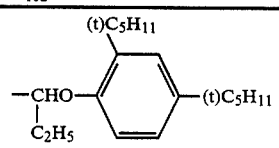 | $-H$ |
| C-2 | $-C_2H_5$ | $-Cl$ | 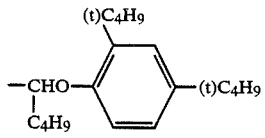 | $-H$ |
| C-3 | $-C_2H_5$ | $-H$ | 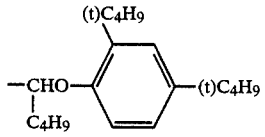 | $-H$ |
| C-4 | $-C_2H_5$ | $-Cl$ | 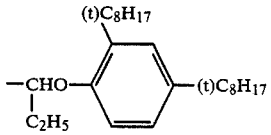 | $-H$ |
| C-5 | $C_2H_5$ | $-Cl$ | 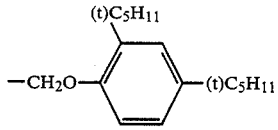 | $-H$ |
| C-6 | $-C_2H_5$ | 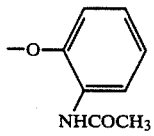 | 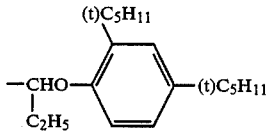 | $-H$ |
| C-7 | 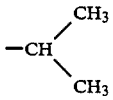 | $-Cl$ | 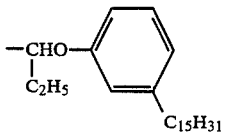 | $-H$ |
| C-8 | $-C_2H_5$ | $-Cl$ | 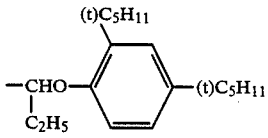 | $-H$ |
| C-9 | $-C_2H_5$ | $-Cl$ | 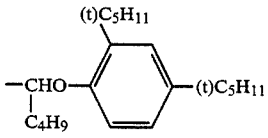 | $-H$ |

-continued
Formula [C-1]
Exemplified Compounds:
| Coupler No. | $R_{101}$ | $X_{101}$ | $R_{102}$ | $R_{100}$ |
|---|---|---|---|---|
| C-10 | $-C_4H_9$ | $-F$ | 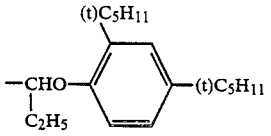 | $-H$ |
| C-11 | $-C_2H_5$ | $-F$ | 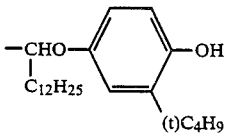 | $-H$ |
| C-12 | $-C_2H_5$ | $-Cl$ | 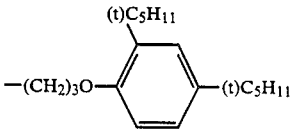 | $-H$ |
| C-13 | $-C_2H_5$ | $-F$ | 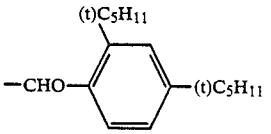 | $-H$ |
| C-14 | $-C_4H_9$ | $-Cl$ | 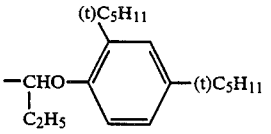 | $-H$ |
| C-15 | $-C_2H_5$ | $-Cl$ | 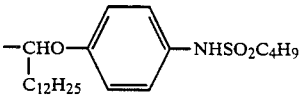 | $-H$ |
| C-16 | $-C_2H_5$ | $-Cl$ | 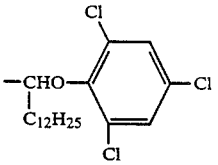 | $-H$ |
| C-17 | $-CH(CH_3)_2$ | $-Cl$ | $-C_{18}H_{37}$ | $-H$ |
| C-18 | $-C_2H_5$ | $-F$ | 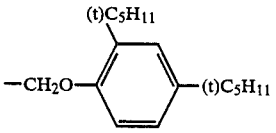 | $-H$ |
| C-19 | $-C_2H_5$ | 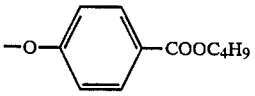 | 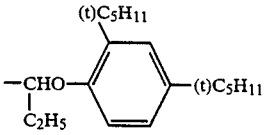 | $-H$ |
| C-20 | $-C_2H_5$ | $-Cl$ | 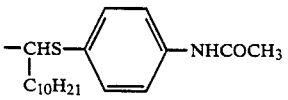 | $-H$ |

-continued

Formula [C-1]
Exemplified Compounds:

| Coupler No. | $R_{101}$ | $X_{101}$ | $R_{102}$ | $R_{100}$ |
|---|---|---|---|---|
| C-21 | $-C_3H_7$ | $-Cl$ | 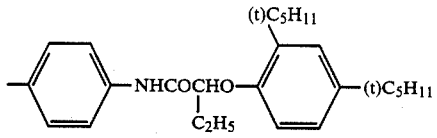 | $-H$ |
| C-22 | $-C_3H_7$ | $-Cl$ | 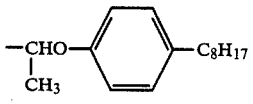 | $-H$ |
| C-23 | $-C_2H_4NHCOCH_3$ | $-Cl$ | 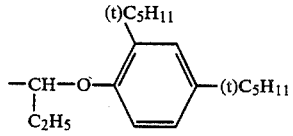 | $-H$ |
| C-24 | $-C_3H_6OCOH_3$ | $-Cl$ | 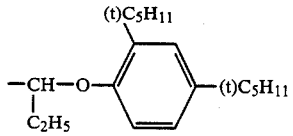 | $-H$ |
| C-25 | $-H$ | $-Cl$ | 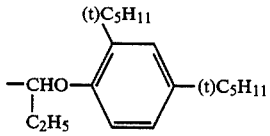 | $-C_2H_5$ |
| C-26 | $-H$ | $-Cl$ | 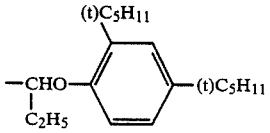 | $-C_3H_7$ |
| C-27 | $-H$ | $-Cl$ | 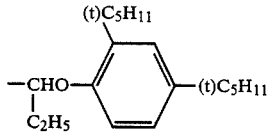 | $-C_{15}H_{31}$ |
| C-28 | $-C_2H_5$ | $-Cl$ | 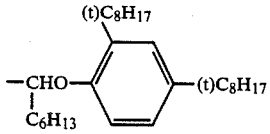 | $-H$ |

The processes each for synthesizing the exemplified compounds will now be described below. The other exemplified compounds may also be synthesized in the same processes as above.

Synthesis Example of Exemplified Compound C-5:

[(1)-a] Synthesis of 2-nitro-4,6-dichloro-5-ethylphenol:

A dissolution of 0.6 g of iodine and 1.5 g of ferric chloride was made in 150 ml of glacial acetic acid. To the resulted solution, 75 ml of sulfuryl chloride were dropped at 40° C. for 3 hours. The precipitates produced in the course of the dropping were reactively dissolved after completing the dropping of the sulfuryl chloride by heatedly refluxing the precipitates. It took about two hours to complete the heat-reflux treatment. The crystals produced by pouring a reaction liquid in water were recrystallized and then refined by making use of methanol. The [(1)-a] was confirmed by making use of nuclear magnetic resonance spectra and in elementary analyses.

[(1)-b] Synthesis of 2-nitro-4,6-dichloro-5-ethylphenol:

A dissolution of 21.2 g of the compound of [(1)-a] was made in 300 ml of alcohol. Whereto, a Raney nickel catalyst in a decatalyzing amount was added and then hydrogen was applied at an atmospheric pressure until the hydrogen was not absorbed. After the reaction, the Raney nickel was removed and the resulted matter was distilled off with alcohol at reduced pressure. The [(1)-b], the resulted residue, was acylated without refining, in the following manner:

[(1)-c] Synthesis of 2[(2,4-di-tert-acylphenoxy)acetamido]-4,6-dichloro-5-ethylphenol:

A dissolution of 18.5 g of a crude amino substance prepared in the above-mentioned [(1)-b] process was made in a mixture liquid comprising 500 ml of glacial acetic acid and 16.7 g of sodium acetate and whereto an acetic acid solution prepared by dissolving 28.0 g of 2,4-di-tert-aminophenoxyacetic acid chloride in 50 ml of acetic acid was dropped at room temperature for 30 minutes. After stirring it for 30 minutes, the resulted reaction liquid was poured into ice water. The resulted precipitate was filtered and dried up. The resulted dried precipitate was recrystallized twice with acetonitrile, so that the object matter was obtained. The object matter was confirmed by an elemental analysis and nuclear magnetic resonance spectra.

| | $C_{21}H_{35}NO_3Cl_2$ | | | |
|---|---|---|---|---|
| | C | H | N | Cl |
| Calculated value (%) | 65.00 | 7.34 | 2.92 | 14.76 |
| Measured value (%) | 64.91 | 7.36 | 2.99 | 14.50 |

Now, the cyan couplers represented by the Formulas [C-II] and [C-III] will be described below.

In the Formulas [C-II] and [C-III], $Y_{101}$ represents $-COR_{104}$,

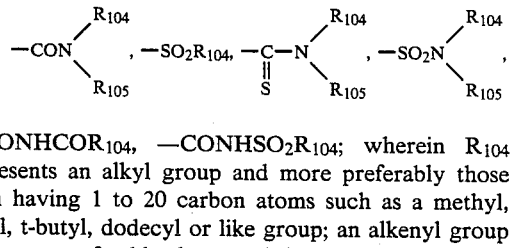

$-CONHCOR_{104}$, $-CONHSO_2R_{104}$; wherein $R_{104}$ represents an alkyl group and more preferably those each having 1 to 20 carbon atoms such as a methyl, ethyl, t-butyl, dodecyl or like group; an alkenyl group and more preferably those each having 2 to 20 carbon atoms such as an allyl, heptadecenyl or like group; a cycloalkyl group and more preferably those each having a 5- to 7-membered ring such as a cyclohexyl group; an aryl group such as a phenyl, tolyl, naphthyl or like group; and a heterocyclic group and more preferably those each having a 5- to 6-membered ring containing 1 to 4 nitrogen, oxygen or sulfur atoms such as furyl, thienyl, benzothiazolyl or like group; and $R_{105}$ represents a hydrogen atom or one of the groups represented by the $R_{104}$. $R_{104}$ and $R_{105}$ are allowed to couple to each other so as to form a 5- or 6-membered heterocyclic ring containing nitrogen, and they are also allowed to introduce an arbitrary substituent thereinto including, for example, an alkyl group having 1 to 10 carbon atoms such as an ethyl, i-propyl, i-butyl, t-butyl, t-butyl or like groups; an aryl group such as a phenyl, naphthyl or like groups; a halogen such as fluorine, chlorine, bromine or like elements; a cyano group; a nitro group; a sulfonamido group such as a methanesulfonamido, butanesulfonamido, p-toluenesulfonamido or like groups; a sulfamoyl group such as a methylsulfamoyl, phenylsulfamoyl or like groups; a sulfonyl group such as methanesulfonyl, p-toluenesulfonyl or like groups; a fluorosulfonyl group; a carbamoyl group such s a dimethylcarbamoyl, phenylcarbamoyl or like groups; an oxycarbonyl group such as an ethoxycarbonyl, phenoxycarbonyl or like groups; an acyl group such as an acetyl, benzoyl or like groups; a heterocyclic group such as a pyridyl, pyrazolyl or like groups; an alkoxy group; an aryloxy group; an acyloxy group; and the like groups.

In the Formulas [C-III] and [C-III], $R_{103}$ represents a ballast group necessary for giving antidispersibility to the cyan couplers represented by the Formulas [C-II] and [C-III] and the cyan dyes each formed by the above-mentioned cyan couplers and, more preferably, an alkyl, aryl or heterocyclic group each having 4 to 30 carbon atoms, including, for example, an alkyl group such as a t-butyl, n-octyl, t-octyl, n-dodecyl or like groups; an alkenyl group; a cycloalkyl group; a 5- or 6-membered heterocyclic group; or the like groups; each of which is normal chained or branch chained.

In the Formulas [C-II] and [C-III], $Z_{101}$ represents hydrogen or a group capable of splitting off at the time of coupling reaction thereof on the oxidation products of a color developing agent. They include, for example, a halogen such as chlorine, bromine, fluorine or like elements; substituted or unsubstituted alkoxy, aryloxy, heterocyclic oxy, acyloxy, carbamoyloxy, sulfonyloxy, alkylthio, arylthio, heterocyclic thio, sulfonamido or like groups and, more typically, those described in, for example, U.S. Pat. No. 3,741,563; Japanese Patent O.P.I. Publication Nos. 37425/1972, 10135/1975, 117422/1975, 130441/1975, 108841/1976, 120343/1975, 18315/1877, 105226/1978, 14736/1979, 48237/1979, 32071/1980, 65957/1980, 1938/1981, 12643/1981, 27147/1981, 146050/1984, 166956/1984, 24547/1985, 35731/1985 and 37557/1985; and Japanese Patent Examined Publication No. 36894/1973.

Among the cyan couplers represented by the Formula [C-II] or [C-III], those couplers each represented by the following Formula [C-V], [C-VI] or [C-VII] are further preferable in the invention:

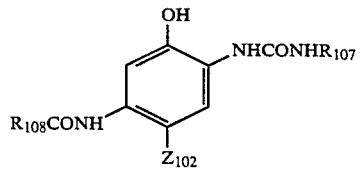

Formula [C-V]

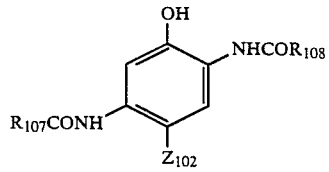

Formula [C-VI]

-continued

Formula [C-VII]

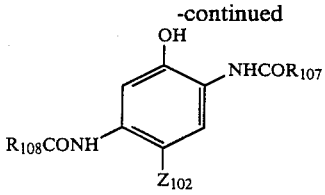

In the above-given Formulas [C-V] through [C-VII], $R_{107}$ represents a substituted or unsubstituted aryl group and, more preferably, a phenyl group in particular. When the above-mentioned aryl group has a substituent, such substituents include, for example, at least one substituent selected from the group consisting of $-SO_2R_{109}$; a halogen such as fluorine, bromine, chlorine or like elements; $-CF_3$, $-NO_2$, $-CN$, $-COR_{109}$, $-COOR_{109}$, $-SO_2OR_{109}$,

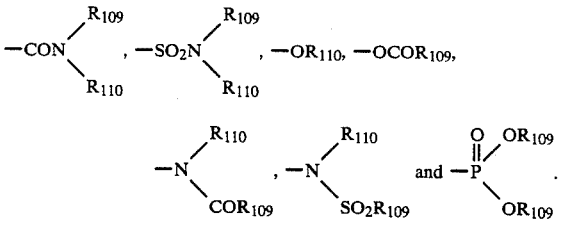

wherein $R_{109}$ represents an alkyl group and, more preferably, those each having 1 to 20 carbon atoms such as a methyl, ethyl, tert-butyl, dodecyl or like groups; an alkenyl group and, more preferably, those each having 2 to 20 carbon atoms such as an allyl, heptadecenyl or like groups; a cycloalkyl group and, more preferably, those each having a 5- to 7-membered ring such as a cyclohexyl or like groups; and an aryl group such as a phenyl, tolyl, naphthyl or like groups; and $R_{110}$ represents hydrogen or the groups each represented by the $R_{109}$.

The compounds suitable for the phenol type cyan couplers each represented by the Formula [C-V] are those in which $R_{107}$ is a substituted or unsubstituted phenyl group and the substituent to the phenyl group is a cyano, nitro, $-SO_2R_{111}$ in which $R_{111}$ represents an alkyl group, a halogen or a trifluoromethyl group.

In the Formulas [C-V], [C-VI] and [C-VII], $R_{108}$ represents an alkyl group and, more preferably, those each having 1 to 20 carbon atoms such as a methyl, ethyl, tert-butyl, dodecyl or like groups; an alkenyl group and, more preferably, those each having 2 to 20 carbon atoms such as an allyl, oleyl or like groups; a cycloalkyl group and, more preferably, a 5- to 7-membered cyclic group such as a cyclohexyl or like groups; an aryl group such as a phenyl, tolyl, naphthyl or like groups; and a heterocyclic group and, more preferably, a 5- or 6-membered heterocyclic group each containing 1 to 4 nitrogen, oxygen or sulfur atoms such as a furyl, thienyl, benzothiazolyl or like groups.

The above-mentioned $R_{109}$ and $R_{110}$, and $R_{108}$ denoted in the Formulas [C-V], [C-VI] and [C-VII], each are further allowed to introduce thereinto an arbitrary substituent which typically includes such a substituent as is capable of being introduced into the $R_{104}$ or $R_{105}$ denoted in the aforegiven Formulas [II] and [III]. The preferable substituents include, particularly, a halogen such as chlorine, fluorine or like elements.

In the Formulas [V], [VI] and [VII], $Z_{102}$ and $R_{108}$ are synonymous with those denoted in the Formulas [II] and [III], respectively. The preferable examples of the ballast groups represented by $R_{108}$ include the groups each represented by the following Formula [VIII]:

Formula [VIII]

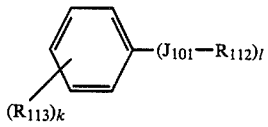

wherein, $J_{101}$ represents an oxygen or sulfur atom or a sulfonyl group; k is an integer of from 0 to 4 and l is an integer of 0 or 1; and, if k is not less than 2 and there are 2 or more $R_{113}$s, such $R_{113}$s may be the same with or the different from each other; $R_{112}$ represents a substituted or unsubstituted alkylene group having 1 to 20 carbon atoms, in which the aryl group thereof is substituted; and $R_{113}$ represents a monovalent group including, for example, a hydrogen atom; a halogen atom such as chlorine or bromine; an alkyl group and, more preferably, a normal chained or branch chained alkyl group having 1 to 20 carbon atoms such as a methyl, t-butyl, t-pentyl, t-octyl, dodecyl, pentadecyl, benzyl, phenethyl or like groups; an aryl group such as a phenyl group; a heterocyclic group and, more preferably, a nitrogen-containing heterocyclic group; an alkoxy group and, more preferably, a normal chained or branch chained alkoxy group having 1 to 20 carbon atoms such as a methoxy, ethoxy, t-butyloxy, octyloxy, decyloxy, dodecyloxy or like groups; an aryloxy group such as a phenoxy group; a hydroxy group; an acyloxy group and, more preferably, an alkylcarbonyloxy group; an arylcarbonyloxy group such as an acetoxy, benzoyloxy or like groups; a carboxy group; an alkyloxycarbonyl group and, more preferably, a normal chained or branch chained alkyloxycarbonyl group having 1 to 20 carbon atoms; an aryloxycarbonyl group and, more preferably, a phenoxycarbonyl group; an alkylthio group and, more preferably, those each having 1 to 20 carbon atoms; an acyl group and, more preferably, a normal chained or branch chained alkycarbonyl group having 1 to 20 carbon atoms, an acylamino group having 1 to 20 carbon atoms and a normal chained or branch chained alkylcarbonamido group having 1 to 20 carbon atoms; a benzenecarbonamido group; a sulfonamido group and, more preferably, a normal chained or branch chained alkylsulfonamido or benzenesulfonamido group having 1 to 20 carbon atoms; a carbamoyl group and, more preferably, a normal chained or branch chained alkylaminocarbonyl or phenylaminocarbonyl group having 1 to 20 carbon atoms; and a sulfamoyl group and, more preferably, a normal chained or branch chained alkylaminosulfonyl or phenylaminosulfonyl group having 1 to 20 carbon atoms.

The typical exemplified compounds of the cyan couplers each represented by the Formula [C-II] or [C-III], which are capable of being used in the invention will be given below:
[Exemplified Compounds]
C-29
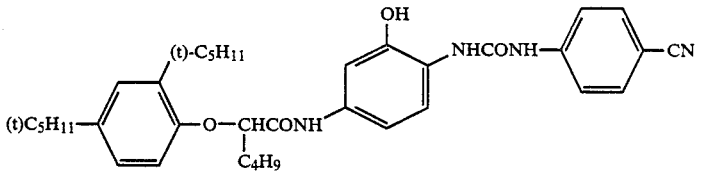
C-30
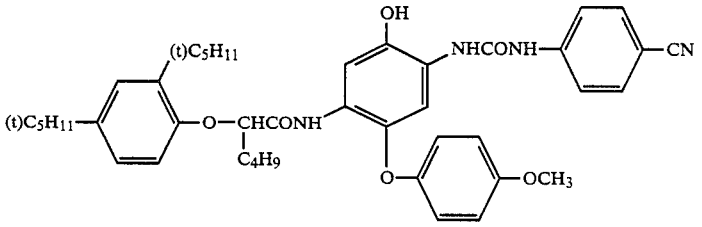
C-31
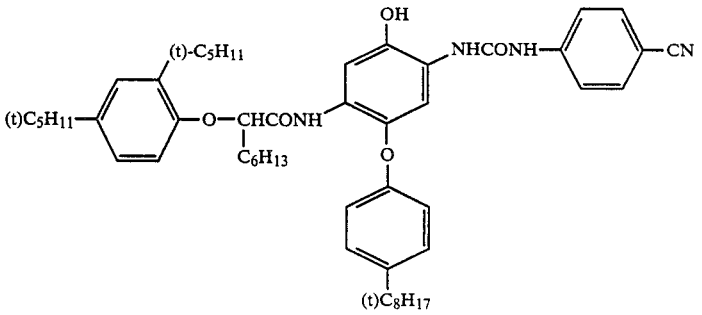
C-32
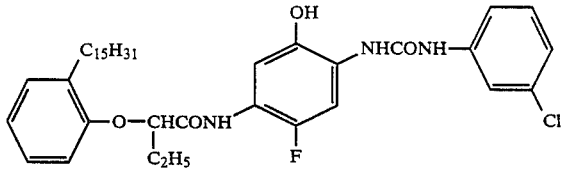
C-33
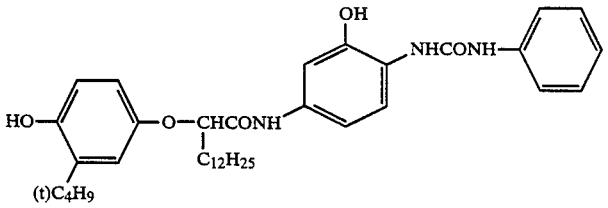
C-34
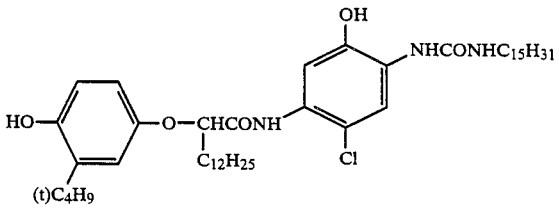

-continued
[Exemplified Compounds]
C-35
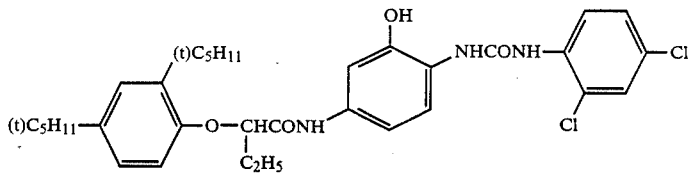
C-36
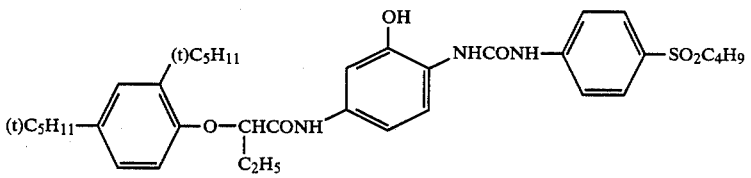
C-37
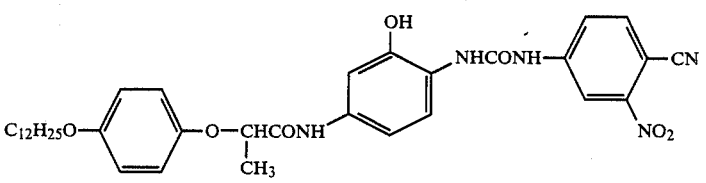
C-38
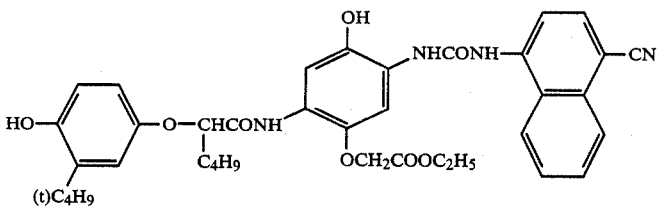
C-39
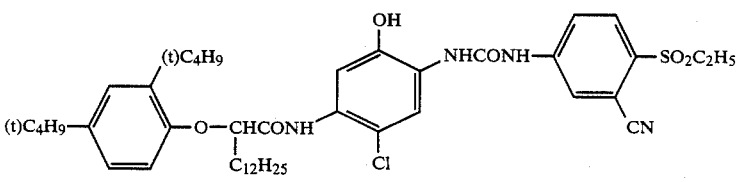
C-40
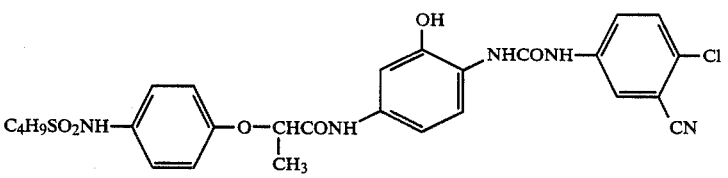
C-41
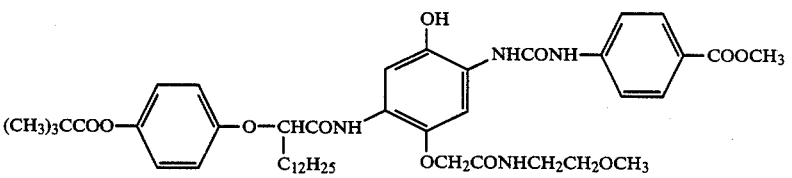
C-42
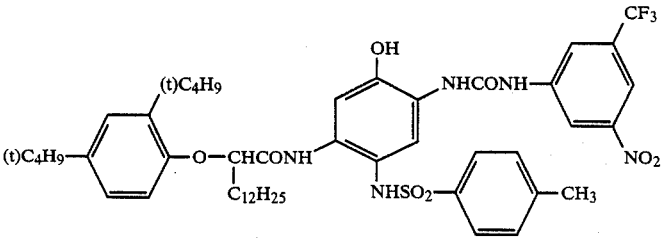

-continued
[Exemplified Compounds]
C-43
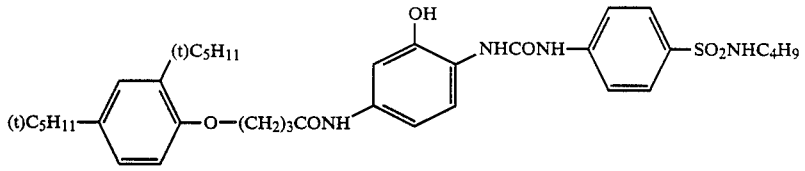
C-44
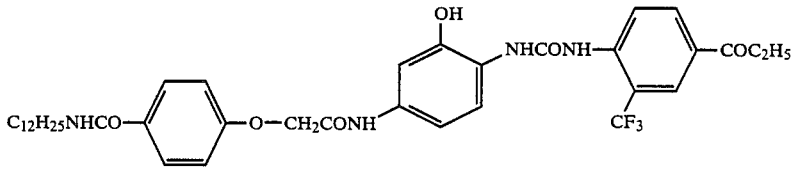
C-45
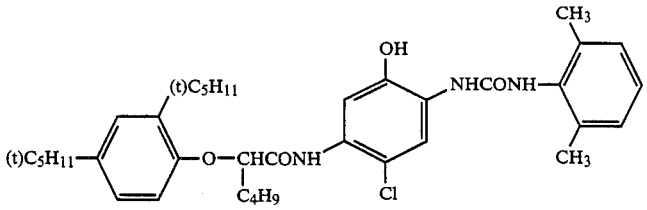
C-46
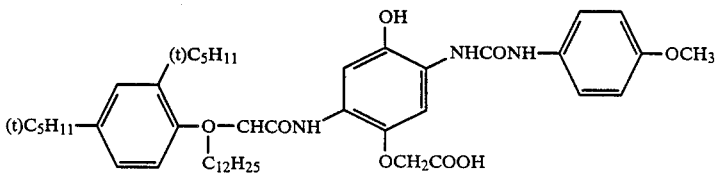
C-47
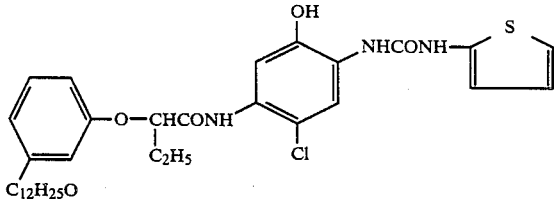
C-48
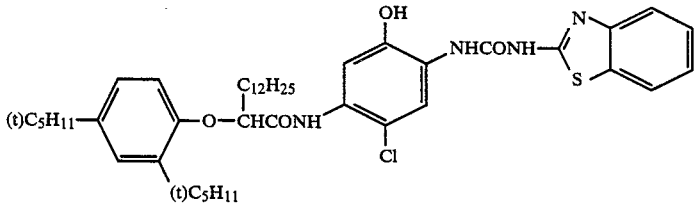
C-49
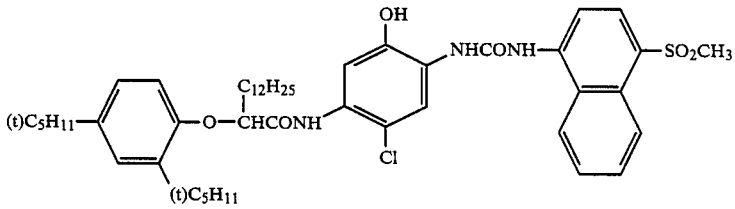

-continued
[Exemplified Compounds]
C-50
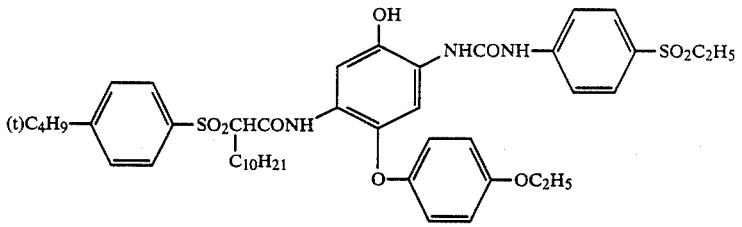
C-51
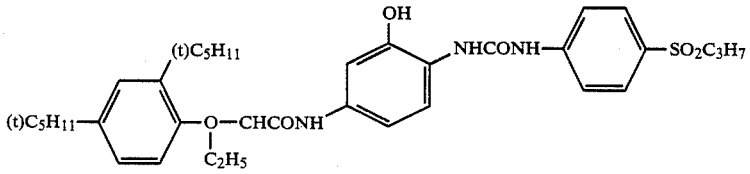
C-52
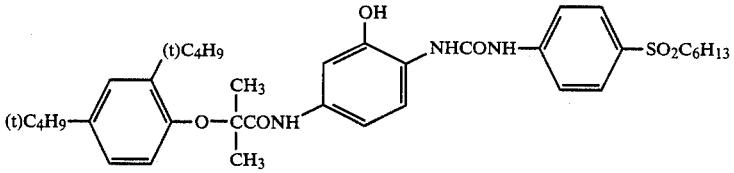
C-53
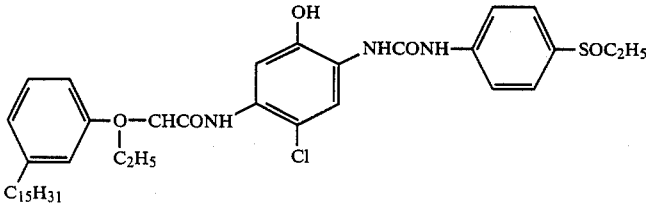
C-54
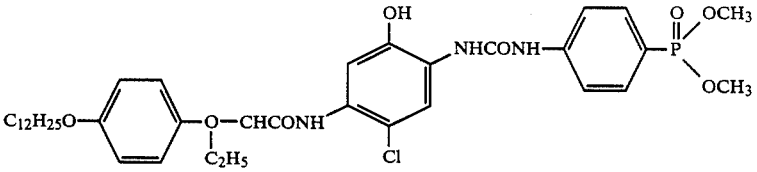
C-55
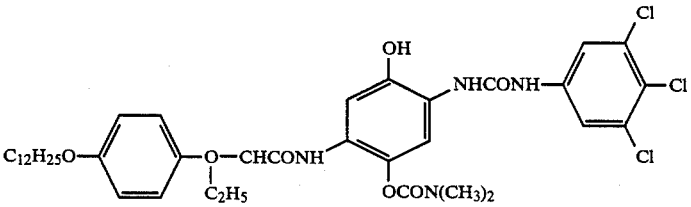
C-56
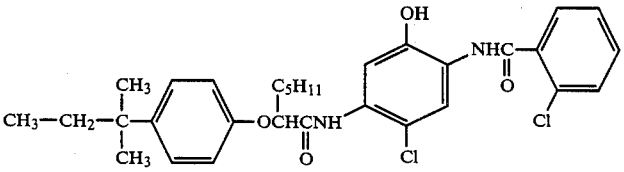

-continued
[Exemplified Compounds]
C-57
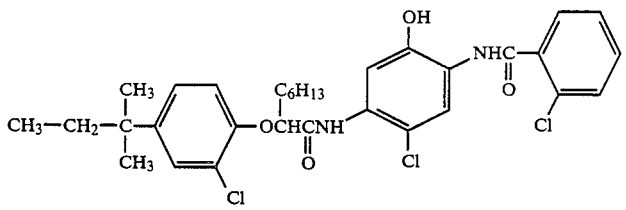
C-58
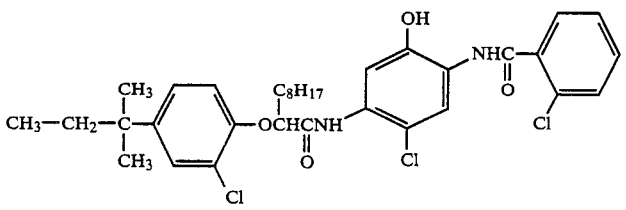
C-59
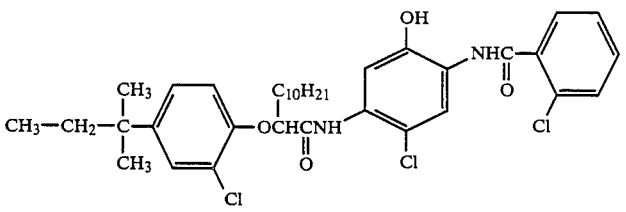
C-60
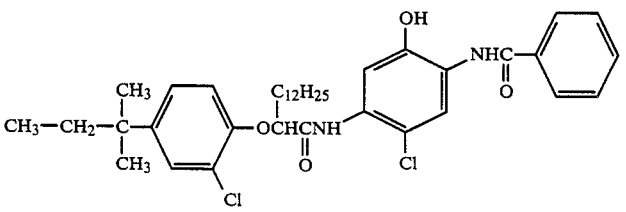
C-61
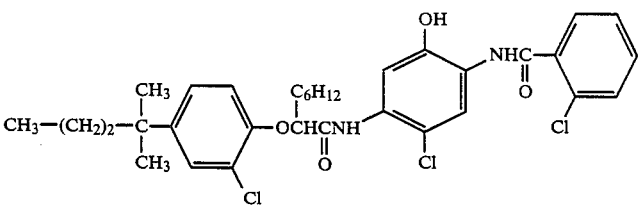
C-62
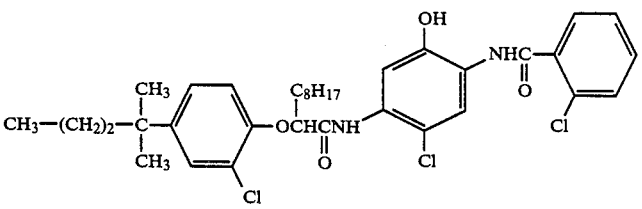
C-63
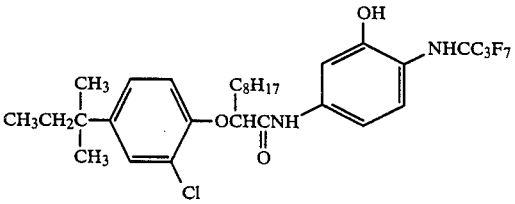

-continued
[Exemplified Compounds]
C-64
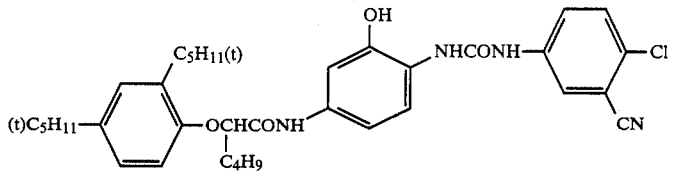
C-65
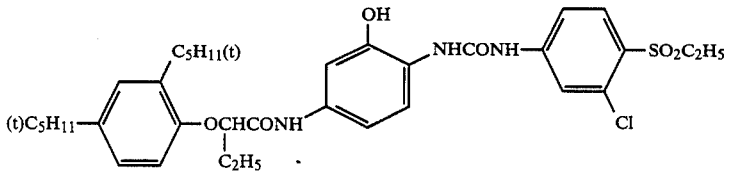
C-66
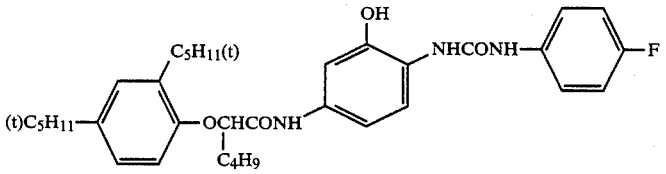
C-67
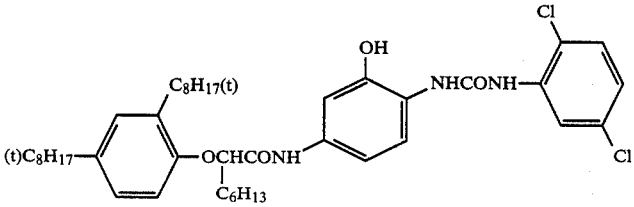
C-68
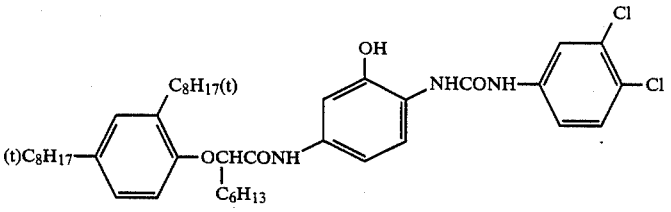
C-69
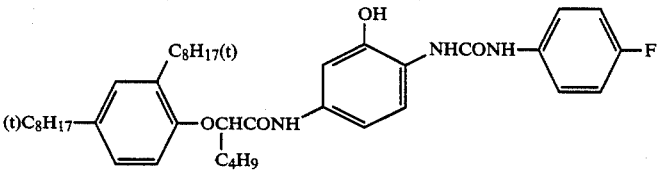
C-70
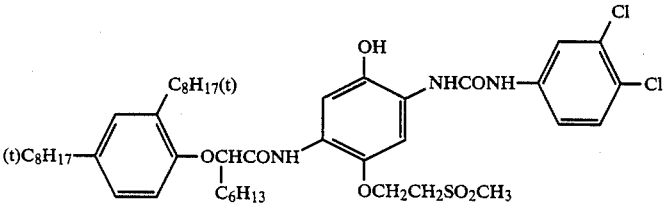

-continued
[Exemplified Compounds]
C-71
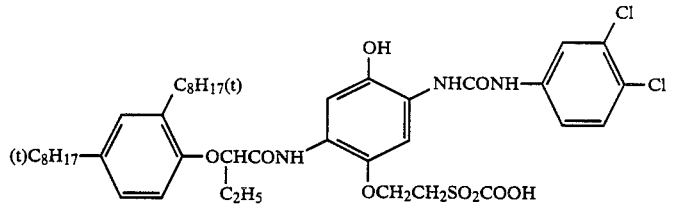
C-72
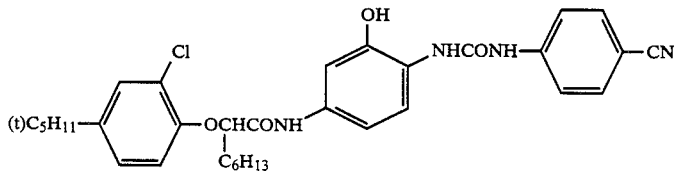
C-73
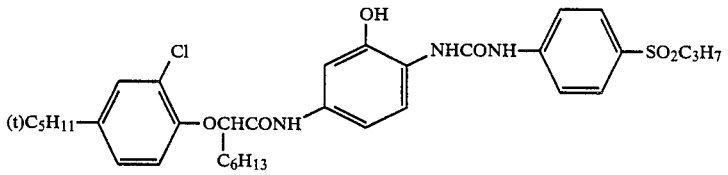
C-74
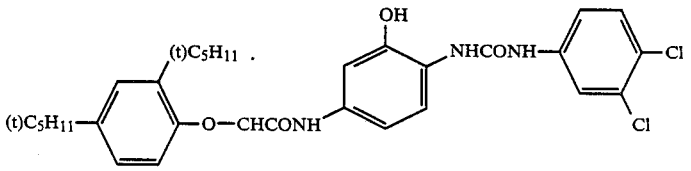
C-75
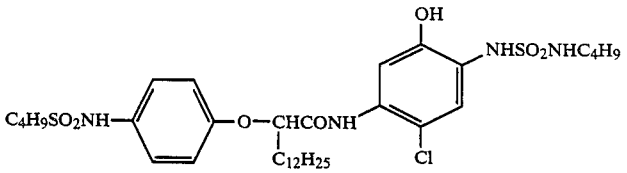
C-76
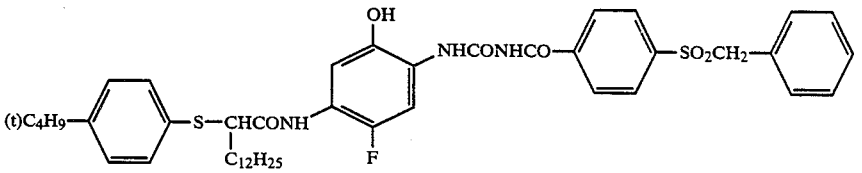
C-77
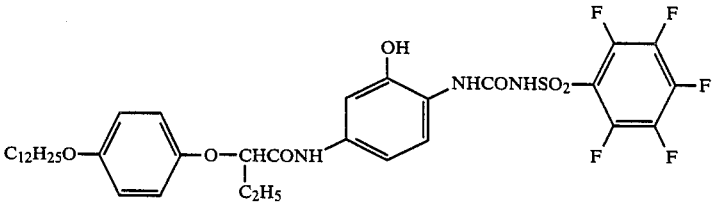

-continued
[Exemplified Compounds]
C-78
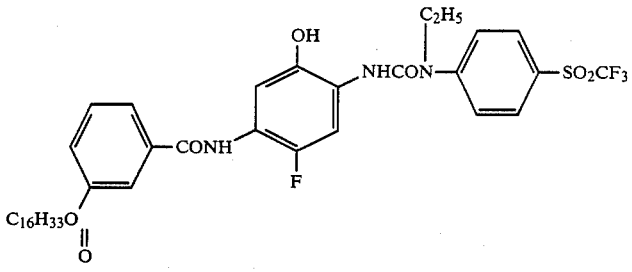
C-79
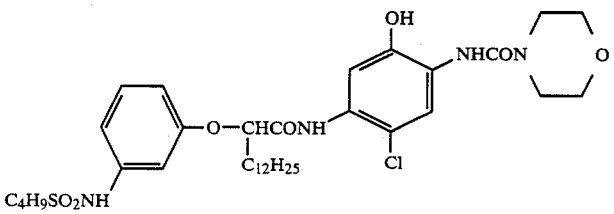
C-80
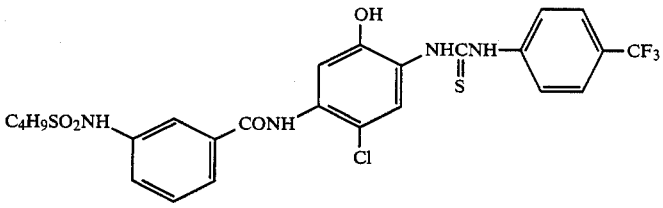
C-81
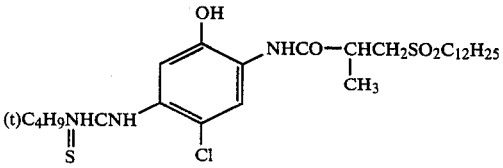
C-82
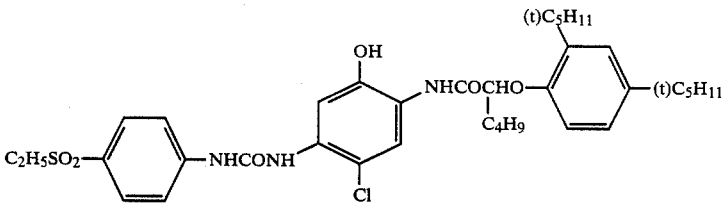
C-83
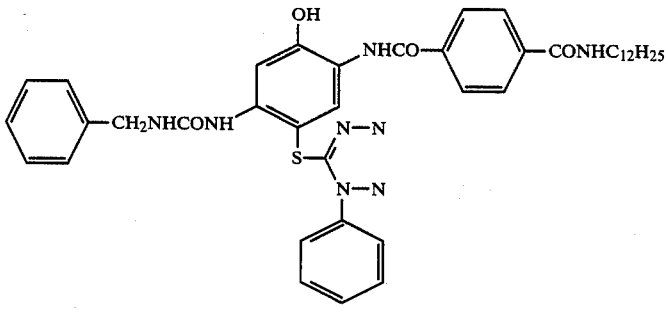
C-84
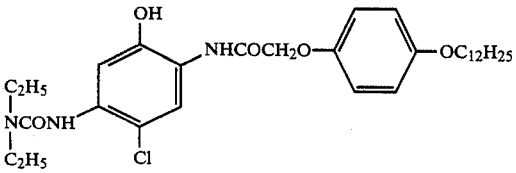

-continued
[Exemplified Compounds]
C-85
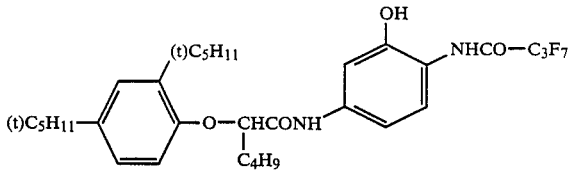
C-86
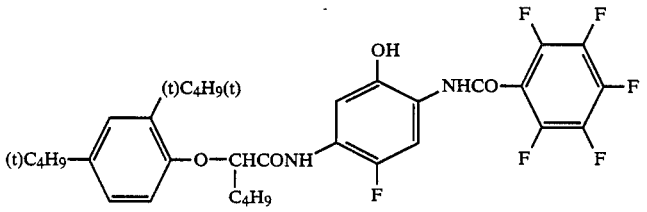
C-87
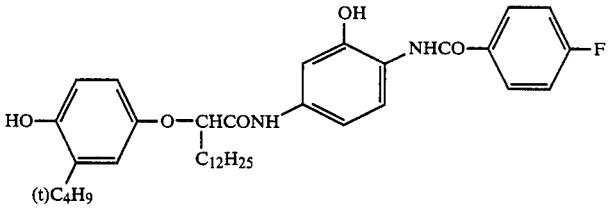
C-88
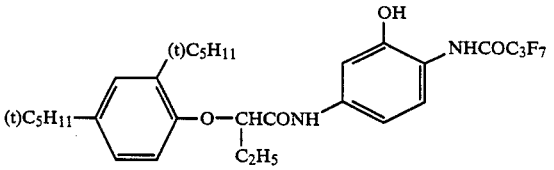
C-89
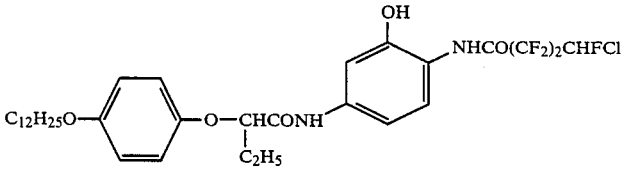
C-90
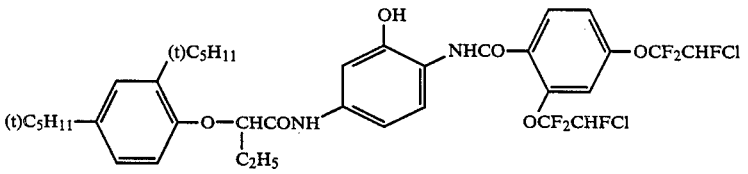
C-91
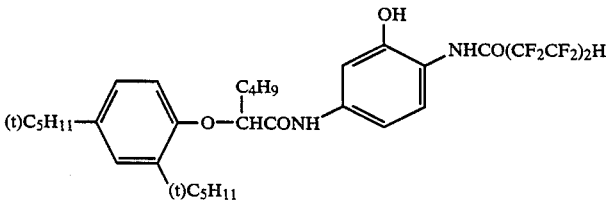
C-92
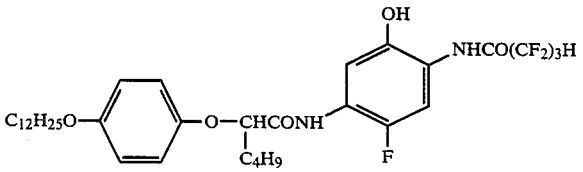

-continued
[Exemplified Compounds]
C-93
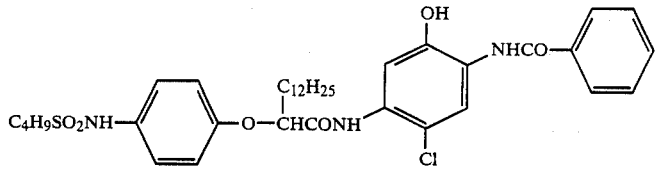
C-94
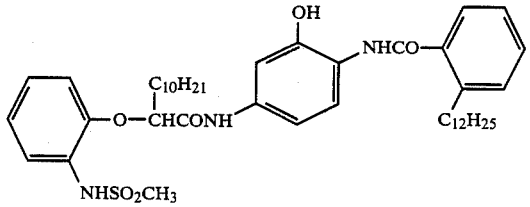
C-95
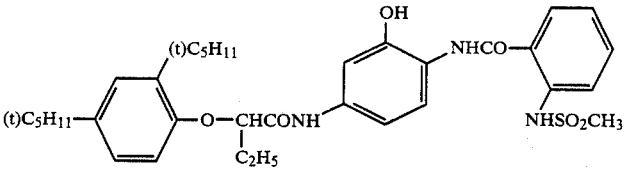
C-96
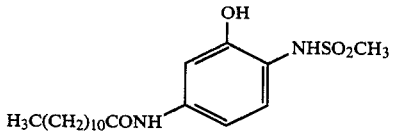
C-97
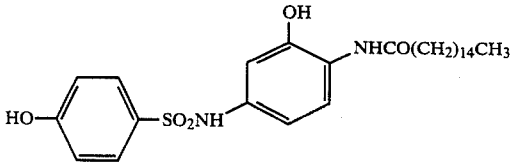
C-98
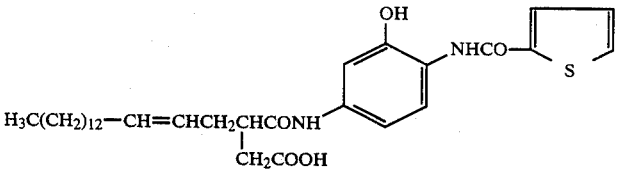
C-99
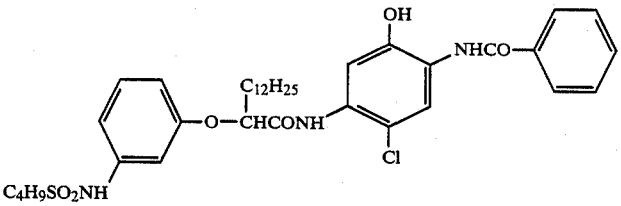
C-100
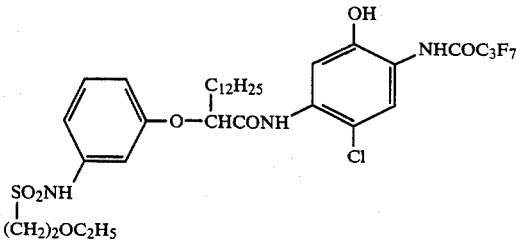

-continued
[Exemplified Compounds]
C-101
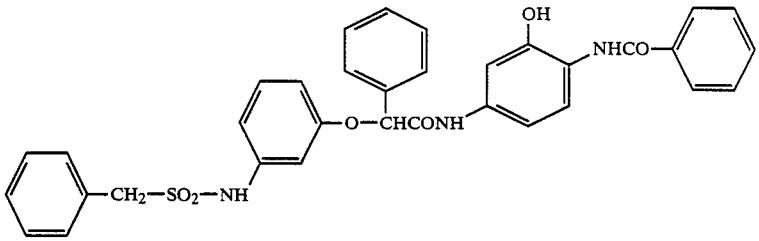
C-102
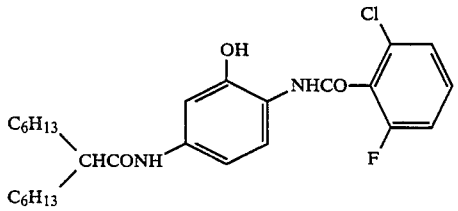
C-103
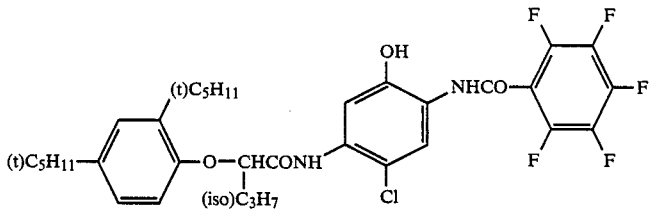
C-104
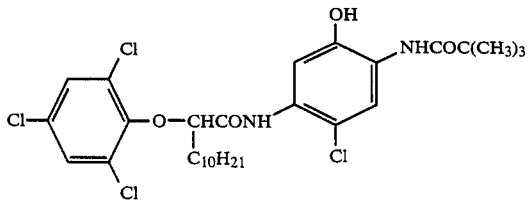
C-105
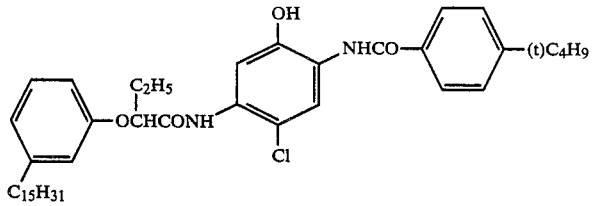
C-106
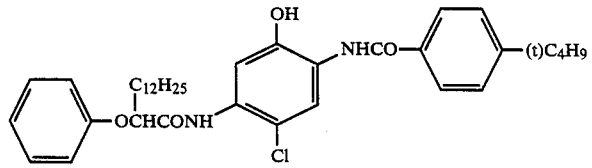
C-107
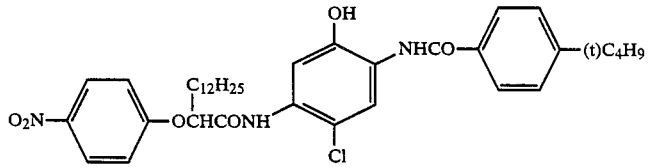

-continued
[Exemplified Compounds]
C-108
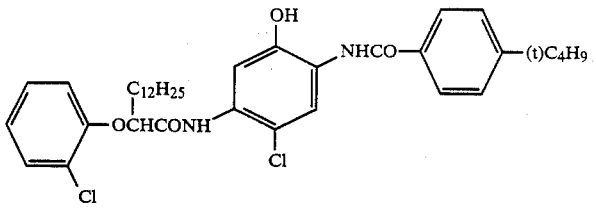
C-109
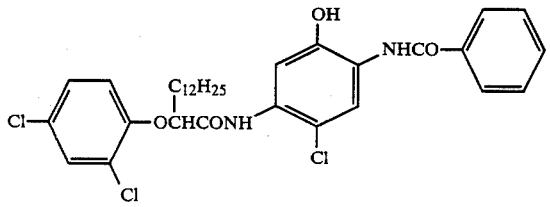
C-110
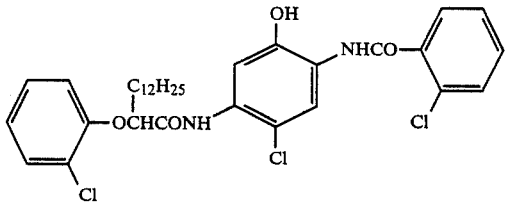
C-111
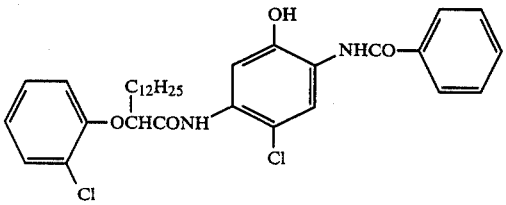
C-112
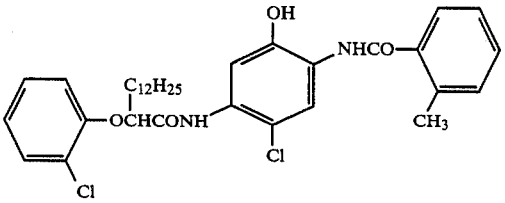
C-113
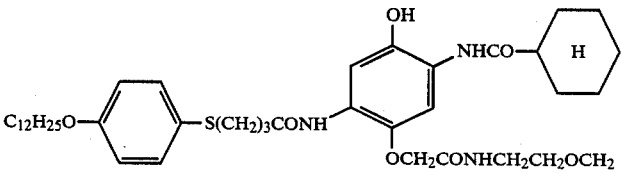
C-114
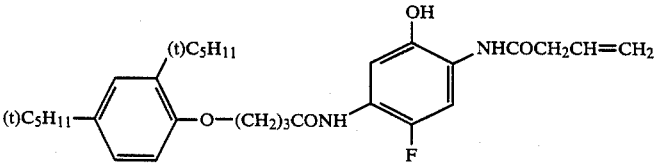

-continued
[Exemplified Compounds]
C-115
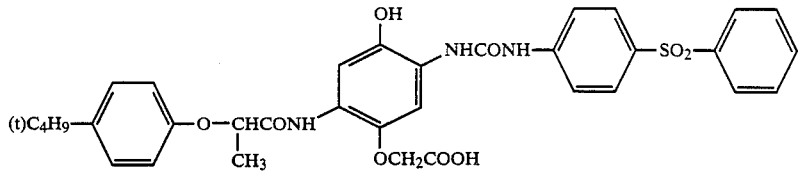
C-116
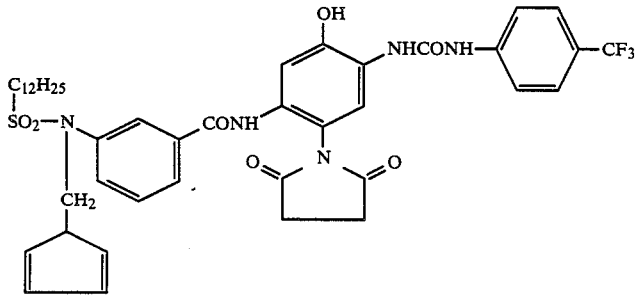
C-117
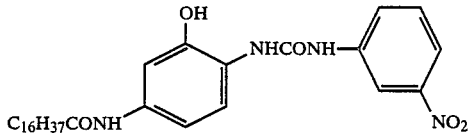
C-118
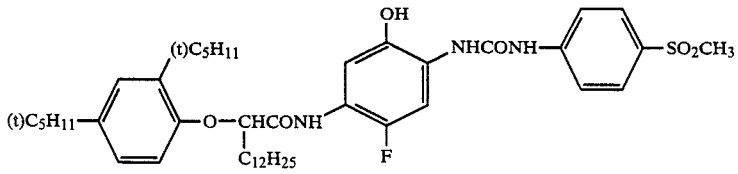
C-119
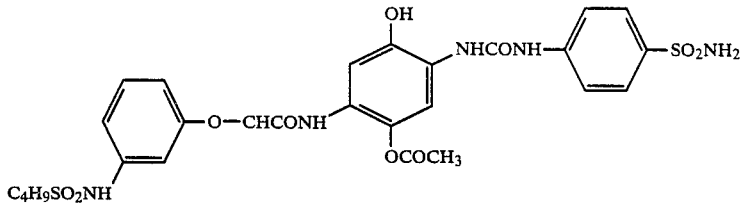
C-120
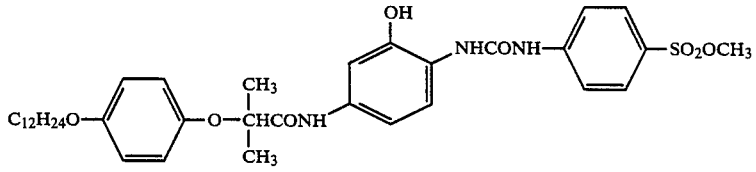
C-121
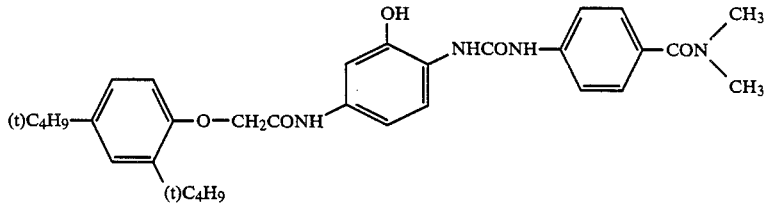

-continued
[Exemplified Compounds]
C-122
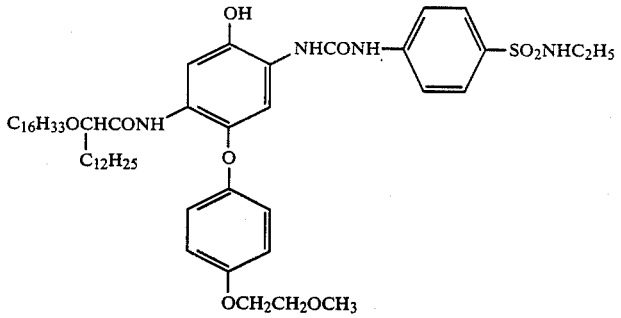
C-123
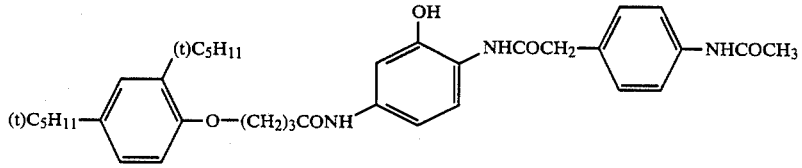
C-124
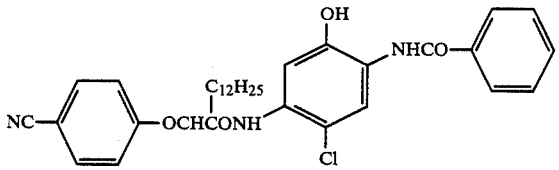
C-125
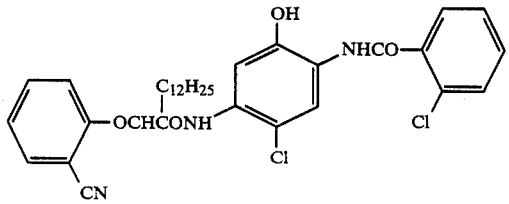
C-126
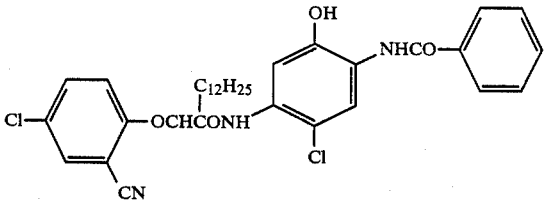
C-127
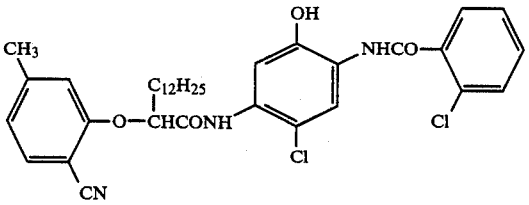
C-128
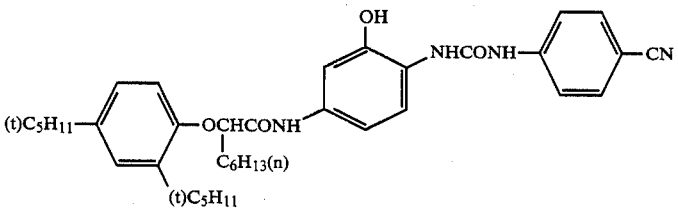

The above-given cyan couplers can be prepared in any well-known processes described in, for example, U.S. Pat. Nos. 2,772,162, 3,758,308, 3,880,661, 4,124,396 and 3,222,176; British Pat. Nos. 975,773, 8,011,693 and 8,011,694; Japanese Patent O.P.I. Publication Nos. 21139/1972, 112038/1975, 163537/1980, 29235/1981, 99341/1980, 116030/1981, 69329/1977, 55945/1981, 80045/1981 and 134644/1975; and, besides the above, British Pat. Nos. 1,011,940; U.S. Pat. Nos. 3,446,622 and 33,996,253; Japanese Patent O.P.I. Publication Nos. 65134/1981, 204543/1982, 204544/1982 and 204545/1982; Japanese Patent Application Nos. 131312/1981, 131313/1981, 131314/1981, 131309/1981, 131311/1981, 149791/1982 and 130459/1981; and Japanese Patent O.P.I. Publication Nos. 146050/1984, 166956/1984, 24547/1985, 35731/1985, 37557/1985 and 55340/1985; and the like.

In the invention, the cyan couplers represented by the Formula [I], [II] or [III] may be used in combination with the other cyan couplers, and may also be used in combination with those represented by the Formula [C-I], [C-II] or [C-III].

When a silver halide emulsion layer will contain the cyan couplers each represented by the Formulas [C-I] through [C-III], an amount of the cyan couplers to be used is normally within the range of from about 0.005 to 2 mol per mol of the silver halide to be used and, more preferably, from 0.01 to 1 mol.

Aromatic primary amine color developing agents used for color developer and for replenisher for color development include what are widely known and widely used in various processes of color photography. These developing agents include aminophenol type derivatives and p-phenylenediamine type derivatives. These compounds are generally used in the form of a salt such as, for example, hydrochloride or sulfate because of its stability rather than in the form of a free state. Further, these compounds are used in the range of concentration from about 0.1 g to about 30 g per l of color developer usually and in the range from about 1 g to about 1.5 g per l of color developer preferably.

Aminophenol type developing agents include, for example, o-aminophenol, p-aminophenol, 5-amino-2-oxytoluene, 2-amino-3-oxytoluene, 2-oxy-3-amino-1 and 4-dimethylbenzene.

Primary aromatic amino type color developing agents which are especially useful are N,N'-dialkyl-p-phenylenediamine type compounds and an alkyl group and a phenyl group thereof may be substituted with any substituent. Among those compounds, N,N'-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-$\beta$-methanesulfonamideethyl-3-methyl-4-aminoaniline hydrochloride, N-ethyl-N-$\beta$-hydroxyethylaniline, 4-amino-3-methyl-N,N'-diethylaniline and 4-amino-N-(2-methoxyethyl)-N-ethyl-3-methylaniline-p-toluenesulfonate are given as a particularly useful compound.

A color developer used for the processing in the invention can include, in addition to aforesaid primary aromatic amine type color developing agents, various types of ingredients generally added to a color developer such as, for example, alkali agents of sodium hydroxide, sodium carbonate and potassium carbonate, alkali metal sulfite, alkali metal bisulfite, alkali metal thiocyanate, alkali metal halide, benzyl alcohol, 1-phenyl-3-pyrazolidone, Metol and hydroquinone black and white developing agent, water-softening agent and concentrating agent and in the present invention, chelating agents represented by following general formulae [XII], [XIII] and [XIV] are preferably used for achieving further effects of the invention.

General formula [XII] A-COOM

General formula [XIII] B-$PO_3M_2$

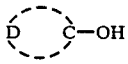

General formula [XIV]

A and B in the formulae represent respectively a monovalent group or atom and they may be either an inorganic substance or an organic one. D represents a group of non-metal atoms necessary for forming an aromatic ring or a heterocyclic ring both of which may have a substituent and M represents a hydrogen atom or an alkali metal atom and m is an interger from 3 to 6.

The chelating agents represented by aforesaid general formula [XII], [XIII] and [XIV] are used in the invention, and the preferable ones for the invention are the compounds represented by any one of following general formulae [XV]-[XXVI].

General formula [XV] $M_mP_mO_{3m}$

General formula [XVI] $M_{n+2}P_nO_{3n+1}$

General formula [XVII] $A_1$—$R_1$—Z—$R_2$—COOH

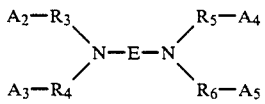

General formula [XVIII]

E in the formula represents substituted or unsubstituted alkylene group, cycloalkylene group, phenylene group, —$R_7$—$OR_7$—, —$R_7$—$OR_7OR_7$— and —$R_7$Z-$R_7$—, Z represents >N—$R_7$—$A_6$ and >N—$A_6$, $R_1$-$R_7$ represents substituted or unsubstituted alkylene group, $A_1$-$A_6$ represent hydrogen, —OH, —COOM, —$PO_3M_2$, M represents hydrogen and an alkali metal atom, m represents integers of 3-6 and n represents integers of 2-20.

General formula [XIX] $R_8N(CH_2PO_3M_2)_2$

In the formula, $R_8$ represents a lower alkyl group, an aryl group, an aralkyl group and a nitrogen-containing 6-member ring group [—OH, —OR, —COOM as a substituent] and M represents a hydrogen atom and an alkali metal atom.

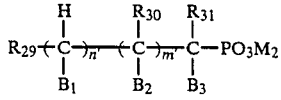

General formula [XX]

In the formula, $R_{29}$-$R_{31}$ represent a hydrogen atom, —OH, lower alkyl (—OH, —COOM, —$PO_3M_2$ as an unsubstituted group or a substituent), $B_1$–$B_3$ represent a hydrogen atom, —OH, —COOM, —$PO_3M_2$ and —$Nj_2$, J represents a hydrogen atom, lower alkyl, $C_2H_4OH$ and —$PO_3M_2$, M represents a hydrogen atom and alkali metal and n' and m' represent 0 or 1.

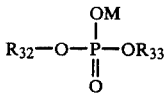

General formula [XXI]

$R_{32}$ and $R_{33}$ in the formula represent a hydrogen atom, alkali metal, alkyl groups having $C_1$–$C_{12}$, an alkenyl group and a cyclic alkyl group.

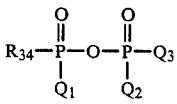

General formula [XXII]

In the formula, $R_{34}$ represents alkyl groups having $C_{1-12}$, alkoxy groups having $C_{1-12}$, monoalkylamino groups having $C_{1-12}$, dialkylamino groups having $C_{2-12}$, an amino group, allyloxy groups having $C_{1-24}$, arylamino groups having $C_{6-24}$ and an amyloxy group and $Q_1$–$Q_3$ represent —OH, alkoxy groups having $C_{1-24}$, an aralkyloxy group, an allyloxy group, —OM' (M' represents cation), an amino group, a morpholino group, a cyclic amino group, an alkylamino group, a dialkylamino group, an arylamino group and an alkyloxy group.

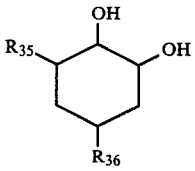

General formula [XXIII]

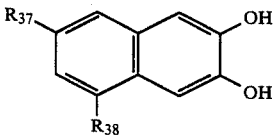

General formula [XXIV]

In the formula, $R_{35}$, $R_{36}$, $R_{37}$ and $R_{38}$ respectively represent a hydrogen atom, a halogen atom, a sulfonic acid group, substituted or unsubstituted alkyl groups having 1–7 carbon atoms, —$OR_{39}$, —$COOR_{40}$,

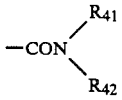

or a substituted or unsubstituted phenyl group. $R_{39}$, $R_{40}$, $R_{41}$ and $R_{42}$ respectively represent a hydrogen atom or alkyl groups having 1–18 carbon atoms.

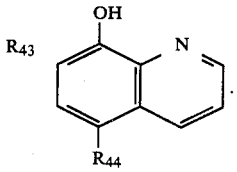

General formula [XXV]

In the formula, $R_{43}$ and $R_{44}$ represent a hydrogen atom, a halogen atom and a sulfonic acid group.

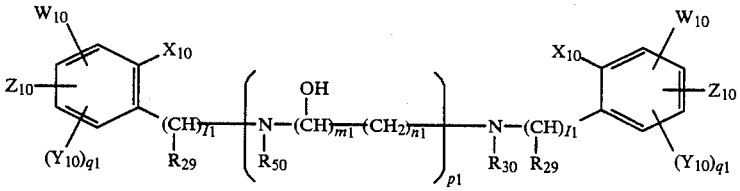

General formula [XXVI]

In the formula, $R_{29}$ and $R_{30}$ respectively represent a hydrogen atom, a phosphoric acid group, a carboxylic acid group, —$CH_2COOH$, —$CH_2PO_3H_2$ or a salt thereof; while $X_{10}$ represents a hydroxyl group or the salts thereof, and $W_{10}$, $Z_{10}$ and $Y_{10}$ respectively represent a hydrogen atom, a halogen atom, a hydroxyl group, a cyano group, a carboxylic acid group, a phosphoric acid group, a sulfonic acid group or a salt thereof, an alkoxy group or an alkyl group. On the other hand, $m_1$ represents an integer of 0 or 1, $n_1$ represents integers 1–4, $I_1$ represents 1 or 2, $p_1$ represents integers 0–3 and $q_1$ represents integers 0–2.

Actual examples of chelating agents represented by aforesaid general formulae [XV]–[XXVI] are given as follows.

[exemplified chelating agents]

| | | | |
|---|---|---|---|
| $Na_4P_4O_{12}$ | (1) | $Na_3P_3O_9$ | (2) |
| $H_4P_2O_7$ | (3) | $H_5P_3O_{10}$ | (4) |
| $Na_6P_4O_{13}$ | (5) | 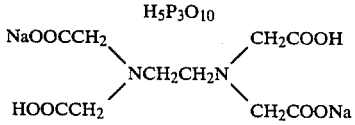 | (6) |

-continued
[exemplified chelating agents]
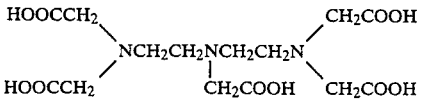
(7)
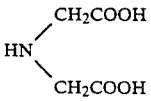
(8)
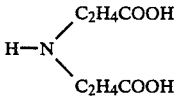
(9)
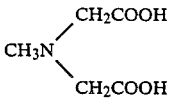
(10)
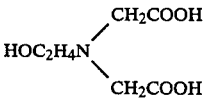
(11)
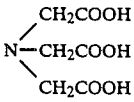
(12)
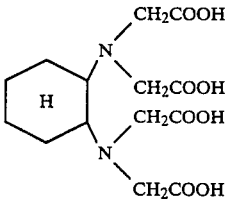
(13)
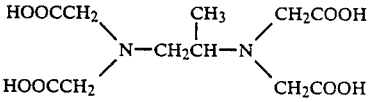
(14)
$(HOC_2H_4)_2NCH_2COOH$ (15)
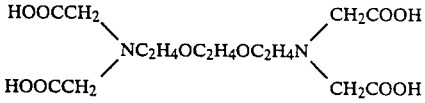
(16)
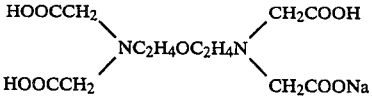
(17)
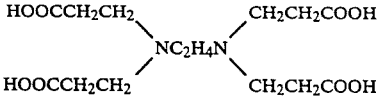
(18)
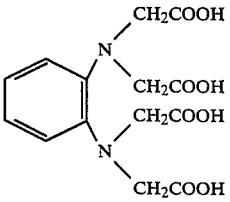
(19)
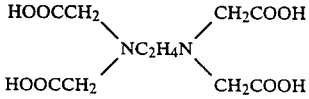
(20)
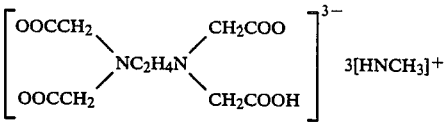
(21)
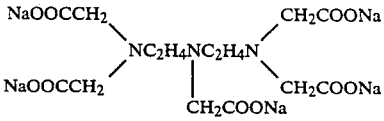
(22)
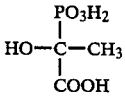
(23)
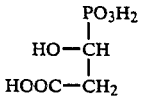
(24)
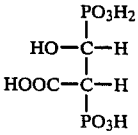
(25)
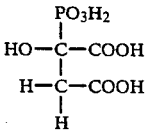
(26)
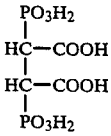
(27)
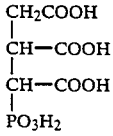
(28)

-continued
[exemplified chelating agents]
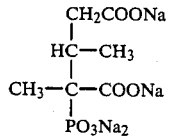
(29)
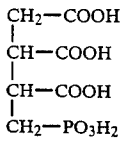
(30)
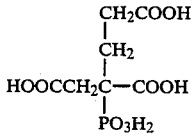
(31)
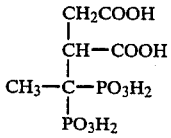
(32)
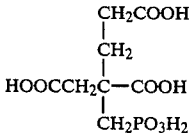
(33)
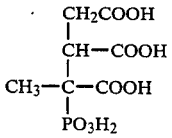
(34)
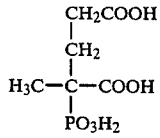
(35)
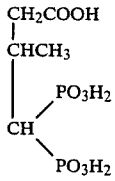
(36)
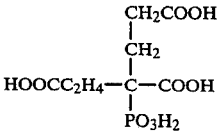
(37)
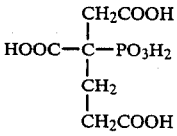
(38)
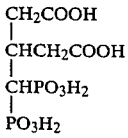
(39)
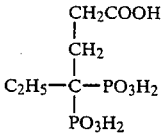
(40)
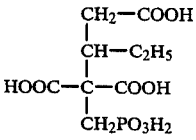
(41)
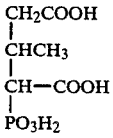
(42)
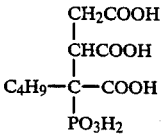
(43)
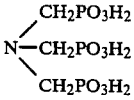
(44)
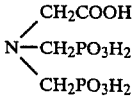
(45)
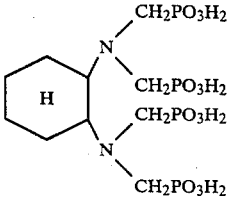
(46)

-continued
[exemplified chelating agents]
(47)
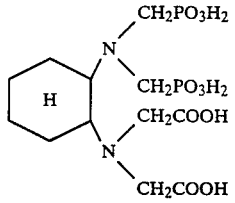
(48)
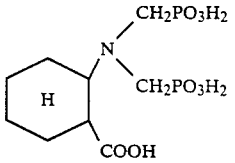
(49)
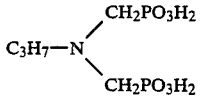
(50)
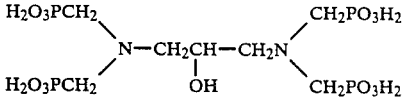
(51)
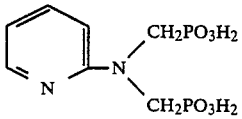
(52)
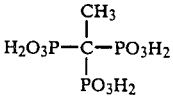
(52')
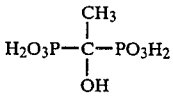
(53)
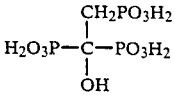
(54)
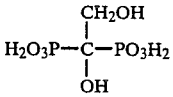
(55)
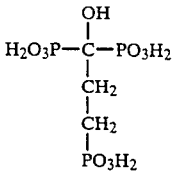
(56)
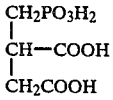
(57)
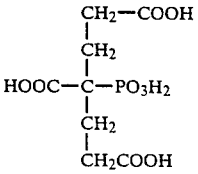
(58)
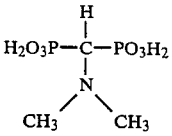
(59)
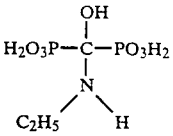
(60)
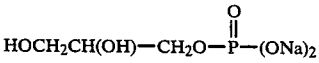
(61)
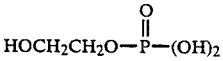
(62)
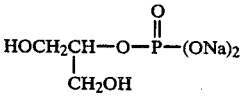
(63)
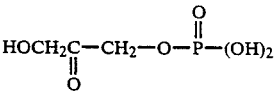
(64)
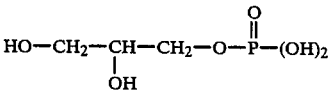
(65)
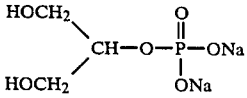
(66)
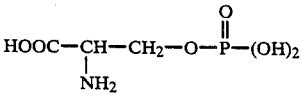
(67)
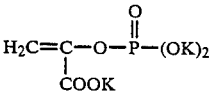
(68)
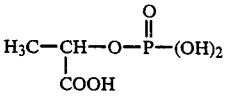
(69)
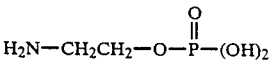

-continued
[exemplified chelating agents]
(70)
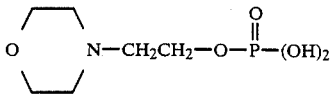
(71)
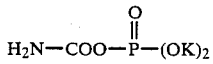
(72)
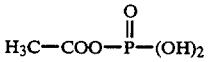
(73)
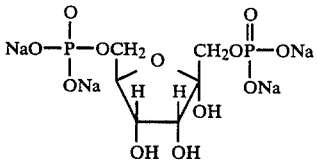
(74)
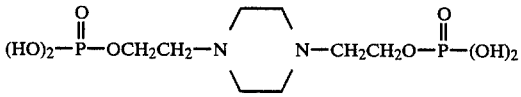
(75)
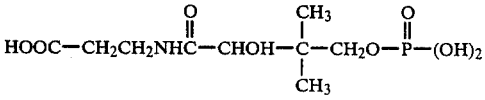
(76)
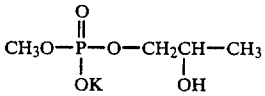
(77)
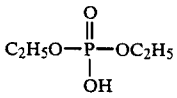
(78)
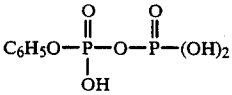
(79)
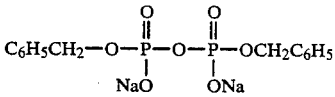
(80)
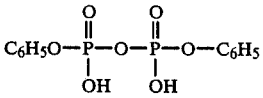
(81)
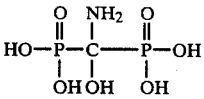
(82)
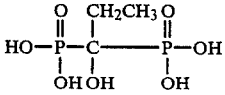
(83)
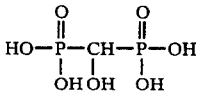
(84)
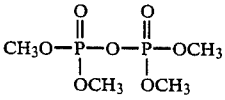
(85)
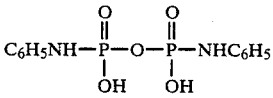
(86)
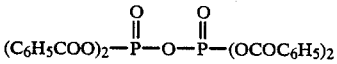
(87)
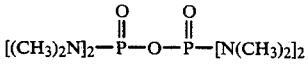
(88)
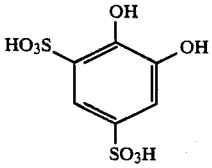
(89)
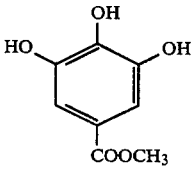
(90)
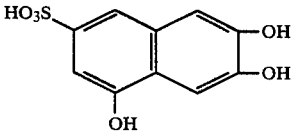
(91)
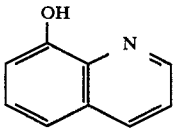
(92)
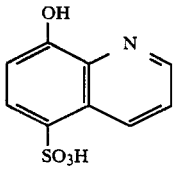
(93)
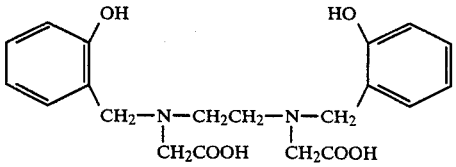

-continued

[exemplified chelating agents]

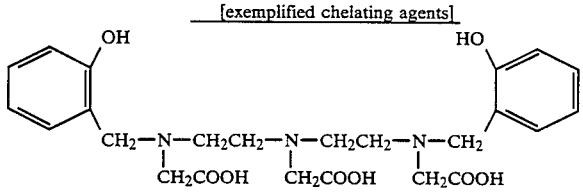
(94)

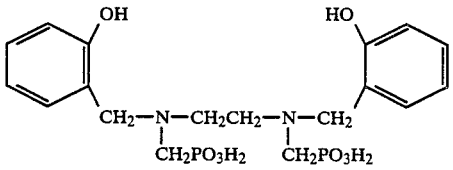
(95)

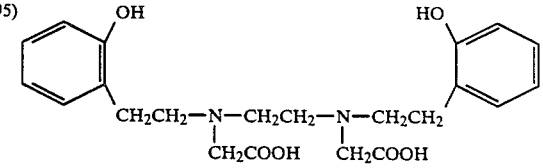
(96)

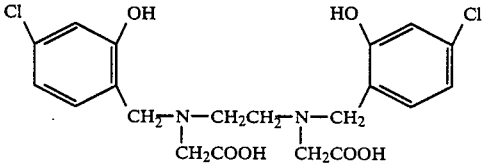
(97)

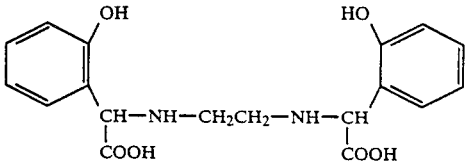
(98)

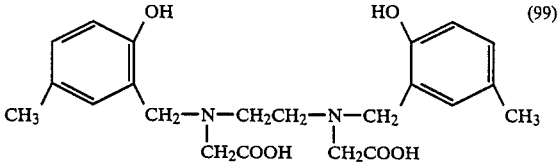
(99)

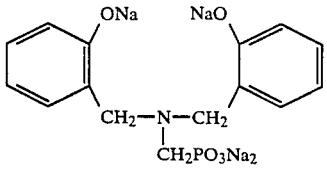
(100)

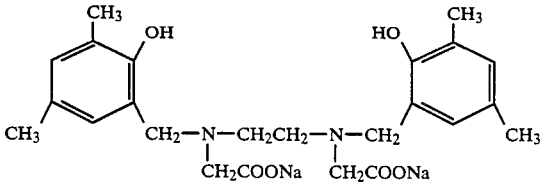
(101)

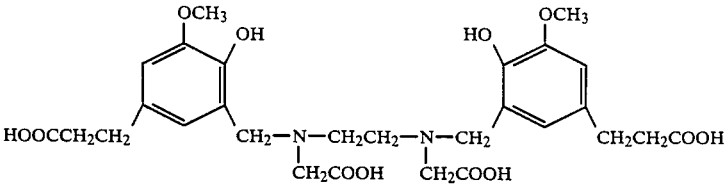
(102)

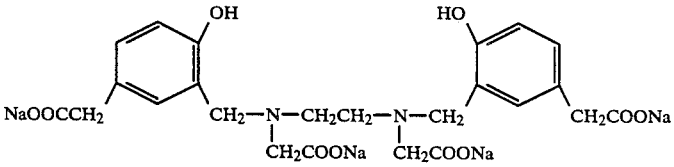
(103)

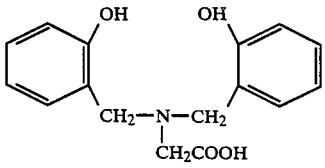
(104)

In the invention, it is advantageous to use chelating agents represented by general formulae [XV], [XVI], [XVII], [XVIII], [XVIX], [XX], [XXI] and [XXVI].

Chelating agents which are represented by any of aforesaid general formulae [XI]-[XIII] and used in the invention may be added within the range from $1\times10^{-4}$ mol to 1 mol of chelating agent per l of a developer used and within the preferable range from $2\times10^{-4}$ mol to $1\times10^{-1}$ mol and further preferable range from $5\times10^{-4}$ mol to $5\times10^{-2}$ mol per l of developer.

A pH value of the color developer is usually 7 or more and it is most generally about 10 to about 13.

In the present invention, after the processing of color development, a processing solution having a fixing capability is used for the processing and when the processing solution having a fixing capability is a fixer, the bleaching process is carried out before the processing with the fixer. As a bleaching agent used for a bleaching solution or a bleach-fix solution, metal complex of organic acid is used and aforesaid metal complex has a function for changing metal silver produced through the development to silver halide by oxidizing aforesaid metal silver and for causing concurrently the uncolored portion of the color forming agent to be colored. The structure of the metal complex is represented by an organic acid such as amino polycarboxylic acid, oxalic acid or citric acid, wherein a metal ion such as that of iron, cobalt or copper is coordinated. As the most preferable organic acid to be used for forming metal complex of aforesaid organic acid, polycarboxylic acid or amino carboxylic acid is given. Such polycarboxylic acid or amino polycarboxylic acid may also be alkali metallic salt, ammonium salt or water-soluble amine salt.

Concrete and typical examples of the foregoing are given as follows.

[1] ethylenediaminetetraacetic acid
[2] diethylenetriaminepentaacetic acid
[3] ethylenediamine-N-(β-oxyethyl)-N,N',N'-triacetic acid
[4] propylenediaminetetraacetic acid
[5] nitrilotriacetic acid
[6] cyclohexandiaminetetraacetic acid
[7] iminodiacetic acid
[8] dihydroxyethylglycinecitric acid (or tartaric acid)
[9] ethyletherdiaminetetraacetic acid
[10] glycoletheraminetetraacetic acid
[11] ethylenediaminetetrapropionic acid
[12] phenylenediaminetetraacetic acid
[13] ethylenediaminetetraacetic acid disodium salt
[14] ethylenediaminetetraacetic acid tetra(trimethylammonium) salt
[15] ethylenediaminetetraacetic acid tetrasodium salt
[16] diethylenetriaminepentaacetic acid pentasodium salt
[17] ethylenediamine-N-(β-oxyethyl)-N,N',N'-triacetic acid sodium salt
[18] propylenediaminetetraacetic acid sodium salt
[19] nitrilotriacetic acid sodium salt
[20] cyclohexanediaminetetraacetic acid sodium salt A bleaching solution to be used may contain metal complex of aforesaid organic acid as a bleaching agent and contain various types of additives. As an additive, it is preferable that alkali halide or ammonium halide such as, for example, rehalogenating agent like potassium bromide, sodium bromide, sodium chloride and ammonium bromide as well as metallic salts and chelating agents are contained in particular. It is further possible to add, according to circumstances, pH buffering agents such as borate, oxalate, acetate, carbonate, phosphate or the like and alkylamines, polyethyleneoxides and others which are known to be added generally to a bleaching solution.

Further, a fixer and a bleach-fix solution may contain one kind or two or more kinds of pH buffering agents composed of sulfite such as ammonium sulfite, potassium sulfite, sodium bisulfite, ammonium metabisulfite, potassium metabisulfite, sodium metabisulfite and others and of various kinds of salts such as boric acid, borax, sodium hydroxide, potassium hydroxide, sodium carbonate, potassium carbonate, sodium bicarbonate, potassium bicarbonate, acetic acid, sodium acetate, ammonium hydroxide and others.

When processing while replenishing a bleach-fix replenisher to the bleach-fix solution (bath), either the case where the bleach-fix solution (bath) contains thiosulfate, thiocyanate or sulfite or the case where the bleach-fix replenisher contains aforesaid salts and is replenished to the processing path is allowed.

As for a bleaching solution in the invention, air or oxygen is allowed to be blown in the bleach-fix bath and in the storage tank for bleach-fix replenisher at need for enhancing the activity of a bleach-fix solution, or proper oxidizing agents such as, for example, hydrogen peroxide, bromate, persulfate or the like may be added according to circumstances.

In the processing of the invention, the silver recovery may be carried out from processing solution containing soluble silver complex salts such as a fixer and a bleach-fix solution as well as the washing water or a stabilizer of the substitute for washing. For example, an electrolysis method (French Pat. No. 2,299,667), a precipitation method (Japanese Patent O.P.I. Publication No. 73037/1977, West German Pat. No. 2,331,220), an ion exchange method (Japanese Patent O.P.I. Publication No. 17114/1976 and West German Pat. No. 2,548,237) and a metal substitution method (British Pat. No. 1,353,805) are utilized effectively.

After the bleaching process and fixing process (or bleach-fix process) following the color developing process in the invention, either the case wherein no washing is conducted and the substitutive process for washing is carried out or the case wherein washing is conducted and then the substitutive stabilizing process for washing is carried out is allowed. In addition to the aforesaid processes, known auxiliary processes such as the processes for hardening, neutralizing, black and white developing, reversal and washing with a small quantity of water may be added at need. Typical concrete examples of preferable processing method include the following processes.

(1) color development→bleach-fix→washing
(2) color developing→bleach-fix→washing with a small quantity of water→washing
(3) color development→bleach-fix→washing→substitutive process for washing
(4) color development→bleach-fix→substitutive process for washing
(5) color development→bleach-fix→substitutive process for washing→stabilizing
(6) color development→washing (or substitutive process for washing)→bleach-fix→washing (or substitutive process for washing)
(7) color development→stop→bleach-fix→washing (or substitutive process for washing)
(8) color development→bleaching→washing→fixing→washing→stabilizing
(9) color development→bleaching→fixing→washing→stabilizing

(10) color development→bleaching→fixing→substitutive process for washing→stabilizing
(11) color development→bleaching→washing with a small quantity of water→fixing→washing with a small quantity of water→washing→stabilizing
(12) color development→washing with a small quantity of water→bleaching→washing with a small quantity of water→fixing→washing with a small quantity of water→washing→stabilizing
(13) color development→stop→bleaching→washing with a small quantity of water→fixing→washing with a small quantity of water→washing→stabilizing
(14) black and white development→washing (or substitutive process for washing)→reversal process→color development→bleaching→fixing→washing (or omission)→stabilizing
(15) pre-hardening→neutralizing→black and white development→stop→color development→bleaching→fixing→washing (or omission)→stabilizing A core/shell emulsion used for the invention is described in detail in Japanese Patent O.P.I. Publication No. 154232/1982. In the invention, it is satisfactory that a core/shell emulsion contains 3 mol % or more of silver iodide and in the preferable color photographic material, the composition of a core in terms of silver halide is that the silver halide contains 0.1–20 mol %, preferably 0.5–10 mol % of silver iodide and a shell consists of silver bromide, silver chloride, silver iodobromide, silver chlorobromide or the mixture of the foregoing.

What is preferable in particular is that a shell is a silver halide emulsion consisting of silver bromide or silver iodobromide. Further, in the invention, a preferable effect may be achieved when a core is a monodispersed silver halide grain and the thickness of a shell is 0.01–0.5 μm.

A silver halide color photographic material of the invention is characterized in that it consists of silver halide grains containing 3 mol % of silver iodide and silver halide grains containing silver iodide are used especially as a core thereof and the nature toward the high sensitivity of silver halide grains containing silver iodide is put to practical use by covering the core of a silver halide grain consisting of silver bromide, silver chloride, silver chlorobromide, silver iodobromide or the mixture of the foregoing using the shell having aforesaid specific thickness and further the process variation is improved by hiding the disadvantageous nature of aforesaid grains. More particularly, a core of silver halide containing silver iodide is given a shell having the strictly regulated range of its thickness necessary for bringing out effectively only the preferable nature of the core and for hiding the unpreferable behavior of the core. The method for covering with a shell having the absolute thickness that is necessary and minimum for bringing out effectively the nature owned by the core may also be utilized extensively for the purposes of improving the process variation, the life or the spectral sensitizer-absorbing property by changing the purpose, namely changing the material of the shell, which is advantageous to a great extent.

A silver iodide content in a matrix of silver halide grain (core) ranges from the solid solution of 0.1–20 mol % to the mixed crystal and it preferably is within the range from 0.5 mol % to 10 mol %. The distribution in the core of silver iodide contained may either be an omnipresent state or a uniform state and the uniform distribution is preferable.

A silver halide emulsion of the invention containing a silver halide grain having a shell with a specific thickness may be manufactured by covering with aforesaid shell the core of silver halide grain contained in a monodispersed emulsion. Incidentally, it is preferable that the ratio of silver iodide to silver bromide in the case that a shell is silver iodobromide is 10 mol % and less.

When causing a core to be a monodispersed silver halide grain, it is possible to obtain a grain having the desired size through a double-jet method wherein the pAg is kept constant. Further, for manufacturing a silver halide emulsion having a high-level monodispersibility, it is possible to use the method disclosed in Japanese Patent O.P.I. Publication No. 48521/1979. The preferable embodiment among aforesaid methods is to manufacture, by adding potassium iodobromide-gelatin solution and ammoniacal silver nitrate solution into gelatin solution containing silver halide seed grains through the adding method wherein the adding speed changes as a function of time. In this case, it is possible to obtain a silver halide emulsion having a high-level dispersibility by selecting properly the function of time for adding speed, pH, pAg, temperature or the like.

A monodispersed core/shell emulsion in the invention is preferably used and monodispersed silver halide grains mean silver halide grains wherein the weight of silver halide whose grain size is within the range of ±20% of the average grain size $\bar{r}$ that is centered is 60% or more of the weight of total silver halide grains. Aforesaid average grain size $\bar{r}$ is defined as the grain size $r_i$ (valid figures, 3 digits) under the condition that the product of frequency $n_i$ of the grain having the grain size $r_i$ multiplied by $r_i^3$ is maximum.

The grain size mentioned here is a diameter of a silver halide grain when the silver halide grain is spherical, while, when it is of a shape other than a spherical shape, the grain size is a diameter of a circle image converted from the projected image of the grain and having the same area as that of projected image. The grain size is obtained by photographing the grain through an electron microscope with a magnification of 10,000 times to 50,000 times and by measuring the grain diameter or the area of a projected image on the print. The number of grains to be measured is 1000 or more selected through the random sampling.

A monodispersed silver halide emulsion used in the invention gives an effect that the density variation in the high density portion is made smaller compared with a polydisperse emulsion, which is a preferable embodiment in the working of the invention.

As for the thickness of a shell that covers a core, it is required to be the thickness which does not hide the preferable nature of the core and does hide the unpreferable nature thereof. Namely, the thickness is limited to a narrow range between the upper limit and the lower one. Such shell may be formed in a way wherein soluble halide solution and soluble silver salt solution are treated through a double-jet method to be deposited in a form of a monodispersed core.

For example, in the experiment wherein monodispersed silver halide grains having an average grain size of 1 μm and containing silver iodide of 3 mol % in the core were used and the covering thickness of 0.2 mol % silver iodobromide which is a shell was changed variously, when the shell having the thickness of 0.85 μm was prepared, the covering power of monodispersed silver halide grains in the aforesaid method was too low to be put to practical use. This was treated in the processing bath containing a solvent capable of dissolving silver halide and having a physical development property and then was observed under a scanning type electron microscope which proved that no filament of developed silver appeared. This suggests that the optical density is lowered and the covering power is further lowered. Therefore, it was tried, taking the form of a filament of developed silver into consideration, that the thickness of a shell of silver bromide on the surface was gradually thinned while changing the average grain size of a core. As the result of aforesaid trial, it was found that many excellent filaments of developed silver were produced and thereby sufficient optical densities were obtained and nevertheless the nature of high sensitivity of the core was not deteriorated, independently of the average grain size of a core but dependently on an absolute thickness of a shell of 0.5 μm and less (preferably, 0.2 μm and less).

When the thickness of a shell is too thin, on the other hand, there are produced portions where the foundation of a core containing silver iodide is bared and thereby the effects of covering the surface with shells, namely, the effect of chemical sensitization and the property of quick development, fixing or the like are lost. It is preferable that the limit of the thickness is 0.01 μm.

When confirmed by the high monodispersed core, the preferable thickness of a core ranges from 0.01 μm to 0.06 μm and the most preferable thickness is 0.03 μm and below.

Aforesaid effects that sufficient filaments of developed silver are produced and thereby the chemical density is improved, the sensitizing effect is achieved by making the best use of the nature of a core toward the high sensitivity and the property of quick development and fixing is obtained, are caused by the shell whose thickness is regulated, as mentioned above, by the high monodispersed core and by the synergetic effect between the silver halide composition of core and shell. Provided that the regulation of shell thickness is satisfied, silver iodobromide, silver bromide, silver chloride, silver chlorobromide or the mixture thereof may be used as silver halide constituting aforesaid shell. Among them, silver bromide, silver iodobromide or the mixture thereof are preferable from the viewpoints of a congeniality with a core, process stability and process stain or of a life.

When silver halide of core and shell is produced in a form of precipitation and when grains thereof grow or after the completion of the growth, a photosensitive silver halide emulsion used in the invention may be doped with various types of metallic salts or metal complexes. For example, metallic salts or complexes of gold, platinum, palladium, iridium, rhodium, bismuth, cadmium and copper or the mixture thereof may be applied.

Further, excess halogenated compounds produced during the preparation of an emulsion of the invention or salts such as a nitrate, ammonium or the like and compounds which are produced as a secondary product or have become unnecessary may be eliminated. As an eliminating method, noodle washing method, a dialysis method or a coagulating method, all of which are commonly used for general emulsions may be used at need.

Further, various types of chemical sensitizing methods used for general emulsions may be applied to the emulsion of the invention. Namely, through chemical sensitizing agents like reduction sensitizer such as active gelatin; noble metal sensitizer such as water-soluble gold salt, water-soluble platinum salt, water-soluble palladium salt, water-soluble rhodium salt and water-soluble iridium salt; sulfur sensitizer; selenium sensitizer; polyamine and stannous chloride, it is possible to carry out the chemical sensitization using one of aforesaid chemical sensitizers or using plural chemical sensitizers mentioned above in combination. It is further possible to carry out the optical sensitization for the desired wavelength range on the silver halide. There is no restriction in particular in the optical sensitizing methods for the emulsion of the invention, and, for example, optical sensitizers such as cyan dye like zerometin dye, cyan dye like trimetin dye or merocyanine dye may be used individually or in combination thereof (e.g. strong color sensitization) for the optical sensitization. These technologies are disclosed in U.S. Pat. Nos. 2,688,545, 2,912,329, 3,397,060, 3,615,635 and 3,628,964, British Pat. Nos. 1,195,302, 1,242,588 and 1,293,862, West German OLS Pat. Nos. 2,030,326 and 2,121,780 and Japanese Patent Examined Publication Nos. 4936/1968 and 14030/1969. The selection may freely be made from aforesaid technologies according to the purpose and application for the photosensitive material, such as the wavelength range to be sensitized, the sensitivity and others.

As for the silver halide emulsion to be used in the invention, a monodispersed silver halide emulsion wherein shells are mostly uniform in thickness is obtained by using the silver halide emulsion in which core particles are represented by monodispersed silver halide grains and by coating aforesaid core particle with a shell, when forming silver halide grains to be further contained. Such monodispersed silver halide emulsion may be used either without changing its grain size distribution or with blending, for obtaining desired gradient, 2 or more kinds of monodispersed emulsions having different average grain sizes each other at an optional moment after forming grains.

As for the silver halide emulsion used in the invention, the one containing silver halide grains of the invention at the rate identical to or higher than that of the emulsion obtained by covering with shells monodispersed cores having the distribution area of 20% and less against total silver halide grains contained in the emulsion wherein the ratio of the silver halide grains of the invention to the total silver halide grains contained in the emulsion is identical to or higher than that of the emulsion obtained by covering with shells the monodispersed cores having the distribution area of 20% and less is preferable.

However, silver halide grains other than the invention are allowed to be contained within the range that the effect of the invention is not impeded. Aforesaid silver halide other than the invention is allowed to be either of a core/shell type or of a non-core/shell type and it is further allowed to be either monodispersed one or polydispersed one. In the silver halide emulsion used in the invention, it is preferable that at least 65% by weight of silver halide grains contained in aforesaid emulsion is the silver halide grains of the invention and it is desirable that almost all of silver halide grains in the emulsion are the silver halide grains of the invention.

As for other couplers for photographic use used in the invention, phenol type compounds and naphthol type compounds are preferable as a cyan coupler and they may be selected from the ones described, for example, in U.S. Pat. Nos. 2,369,929, 2,434,272, 2,474,293, 2,895,826, 3,253,924, 3,034,892, 3,311,476, 3,386,301, 3,419,390, 3,458,315 and 3,591,383 which also include synthesizing methods for those compounds.

In addition to magenta couplers of the invention, other magenta couplers may be used together with the former and the actual examples of aforesaid other magenta couplers are pyrazolone compounds, pyrazolinobenzimidazole compounds and indazolone compounds. As pyrazolone magenta couplers, the compounds described in U.S. Pat. Nos. 2,600,788, 3,062,653, 3,127,269, 3,311,476, 3,419,391, 3,519,429, 3,558,318, 3,684,514, 3,888,680, Japanese Patent O.P.I. Publication Nos. 29639/1974, 111631/1974, 129538/1974, 13041/1975, Japanese Patent Examined Publication Nos. 47167/1978, 10491/1979 and 30615/1980 are used and as diffusion-proof colored magenta couplers, the compounds wherein a coupling position of a colorless magenta coupler is substituted with arylazo are generally used and the examples thereof are described in U.S. Pat. Nos. 2,801,171, 2,983,608, 3,005,712, 3,684,514, British Pat. No. 937,621, Japanese Patent O.P.I. Publication Nos. 123625/1974 and 31448/1974. Further, the colored magenta coupler of the type wherein dyes flow out into processing solution during the reaction with oxidants of developing agents, which is identical to the one described in U.S. Pat. No. 3,419,391 is allowed to be used.

As a yellow coupler for photographic use, open chain ketomethylene compounds have been used and it is possible to use a benzoylacetanilide type yellow coupler and a pivaloylacetanilide type yellow coupler both of which are widely used. Further, a 2-equivalent type yellow coupler wherein a carbon atom in a coupling position is substituted with a substituent capable of splitting off during a coupling reaction may also be used advantageously. The examples of aforesaid yellow coupler are described together with synthesizing methods thereof in U.S. Pat. Nos. 2,875,057, 3,265,506, 3,664,841, 3,408,194, 3,277,155, 3,447,928, 3,415,652, Japanese Patent Examined Publication No. 13576/1974, Japanese Patent O.P.I. Publication Nos. 29432/1973, 68834/1973, 10736/1974, 122335/1974, 28834/1975 and 132926/1975.

An amount of aforesaid diffusion-proof coupler used in the invention is generally 0.05 mol-2.0 mol per 1 mol of silver in a photosensitive silver halide emulsion layer.

In the invention, DIR compounds are preferably used in addition to aforesaid diffusion-proof couplers.

Furthermore, in addition to DIR compounds, the compounds which discharge development inhibitors during the development are also included in the invention and the examples thereof are described in U.S. Pat. Nos. 3,297,445 and 3,379,529, West German OLS Pat. No. 2,417,914, Japanese Patent O.P.I. Publication Nos. 15271/1977, 9116/1978, 123838/1984 and 127038/1984.

DIR compounds used in the invention are the compounds capable of reacting on oxidants of developing agent and thereby discharging development inhibitors.

As a typical one of aforesaid DIR compounds, there is given a DIR coupler wherein a group capable of forming, when splitting from a coupling position, a compound having a development-inhibiting action is substituted to the coupling position of the coupler and the examples thereof are described in British Pat. No. 935,454, U.S. Pat. Nos. 3,227,554, 4,095,984 and 4,149,886.

Aforesaid DIR coupler has a property that the coupler parent group of the DIR coupler, during the coupling reaction on oxidants of developing agent, forms a dye and discharges, on the other hand, a development inhibitor. The present invention further includes the compounds which discharge, during the coupling reaction on oxidants of developing agents as described in U.S. Pat. Nos. 3,652,345, 3,928,041, 3,958,993, 3,961,959 and 4,052,213, Japanese Patent O.P.I. Publication Nos. 110529/1978, 13333/1979 and 161237/1980, the development inhibitors but do not form any dye.

Furthermore, the invention includes what is called a timing DIR compound which is a compound whose parent group forms, when reacting on oxidants of developing agent as described in Japanese Patent O.P.I. Publication Nos. 145135/1979, 114946/1981 and 154234/1982, a dye or a colorless compound, while, a timing group splitted off discharges development inhibitor through an intramolecular nucleophilic substitution reaction or an elimination reaction.

Further, the invention also includes a timing DIR compound wherein a timing group is connected to a coupler parent group that produces completely diffusive dye when reacting on oxidants of developing agent as described in Japanese Patent O.P.I. Publication Nos. 160954/1983 and 162949/1983.

As for an amount of DIR compound contained in a photosensitive material, the amount ranging from $1\times10^{-4}$ mol to $10\times10^{-1}$ mol per 1 mol of silver is preferably used.

A silver halide emulsion layer of the invention is allowed to contain various additives normally used according to purposes. For example, stabilizers and antifoggants such as azaindenes, triazoles, tetrazoles, imidazolium salts, tetrazolium salts and polyhydroxy compounds; hardeners of the types of aldehyde, aziridine, isoxyazole, vinyl sulfone, acryloyl, carbodiimido, maleimide, ester methanesulfonate and triazine; development accelerators such as benzyl alcohol and polyoxyethylene compounds: image stabilizers of the types of chroman, coumaran, bisphenyl and phosphorus ester; and lubricants such as wax, glyceride of higher fatty acid and higher alcohol ester of higher fatty acid are given. Further, coating aids as a surface active agent, penetrability-improving agents for processing solution, defoaming agents or materials for controlling various physical properties of photosensitive material such as the materials of an anion type, a cation type, a non-ion type and an amphoteric type are allowed to be used. As an antistatic agent, diacetyl cellulose, styreneperfluoroalkyllithiummalate copolymer and alkali salt of reactant between styrene-maleic anhydride copolymer and p-aminobenzenesulfonic acid are useful. As a matting agent, polymethyl methacrylate, polystyrene and alkali-soluble polymer are given. Colloidal silicon oxide may further be used. As a latex to be added for improving physical properties of a layer, copolymers polymerized from acrylic ester or vinyl ester and a monomer having other ethylene group are given. As a gelatin plasticizer, glycerol and glycol compounds are given and as a thickener, styrene-sodium maleate copolymer and alkylvinylether-maleic acid copolymer are given.

In silver halide color photographic materials of the invention, hydrophilic colloid used for preparing an emulsion and other coating solution for hydrophilic colloidal layers includes any of protein such as gelatin, derivative gelatin, graft polymer of gelatin and other high polymer, albumin and casein; cellulose derivative such as hydroxyethylcellulose derivative and carboxymethylcellulose; and homopolymer type or copolymer type synthesized hydrophilic high polymer such as starch derivative, polyvinylalcohol, polyvinylimidazole and polyacrylamide.

As a support for silver halide color photographic materials of the invention, there are given, as an example, a glass plate, polyester film such as cellulose acetate, cellulose nitrate or polyethylene-terephthalate, polyamide film, polycarbonate film and polystyrene film and further an ordinary reflective support (e.g. baryta paper, polyethylene-coated paper, polypropylene synthetic paper and transparent support provided with a reflective layer or having a reflective substance to be used together with transparent support) is also allowed to be used and these supports are selected according to the purpose of the application of photosensitive materials.

For coating arrangement of a silver halide emulsion layer used in the invention and other photographic structural layers, various types of coating methods such as a dipping coating method, an air doctor coating method, a curtain coating method and a hopper coating method are allowed to be used. Further, a method of simultaneous coating of 2 or more layers based on the means described in U.S. Pat. Nos. 2,761,791 and 2,941,893 may also be used.

The invention may be applied to silver halide color photosensitive materials such as color paper, color negative film, color positive film, color reversal film for slide, color reversal film for cinematography, color reversal film for TV and reversal color paper.

[EXAMPLES]

The invention will be explained as follows in detail referring to the examples which do not limit the embodiments of the invention.

EXAMPLE (1)

A multilayer color photosensitive material having, on its support of cellulose triacetate film, the layers each of which has a composition shown below was prepared.

First layer: antihalation layer
- gelatin layer containing black colloidal silver Second layer: interlayer (gelatin layer)

Third layer: first red-sensitive emulsion layer
- silver iodobromide (monodispersed spherical grains having an average grain size of 0.4 μm and containing silver iodide of 4.0 mol %)
  - coating weight of silver: 0.8 g/m$^2$
- silver iodobromide (monodispersed spherical grains having an average grain size of 0.5 μm and containing silver iodide of 4 mol %)
  - coating weight of silver: 0.8 g/m$^2$
- sensitizing dye I (mentioned below) . . . $6\times10^{-5}$ mol per mol of silver
- sensitizing dye II (mentioned below) . . . $1.0\times10^{-5}$ mol per mol of silver
- cyan coupler (mentioned below) . . . 0.044 mol per mol of silver Fourth layer: second red-sensitive emulsion layer
- silver iodobromide (monodispersed spherical grains having an average grain size of 1.0 μm and containing silver iodide of 6 mol %)
  - coating weight of silver: 2.0 g/m$^2$
- sensitizing dye I . . . $3.5\times10^{-5}$ mol per mol of silver
- sensitizing dye II . . . $1.0\times10^{-5}$ mol per mol of silver
- cyan coupler . . . 0.020 mol per mol of silver Fifth layer: interlayer
- Same as Second layer Sixth layer: first green-sensitive emulsion layer
- silver halide emulsion (Table 1)
  - coating weight of silver: 1.8 g/m$^2$
- sensitizing dye III (mentioned below) . . . $3.3\times10^{-5}$ mol per mol of silver
- sensitizing dye IV (mentioned below) . . . $1.1\times10^{-5}$ mol per mol of silver
- magenta coupler (Table 2) . . . 12 g per mol of silver Seventh layer: second green-sensitive emulsion layer
- silver halide emulsion (Table 1)
  - coating weight of silver: 1.8 g/m$^2$
- sensitizing dye III . . . $2.65\times10^{-5}$ mol per mol of silver
- sensitizing dye IV . . . $0.89\times10^{-5}$ mol per mol of silver
- magenta coupler (Table 2) . . . 0.02 mol per mol of silver Eighth layer: yellow filter layer
- gelatin layer wherein yellow colloid is contained in gelatin aqueous solution Ninth layer: first blue-sensitive emulsion layer
- silver iodobromide (monodispersed spherical grains having an average grain size of 0.4 μm and containing silver iodide of 5.6 mol %)
  - coating weight of silver: 1.5 g/m$^2$ Tenth layer: second blue-sensitive emulsion layer silver iodobromide (spherical grains having an average grain size of 0.90 μm and containing silver iodide of 6 mol %)

coating weight of silver: 1.21 g/m² yellow coupler . . . 0.06 per mol of silver

Eleventh layer: first protective layer silver iodobromide (silver iodide: 1 mol %, average grain size 0.07 μm)

coating weight of silver: 0.5 g gelatin layer containing emulsified and dispersed UV absorbing agent Twelfth layer: second protective layer gelatin layer containing trimethylmethacrylate grains (diameter 1.5 μm)

Gelatin hardener and surface active agent were added to each layer in addition to aforesaid composing substances.

sensitizing dye I: anhydro-5,5'-dichloro-3,3'-(γ-sulfopropyl)-9-ethylthiacarbocyaninehydroxide•pyridinium salt sensitizing dye II: anhydro-9-ethyl-3,3'-di-(γ-sulfopropyl)-4,5,4',5'-dibenzothiacarbocyaninehydroxide•triethylamine salt sensitizing dye III: anhydro-9-ethyl-5,5'-dichloro 3,3'-di-(γ-sulfopropyl)oxacarbo-cyanine•sodium salt sensitizing dye IV: anhydro-5,6,5',6'-tetradichloro-1,1'-diethyl-3,3'-di-{β-[β-(γ-sulfopropoxy)ethoxy]-}ethylimidazolocarbocyanine-hydroxide•sodium salt

TABLE (1)

| | emulsion No. | silver halide | J content (mol %) | grain size | thickness of shell |
|---|---|---|---|---|---|
| Sixth layer | A | AgBrJ | 1.0 | 0.4 μm | — |
| first | B | " | 3.5 | " | — |
| green-sensitive | C | " | 1.0 | " | 0.03 μm |
| emulsion | D | " | 3.5 | " | " |
| layer | E | AgBr | — | " | — |
| Seventh layer | F | AgBrJ | 1.0 | 1.0 μm | — |
| second | G | " | 3.5 | " | — |
| green-sensitive | H | " | 1.0 | " | 0.03 μm |
| emulsion | *I | " | 3.5 | " | " |

TABLE (1)-continued

| | emulsion No. | silver halide | J content (mol %) | grain size | thickness of shell |
|---|---|---|---|---|---|
| layer | J | AgBr | — | " | — |

(note)
*the present invention
Cyan coupler (comparative)

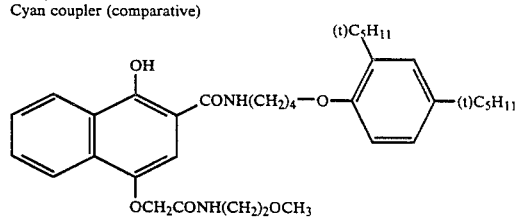

Yellow coupler

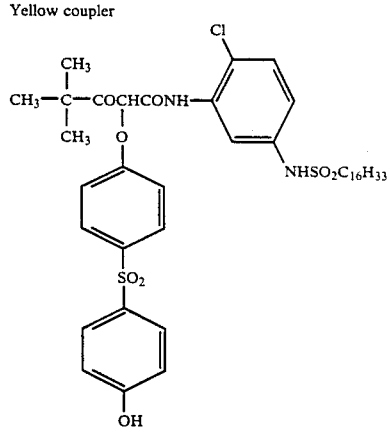

Aforesaid photosensitive materials were processed continuously by an automatic processor according to the following steps. The automatic processor used was a modified suspension type Film Automatic Processor Type H4-220W-2 made by Noritsu Koki Co.

| processing step (38° C.) | number of tank | processing time |
|---|---|---|
| color development | 1 | 3 min 15 sec |
| bleaching | 2 | 6 min 30 sec |
| washing in small amount of water | 1 | 3 min 15 sec |
| fixing | 1 | 6 min 30 sec |
| washing | 2 | 4 min 20 sec |
| stabilizing | 1 | 2 min 10 sec |

The composition of color developer used was as follows.

| | |
|---|---|
| potassium carbonate | 30 g |
| sodium hydrogencarbonate | 2.5 g |
| potassium sulfite | 5 g |
| sodium bromide | 0.1 g |
| potassium iodide | 2 mg |
| hydroxylamine sulfate | 2.5 g |
| sodium chloride | 0.6 g |
| 4-amino-3-methyl-N—ethyl-N—(β-hydroxylethyl)aniline sulfate | 4.8 g |
| potassium hydroxide | 1.2 g |
| add water to make | 1 l |
| adjust the pH value with potassium hydroxide or 20% sulfuric acid to | pH 10.06 |

The composition of replenisher for color development was as follows.

| | |
|---|---|
| potassium carbonate | 40 g |
| sodium hydrogencarbonate | 3 g |
| potassium sulfite | 7 g |
| sodium bromide | $2.5 \times 10^{-3}$ mol |
| hydroxylamine sulfate | 3.1 g |
| 4-amino-3-methyl-N—ethyl-N—(β-hydroxylethyl)aniline sulfate | 6.0 g |
| potassium hydroxide | 2 g |
| add water to make | 1 l |
| adjust the pH value with potassium hydroxide or 20% sulfuric acid to | pH 10.12 |

The composition of bleaching solution used was as follows.

| | |
|---|---|
| ferric-ammonium ethylenediamine-tetra acetic acid | 100 g |
| disodium ethylenediamine acetic acid | 10 g |
| ammonium bromide | 150 g |
| glacial acetic acid | 10 ml |
| add water to make | 1 l |
| adjust the pH value with aqueous ammonia or glacial acetic acid to | pH 5.8 |

The composition of replenisher for bleaching used was as follows.

| | |
|---|---|
| ferric-ammonium ethylenediamine-tetra acetic acid | 120 g |
| disodium ethylenediamine-tetra acetic acid | 12 g |
| ammonium bromide | 178 g |
| glacial acetic acid | 21 ml |
| add water to make | 1 l |
| adjust the pH value with aqueous ammonia or glacial acetic acid to | pH 5.6 |

The composition of fixer used was as follows.

| | |
|---|---|
| ammonium thiosulfate | 150 g |
| anhydrous sodium bisulfite | 12 g |
| sodium metabisulfite | 2.5 g |
| disodium ethylenediaminetetra acetic acid | 0.5 g |
| sodium carbonate | 10 g |
| add water to make | 1 l |

The composition of replenisher for fixing was as follows.

| | |
|---|---|
| ammonium thiosulfate | 200 g |
| anhydrous sodium bisulfite | 15 g |
| sodium metabisulfite | 3 g |
| disodium ethylenediaminetetra acetic acid | 0.8 g |
| sodium carbonate | 14 g |
| add water to make | 1 l |

The composition of stabilizing solution used was as follows.

| | |
|---|---|
| formalin (37% water solution) | 3 ml |
| Konidax (made by Konishiroku Photo Ind. Co., Ltd.) | 7 ml |
| add water to make | 1 l |

The replenisher for color development was replenished to the color developing bath in the amount of 8.0 ml per 100 $cm^2$ of color negative film, the replenisher for bleaching was replenished to the bleaching bath in the amount of 18 ml per 100 $cm^2$ of color negative film, the replenisher for fixing was replenished to the fixing bath in the amount of 7 ml per 100 $cm^2$ of color negative film and further the replenisher for stabilizing was replenished to the stabilizing bath in the amount of 11 ml per 100 $cm^2$ of color negative film. Further, water in the amount of 30 ml per 100 $cm^2$ of color negative film was replenished to the washing bath of small amount of water and water in the amount of 150 ml per 100 $cm^2$ of color negative film was poured to the washing bath.

The color negative film in the amount of 1000 $m^2$ was continuously processed with a fixing bath whose pH value was kept at 6.5 constantly through the continuous processing by adding ammonium hydroxide or acetic acid properly to aforesaid replenisher for fixing.

On the other hand, with the purpose of comparing, 1000 $m^2$ of the respective samples were continuously processed in a developing process for which a relatively larger amount of developing replenishers are used, which has so far popularly been used. (Hereinafter caled a CNK-4 standard process.)

Such CNK-4 process is the same as the process used in the aforementioned experiments, except that an amount of sodium bromide used in the developing solution, a concentration of sodium bromide used in the developing replenisher and the replenishing amount thereof are changed to those indicated below:

| | Process for Experiments | CNK-4 standard process |
|---|---|---|
| Amount of NaBr in Developer: | 0.1 g/l | 1.2 g/l |
| Concentration of NaBr in Replenisher: | $2.5 \times 10^{-3}$ mol/l | $8.8 \times 10^{-3}$ mol/l |
| Amount replenished: | 8.0 ml/100 $cm^2$ | 14.8 ml/100 $cm^2$ |

At the points of time when starting and completing the continuous process of 1000 $m^2$ each of the samples, the light-sensitive characteristics thereof were measured in such a manner that they were exposed to white light through a step wedge by making use of a photosensitometer, Model KS-7 manufactured by KONISHIROKU PHOTO INDUSTRY CO., LTD., Japan, and then processed. On each of the samples, an ordinary scene was taken by making use of a camera, Model FS-1, manufactured by KONISHIROKU PHOTO INDUSTRY CO., LTD., Japan.

The characteristics of the samples each obtained at the point of time when starting the processing were almost the same therebetween, however, every sample was observed some variations in their characteristics at the point of time when 1000 $m^2$ each of them were processed.

Table (2) exhibits the respective results obtained from the samples, with respect to the absolute values of the gamma difference ($|\Delta\gamma|$) and the minimum density difference ($\Delta D_{min}$) obtained after completing 1000 $m^2$ each thereof were processed in the process of the invention and the CNK-4 standard process, respectively.

In the density measurements, the green-light transmission density of each sample was measured by making use of a SAKURA Optical Densitometer, Model PDA- 65, manufactured by KONISHIROKU PHOTO INDUSTRY CO., LTD., Japan.

TABLE (2)

| Sample No. | Silver halide of 6th layer | Silver halide of 7th layer | Magenta Coupler | Process stability $\lvert\Delta\gamma\rvert$ | Minimum density difference ($\Delta D_{min}$) (transmission density for green light) |
|---|---|---|---|---|---|
| 1 | A | F | comparative (1) | 0.24 | 0.17 |
| 2 | " | " | comparative (2) | 0.27 | 0.20 |
| 3 | " | " | exemplified compound 18 | 0.21 | 0.17 |
| 4 | " | " | exemplified compound 44 | 0.19 | 0.17 |
| 5 | B | G | comparative (1) | 0.18 | 0.11 |
| 6 | " | " | comparative (2) | 0.20 | 0.13 |
| 7 | " | " | exemplified compound 18 | 0.13 | 0.08 |
| 8 | " | " | exemplified compound 44 | 0.11 | 0.10 |
| 9 | C | H | comparative (1) | 0.13 | 0.12 |
| 10 | " | " | comparative (2) | 0.17 | 0.14 |
| 11 | " | " | exemplified compound 18 | 0.10 | 0.10 |
| 12 | " | " | exemplified compound 44 | 0.09 | 0.09 |
| 13 | D | I | comparative (1) | 0.12 | 0.08 |
| 14 | " | " | comparative (2) | 0.14 | 0.09 |
| 15* | " | " | exemplified compound 18 | 0.01 | 0.01 |
| 16* | " | " | exemplified compound 44 | 0.01 | 0.02 |
| 17 | E | J | comparative (1) | 0.32 | 0.21 |
| 18 | " | " | comparative (2) | 0.38 | 0.23 |
| 19 | " | 1 | exemplified compound 18 | 0.32 | 0.20 |
| 20 | " | " | exemplified compound 44 | 0.29 | 0.23 |

*the present invention

The symbol $\gamma$ represents an average $\gamma$ of minimum density ranging from +3.0 to 1.2.

comparative coupler (1)

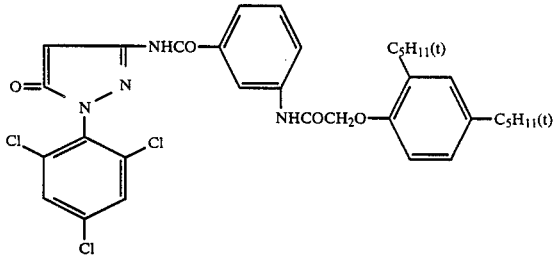

comparative coupler (2)

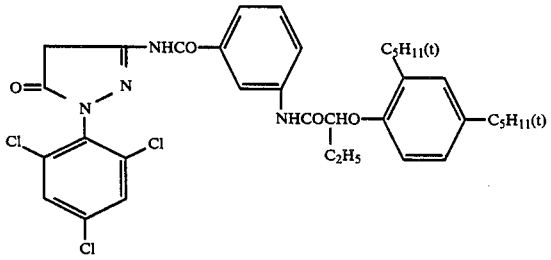

As is apparent from the results shown in Table (2), it is understood that the Sample Nos. 15 and 16 each using the Emulsions D and I of the invention, which are of the core/shell type, comprising a silver halide that is silver iodobromide containing not less than 3 mol% iodine and the Exemplified couplers of the invention to serve as the couplers; such samples have almost no difference in processing variation and in minimum density variation when processed in the process of the invention and even when processed in the CNK-4 standard process which requires a large amount of replenishers, so that almost the same gamma value and the minimum density value can be obtained; and in contrast with the above, the minimum density variation is too great and the $\gamma$-stability is too poor to be put to practical use in the case of the emulsion containing no silver iodide. The results in Table (2) also show that, even if the emulsion is a silver iodobromide emulsion, it shows the same tendency as that of aforesaid emulsion containing no silver iodide, when the silver iodobromide emulsion is not of a core/shell type and the content of iodine is low.

As for a magenta coupler, it is understood that the couplers other than those of the invention are remarkably poor in the process stability.

Incidentally, exemplified compounds for magenta coupler of the invention 7, 15, 22, 41, 100, 104 and 117 were examined and the same effect as that of Table (2) was obtained.

EXAMPLE (2)

Samples were prepared in the same manner as in the Sample (15) of Example (1) except that the magenta couplers were replaced by those described in Table (4), and the resulted samples were evaluated in the same manner that was taken for Example (1), except that the sodium bromide concentration in each of the color developing replenishers were changed to those shown in Table (3).

TABLE (3)

(Process stability ($\lvert\Delta\gamma\rvert$))

| Sample No. | magenta coupler | Replenisher (in ml) & Sodium bromide concentration (in mol/l): 15 ml, $1.0 \times 10^{-2}$ mol/l | 15 ml, $3.0 \times 10^{-3}$ mol/l | 15 ml, $1.0 \times 10^{-3}$ mol/l | 9 ml, $1.0 \times 10^{-2}$ mol/l | 9 ml, $3.0 \times 10^{-3}$ mol/l | 9 ml, $1.0 \times 10^{-3}$ mol/l | 6 ml, $1.0 \times 10^{-2}$ mol/l | 6 ml, $3.0 \times 10^{-3}$ mol/l | 6 ml, $1.0 \times 10^{-3}$ mol/l |
|---|---|---|---|---|---|---|---|---|---|---|
| 31 | compara- | 0.15 | 0.24 | 0.33 | 0.27 | 0.15 | 0.12 | 0.36 | 0.23 | 0.17 |

TABLE (3)-continued

| Sample No. | magenta coupler | (Process stability (\|Δγ\|)) Replenisher (in ml) & Sodium bromide concentration (in mol/l) 15 ml 1.0 × $10^{-2}$ mol/l | 15 ml 3.0 × $10^{-3}$ mol/l | 15 ml 1.0 × $10^{-3}$ mol/l | 9 ml 1.0 × $10^{-2}$ mol/l | 9 ml 3.0 × $10^{-3}$ mol/l | 9 ml 1.0 × $10^{-3}$ mol/l | 6 ml 1.0 × $10^{-2}$ mol/l | 6 ml 3.0 × $10^{-3}$ mol/l | 6 ml 1.0 × $10^{-3}$ mol/l |
|---|---|---|---|---|---|---|---|---|---|---|
| | tive (3) | | | | | | | | | |
| 32 | comparative (4) | 0.18 | 0.26 | 0.34 | 0.28 | 0.18 | 0.13 | 0.36 | 0.25 | 0.19 |
| 33 | exemplified compound 5 | 0.08 | 0.15 | 0.21 | 0.11 | 0.01 | 0 | 0.13 | 0 | 0 |
| 34 | exemplified compound 59 | 0.10 | 0.17 | 0.23 | 0.12 | 0 | 0 | 015 | 001 | 0 |
| 35 | exemplified compound 104 | 0.11 | 0.18 | 0.25 | 0.12 | 0.01 | 0 | 0.16 | 0.01 | 0 |

comparative magenta coupler (3)

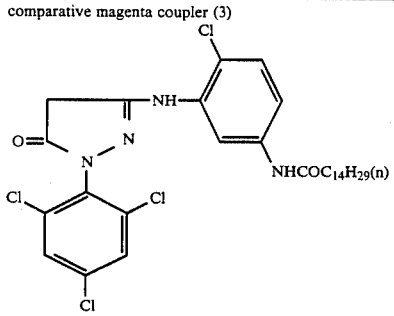

comparative magenta coupler (4)

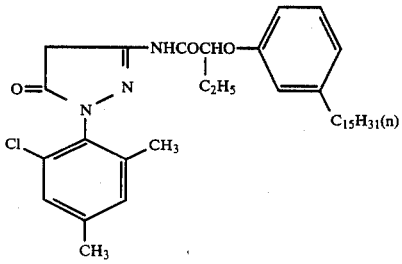

It is clearly understood in Table (3) that the process variation is great when magenta couplers other than those of the invention are used, even if the concentration of sodium bromide in the color developer and the replenishing amount are increased but the magenta couplers of the invention offer the remarkable effect despite the replenishment in a small amount and the concentration of sodium bromide as low as $3.0\times10^{-3}$ mol/l and below. Despite the use of magenta couplers of the invention, no effect on the process variation is observed at all when the replenishing amount other than that of the invention and the concentration of sodium bromide other than that of the invention are used.

EXAMPLE (3)

In order to evaluate an effect of the invention on secondary iron ion and thiosulfate, 0 ppm, 5 ppm and 10 ppm of secondary iron ion and 0 ppm, 20 ppm and 50 ppm of sodium thiosulfate were added respectively to each of the samples of Example (1) and then the process stability (|Δγ|) and the minimum density variation were examined, using (7), (12), (52'), (93) and (88) as a sequestering agent. As a result of the evaluation, the process variation and the minimum density variation both affected by secondary iron ion and sodium thiosulfate were small only when the emulsions and couplers of the invention were used, similarly to Example (1) and the use of aforesaid sequestering agent offered remarkable effects.

EXAMPLE (4)

Sample Nos. 41 through 43 were prepared respectively in the same manner as in Example (1), except that the cyan couplers used in the Example (1) were replaced by the cyan couplers shown in Table (4).

The resulted samples were processed in the same manner as in Example (1). The results thereof are shown in Table (4). In the table, the data of the Examples 16 and 14 obtained in Example (1) are also shown for the comparison purpose.

The characteristics of the cyan images thereof were obtained by measuring the red-light transmission density with the same optical densitometer used in Example (1).

As is obvious from the results shown in Table (4), the processing stability (i.e., $\Delta D_{min}$ in green density) of magenta images can further be improved and, at the same time, the processing stability [i.e., |Δγ|, $\Delta D_{min}$ (fog and stain) in red density] can also remarkably be improved.

The exemplified cyan couplers, C-2, C-14, C-29, C-51, C-86, C-88, C-96 and C-101 were also tested. The results therefrom were almost the same as those shown in Table (3).

TABLE (4)

| sample No. | Magenta coupler | Cyan coupler | Processing stability in red $\lvert\Delta\gamma\rvert$ | Minimum density difference in red(ΔDmin) | Minimum density difference in greed(ΔDmin) |
|---|---|---|---|---|---|
| 16 | Exemplified compound 44 | Coupler used in Example(1) | 0.08 | 0.11 | 0.02 |
| 14 | Comparative coupler(2) | Coupler used in Example(1) | 0.11 | 0.08 | 0.09 |
| 41 | Exemplified compound 44 | Exemplified compound C-8 | 0.02 | 0.01 | 0.01 |
| 42 | Exemplifed compound 44 | Exemplified compound C-36 | 0.02 | 0.02 | 0.01 |
| 43 | Comparative coupler(2) | Exemplified compound C-8 | 0.04 | 0.05 | 0.13 |

EXAMPLE (5)

With respect to the Samples No. 31 and No. 33 both prepared in Example (2), each of the gamma-difference ($\lvert\Delta\gamma\rvert$) between that at the time of starting and that at the time of completing a continuous processing was measured in the same manner as in Example (2), and the processing variations thereof were evaluated. The results thereof are shown in Table (5).

TABLE (5)

| | | Process variation ($\lvert\Delta\gamma\rvert$) | | | | | | | | |
|---|---|---|---|---|---|---|---|---|---|---|
| | | 15 ml | | | 9 ml | | | 6 ml | | |
| Sample No. | Magenta coupler | $1.0\times10^{-2}$ | $3.0\times10^{-3}$ | $1.0\times10^{-3}$ | $1.0\times10^{-2}$ | $3.0\times10^{-3}$ | $1.0\times10^{-3}$ | $1.0\times10^{-3}$ | $3.0\times10^{-3}$ | $1.0\times10^{-3}$ |
| 31 | Comparative coupler(3) | 0.08 | 0.12 | 0.20 | 0.14 | 0.09 | 0.07 | 0.21 | 0.14 | 0.10 |
| 33 | Exemplified compound(5) | 0.06 | 0.11 | 0.17 | 0.10 | 0.02 | 0.01 | 0.11 | 0.03 | 0.02 |

As is obvious from the above-given Table (5), it can be observed that the Sample No. 33 in which the couplers of the invention were used is relatively less in $\gamma$ variation at the time of starting and completing a continuous processing and, in particular, it displays remarkable effects in the cases of a replenishing amount and a concentration of sodium bromide in the invention.

The same effects can also be obtained when the Exemplified Compounds Nos. 7, 18, 59 and 104 each are used in place of the Exemplified compound (5).

What is claimed is:

1. A processing method of an image-wise exposed silver halide color photographic light-sensitive material comprising a replenishing process to replenish a color developer-replenisher to a color developer being used for said processing, wherein said silver halide color photographic material comprises at least one emulsion layer comprising a core-shell structural silver halide grain containing not less than 3 mol% of silver iodide and a magenta coupler represented by the following general formula [I], and said color developer replenisher contains 0 to $3.0\times10^{-3}$ mol of bromide per liter and a replenishing volume of said color developer-replenisher to be replenished to said color developer is 0.5 to 9 ml per 100 $cm^2$ of said silver halide color photographic light-sensitive material:

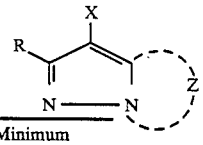

[I]

wherein,

Z represents a group of non-metallic atoms necessary to form a nitrogen-containing heterocyclic ring;

X represents a hydrogen atom or a substituent which is, upon a reaction with an oxidation product of a color developing agent, capable of being released from the coupler residue;

and R represents a hydrogen atom, substituent.

2. The processing method of claim 1, wherein said color developer contains a chelating agent represented by the general formula [XII], [XIII] or [XIV]:

[XII] A—COOM

[XIII] B—$PO_3M_2$

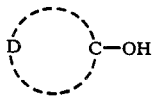

[XIV]

wherein,

A and B represent a monovalent atom, or a monovalent inorganic or organic group;

D represents a group of non-metallic atoms necessary to complete an aromatic ring or a heterocyclic ring;

and M represents a hydrogen atom or an alkali metal atom.

3. The processing method of claim 2, wherein said color developer replenisher contains 0 to $2.0\times10^{-3}$ mol of a bromide.

4. The processing method of claim 1, wherein said magenta coupler is represented by the general formula [VIII]:

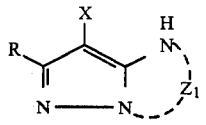

[VIII]

wherein, $Z_1$, X, R, represent the same atoms or groups represented by Z, X, R of the formula [I], respectively.

5. The processing method of claim 4, wherein said magenta coupler is represented by the general formula [II]:

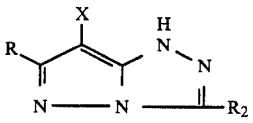

[II]

wherein,

R represents the same atoms or groups represented by R of the formula [I];

X is the same as X of the formula [I];

and $R_2$ represents a substituent.

6. The silver halide photographic material of claim 1, wherein said R represents a hydrogen atom, a halogen atom or a monovalent group selected from the group consisting of an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a residue of spiro compounds, a residue of bridged hydrocarbons, an alkoxy group, an aryloxy group, a heterocycloxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclic group.

7. The processing method of claim 6, wherein said R is represented by the general formula [IX]:

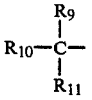

[IX]

wherein, said $R_9$, $R_{10}$ and $R_{11}$ represent a hydrogen atom, a halogen atom or a group selected from the group consisting of a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a residue of spiro compounds, a residue of bridged hydrocarbons, an alkoxy group, an aryloxy group, a heterocycloxy group, a cyloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclic group, respectively, provided that at least two of $R_9$, $R_{10}$ and $R_{11}$ shall not be hydrogen atoms.

8. The processing method of claim 7, wherein two of said $R_9$, $R_{10}$ and $R_{11}$ are alkyl groups, respectively.

9. The processing method of claim 7, wherein two of said $R_9$, $R_{10}$ and $R_{11}$ form a saturated or unsaturated ring.

10. The processing method of claim 9, wherein one of said $R_9$, $R_{10}$ and $R_{11}$ is a hydrogen atom and group represented remaining two of them form a cycloalkyl ring with the carbon atoms combined with said two groups.

11. The processing method of claim 5, wherein $R_2$ is represented by the general formula [X]:

[X] $—R^1—SO_2—R^2$ wherein, $R^1$ represents an alkylene group, and $R^2$ represents an alkyl group, a cycloalkyl group or an aryl group.

12. The processing method of claim 1, wherein said color developer contains a chelating agent represented by the general formula [XV]:

[XV] $M_mP_mO_{3m}$ wherein,

M represents a hydrogen atom or an alkali metal atom, and m represents an integer of 3 to 6.

13. The processing method of claim 2, wherein said chelating agent represented by the general formula [XII] is represented by the general formula [XVII]:

[XVII] $A_1—R_{21}—Z—R_{22}—COOH$ wherein,

Z represents $=N—R_{27}—A_6$ or $=N—A_6$, $A_2$ and $A_6$ independently represents a hydrogen atom, —OH, —COOM, or $—PO_3M_2$, $R_{21}$, $R_{22}$ and $R_{27}$ independently represents a substituted or unsubstituted alkylene group;

and M is the same as M of the general formula [XII].

14. The processing method of claim 1, wherein said color developer contains a chelating agent represented by the general formula [XXII]:

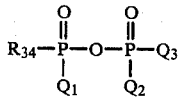

[XXII]

wherein, $R_{34}$ represents a group selected from the group consisting of an alkyl group containing 1 to 12 carbon atoms, an alkoxy group containing 1 to 12 carbon atoms, a monoalkylamino group containing 1 to 12 carbon atoms, a dialkylamino group containing 2 to 12 carbon atoms, an amino group, an allyloxy group containing 1 to 24 carbon atoms, an arylamino group containing 6 to 24 carbon atoms, and an amyloxy group;

$Q_1$, $Q_2$ and $Q_3$ independently represent a group selected from the group consisting of —OH, an alkoxy group containing 1 to 24 carbon atoms, an aralkyloxy group containing 1 to 24 carbon atoms, an alkoxy group containing 1 to 24 carbon atoms, —OM′ (M′ is a cation), an amino group, a morpholino group, a cyclic amino group, an alkylamino group, a dialkylamino group, an arylamino group and an alkyloxy group.

15. The processing method of claim 2, wherein said chelating agent represented by the general formula [XIV] is represented by the general formula [XXIII]:

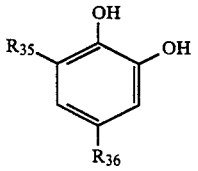

[XXIII]

wherein, $R_{35}$ and $R_{36}$ independently represent a hydrogen atom, a halogen atom or a group selected from the group consisting of a sulfonic acid group, an alkyl group containing 1 to 7 carbon atoms, —$OR_{39}$, —$COOR_{40}$, $$-CON\begin{matrix}R_{41}\\R_{42}\end{matrix},$$

and a phenyl group in which $R_{39}$, $R_{40}$, $R_{41}$, and $R_{42}$ independently represent a hydrogen atom or an alkyl group containing 1 to 18 carbon atoms.

16. The processing method of claim 2, wherein said chelating agent represented by the general formula [XIV] is represented by the general formula [XXV]:

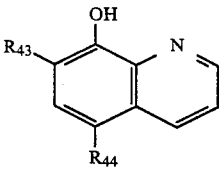

[XXV]

wherein, $R_{43}$ and $R_{44}$ independently represent a hydrogen atom, a halogen atom or a sulfonic acid group.

17. The processing method of claim 1, wherein said color developer contains a chelating agent represented by the general formula [XXVI]:

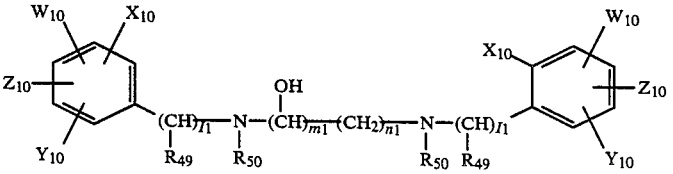

[XXVI]

wherein, $R_{49}$ and $R_{50}$ independently represent a hydrogen atom or a group selected from the group consisting of a phosphoric acid group, a carbonic acid group —$CH_2COOH$, —$CH_2PO_3H_2$, and their salts, $X_{10}$ represents a hydroxy group or its salts;

$W_{10}$, $Z_{10}$ and $Y_{10}$ independently represent a hydrogen atom, a halogen atom or a group selected from the group consisting of a hydroxy group, a cyano group, a carbonic acid group, a phosphoric acid group, a sulfonic acid group, and their salts, an alkoxy group, and an alkyl group;

$m_1$ represents an integer of 0 or 1;

$n_1$ represents an integer of 1 to 4;

$I_1$ represents an integer of 1 or 2;

$p_1$ represents an integer of 0 to 3;

and $q_1$ represents an integer of 0 to 2.

18. The processing method of claim 2, wherein a content of said chelating agent in said color developer is within the range of $1\times10^{-4}$ to 1 mol/l.

19. The processing method of claim 1, wherein a content of silver iodide in a core of said core-shell structural silver halide grain is within the range of 0.5 to 10 mol%.

20. The processing method of claim 1, wherein a shell of said core-shell structural silver halide grain consists of silver bromide or silver bromoiodide.

21. The processing method of claim 4, wherein said R represents a hydrogen atom, a halogen atom or a monovalent group selected from the group consisting of an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group a cyano group, a residue of spiro compounds, a residue of bridged hydrocarbons, an alkoxy group, an aryloxy group, a heterocycloxy group, a siloxy group, an acyloxy group, a carbamoyloxy group, an amino group, an acylamino group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclic group.

22. The silver halide photographic material of claim 5, wherein said R represents a hydrogen atom, a halogen atom or a monovalent group selected from the group consisting of an alkyl group, a cycloalkyl group, an alkenyl group, a cycloalkenyl group, an alkynyl group, an aryl group, a heterocyclic group, a sulfonyl group, a sulfinyl group, a phosphonyl group, a carbamoyl group, a sulfamoyl group a cyano group a residue of spiro compounds, a residue of bridged hydrocarbons, an alkoxy group, an aryloxy group, a heterocycloxy group, a siloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclic group.

23. The process method of claim 4, wherein said R is represented by the general formula [IX]:

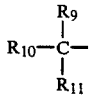

[IX]

wherein, said $R_9$, $R_{10}$ and $R_{11}$ represent a hydrogen atom, a halogen atom or a group selected from the group consisting of a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a residue of spiro compounds, a residue fo bridged hydrocarbons, an alkoxy group, an aryloxy group, a heterocycloxy group, a cyloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclic group, respectively, provided that at least two of $R_9$, $R_{10}$ and $R_{11}$ shall not be hydrogen atoms.

24. The process method of claim 5, wherein said R is represented by the general formula [IX]:

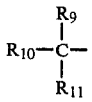

[IX]

wherein, said $R_9$, $R_{10}$ and $R_{11}$ represent a hydrogen atom, a halogen atom or a group selected from the group consisting of a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a residue of spiro compounds, a residue of bridged hydrocarbons, an alkoxy group, an aryloxy group, a heterocycloxy group, a cyloxy group, an acyloxy group, a carbamoyloxy group, an amino group, an acylamino group, a sulfonamido group, an imido group, a ureido group, a sulfamoylamino group, an alkoxycarbonylamino group, an aryloxycarbonylamino group, an alkoxycarbonyl group, an aryloxycarbonyl group, an alkylthio group, an arylthio group, and a heterocyclic group, respectively, provided that at least two of $R_9$, $R_{10}$ and $R_{11}$ shall not be hydrogen atoms.

25. The processing method of claim 2, wherein said chelating agent represented by the general formula [XXIV]:

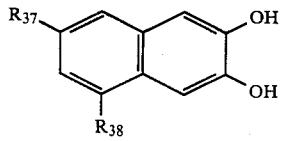

[XXIV]

wherein, $R_{37}$ and $R_{38}$ independently represent a hydrogen atom, a halogen atom or a group selected from the group consisting of a sulfonic acid group, an alkyl group containing 1 to 7 carbon atoms, $—OR_{39}$, $—COOR_{40}$,

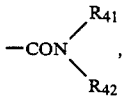

and a phenyl group in which $R_{39}$, $R_{40}$, $R_{41}$, and $R_{42}$ independently represent a hydrogen atom or an alkyl group containing 1 to 18 carbon atoms.

26. The processing method of claim 1, wherein said color developer contains a chelating agent represented by the general formula [XVI]:

[XVI] $M_{n+2}P_nO_{3n+1}$ wherein, M represents a hydrogen atom or an alkali metal atom and n represents an integer of 2 to 20.

27. The processing method of claim 1, wherein said color developer contains a chelating agent represented by the general formula [XIX]:

[XIX] $R_{28}—N(CH_2PO_3M_2)_2$ wherein, $R_{28}$ represents a group selected from the group consisting of a lower class alkyl group, an aryl group, an alalkyl group, or a nitrogen-containing six membered heterocyclic group, —OH, —OR and —COOM;

and M represents a hydrogen atom or an alkali metal atom.

28. The processing method of claim 1, wherein said color developer contains a chelating agent represented by the general formula [XX]:

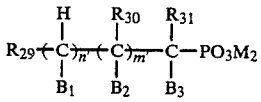

[XX]

wherein, $R_{29}$, $R_{30}$ and $R_{31}$ represent a hydrogen atom or a lower class alkyl group, which may have —OH, —COOM, or $—PO_3M_2$ as a substituent;

$B_1$, $B_2$ and $B_3$ independently represent a hydrogen atom or a group selected from the group consisting of —OH, —COOM, $—PO_3M_2$ and $—NJ_2$ in which J represents a hydrogen atom, a lower class alkyl group, $—C_2H_4OH$ or $PO_3M_2$ and M represents a hydrogen or an alkali metal atom and m' and n' represents an integer of 0 or 1, respectively.

29. The processing method of claim 1, wherein said color developer contains a chelating agent represented by the general formula [XXI]:

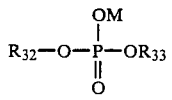

[XXI]

wherein, $R_{32}$ and $R_{33}$ represent a hydrogen atom, an alkali metal atom or a group selected from the group consisting of an alkyl group, an alkenyl group, and a cycloalkyl group, each containing 1 to 12 carbon atoms, and M represents a hydrogen atom or an alkali metal atom.

30. The processing method of claim 1, wherein said color developer contains a chelating agent represented by the general formula [XVIII]:

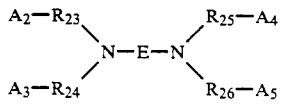

[XVIII]

wherein,

E represents a group selected from the group consisting of an alkylene group, a cycloalkylene group, a phenylene group, $—R_{27}—OR_{27}—$, $—R_{27}—OR_{27}OR_{27}—$, and $R_{27}Z_2R_{27}—$, in which $Z_2$ represents $>N—R_{27}—A_6$ or $>N—A_6$;

$A_2$, $A_3$, $A_4$, $A_5$ and $A_6$ independently represent a hydrogen atom, —OH, —COOM, or $—PO_3M_2$, $R_{24}$, $R_{25}$, $R_{26}$ and $R_{27}$, independently represent a substituted or unsubstituted alkylene group, and M represents a hydrogen atom or an alkali metal atom.

* * * * *